US011673019B2

(12) United States Patent
Venturella et al.

(10) Patent No.: US 11,673,019 B2
(45) Date of Patent: Jun. 13, 2023

(54) ELLIPTICAL EXERCISE MACHINE

(71) Applicant: NAUTILUS, INC., Vancouver, WA (US)

(72) Inventors: Brian Venturella, Vancouver, WA (US); Jeffrey A. Tracy, Troutdale, OR (US)

(73) Assignee: NAUTILUS, INC., Vancouver, WA (US)

( * ) Notice: Subject to any disclaimer, the term of this patent is extended or adjusted under 35 U.S.C. 154(b) by 121 days.

(21) Appl. No.: 17/136,947

(22) Filed: Dec. 29, 2020

(65) Prior Publication Data

US 2021/0275865 A1 Sep. 9, 2021

Related U.S. Application Data

(63) Continuation-in-part of application No. 16/808,221, filed on Mar. 3, 2020, now Pat. No. 11,413,497.

(51) Int. Cl.
*A63B 22/06* (2006.01)
*A63B 24/00* (2006.01)

(52) U.S. Cl.
CPC ..... *A63B 22/0664* (2013.01); *A63B 24/0075* (2013.01); *A63B 24/0087* (2013.01); *A63B 2022/0682* (2013.01); *A63B 2024/009* (2013.01)

(58) Field of Classification Search
None
See application file for complete search history.

(56) References Cited

U.S. PATENT DOCUMENTS 5,685,804 A * 11/1997 Whan-Tong ..... A63B 22/0015 482/57
5,957,814 A * 9/1999 Eschenbach ..... A63B 22/0664 482/57
5,997,445 A * 12/1999 Maresh ..... A63B 22/0664 482/70
6,024,676 A * 2/2000 Eschenbach ..... A63B 22/001 482/52

(Continued)

FOREIGN PATENT DOCUMENTS

DE 202004015622 U1 * 1/2005 ..... A63B 21/005

OTHER PUBLICATIONS

International Search Report and Written Opinion for PCT Appl. No. PCT/US2021/020556 dated Jun. 11, 2021.

(Continued)

*Primary Examiner* — Sundhara M Ganesan
*Assistant Examiner* — Shila Jalalzadeh Abyaneh
(74) *Attorney, Agent, or Firm* — Dorsey & Whitney LLP

(57) ABSTRACT

An exercise machine may include a reciprocating linkage that supports one or more pedals configured to move in a closed loop (e.g., elliptical) path as a user exercises with the machine. The exercise machine may be adjustable to vary a characteristic of the exercise provided by the machine, for example by changing an incline of a rail supporting the reciprocating linkage, and thus an angle of the closed loop path. The exercise machine may vary the incline with a lift mechanism operatively associated with the front upright frame of the machine, which may also support a resistance assembly, all in a compact form factor that may be more aesthetically pleasing and practical for relatively smaller exercise spaces.

25 Claims, 35 Drawing Sheets

(56) References Cited

U.S. PATENT DOCUMENTS 6,042,512 A * 3/2000 Eschenbach ..... A63B 22/0023 482/52
6,168,552 B1 * 1/2001 Eschenbach ..... A63B 22/001 482/52
6,422,977 B1 * 7/2002 Eschenbach ..... A63B 22/001 482/52
6,440,042 B2 * 8/2002 Eschenbach ..... A63B 22/0664 482/52
6,749,540 B1 * 6/2004 Pasero ..... A63B 22/0664 482/52
6,758,790 B1 * 7/2004 Ellis ..... A63B 22/001 482/52
6,939,271 B1 * 9/2005 Whan-Tong ..... A63B 22/0664 482/52
7,060,005 B2 6/2006 Carlsen et al.
7,104,929 B1 9/2006 Eschenbach
7,544,152 B2 * 6/2009 Dey ..... A63B 71/0619 482/52
7,654,936 B2 2/2010 Liao et al.
7,666,122 B2 * 2/2010 Chiles ..... A63B 22/001 482/52
7,722,505 B2 5/2010 Liao et al.
7,854,691 B2 * 12/2010 Long ..... A63B 22/001 482/52
7,946,962 B2 5/2011 Long
7,976,435 B2 * 7/2011 Van Handel ..... A63B 22/001 482/52
9,199,116 B1 * 12/2015 Huang ..... A63B 22/001
9,974,998 B2 * 5/2018 Miller ..... A63B 23/03575
10,532,246 B2 * 1/2020 Liao ..... A63B 21/225
2005/0148438 A1 * 7/2005 Carlsen ..... A63B 22/0015 482/52
2006/0199702 A1 * 9/2006 Eschenbach ..... A63B 22/0015 482/52
2007/0072742 A1 3/2007 Chen
2007/0254778 A1 * 11/2007 Ashby ..... A63B 24/0084 482/4
2008/0300114 A1 * 12/2008 Dalebout ..... A63B 22/0664 482/52
2012/0190507 A1 7/2012 Murray
2013/0199317 A1 8/2013 Law et al.
2013/0237379 A1 9/2013 Huang et al.
2013/0310225 A1 11/2013 Johnson
2014/0121065 A1 5/2014 Dalebout
2014/0206507 A1 7/2014 Murray
2014/0243157 A1 * 8/2014 Huang ..... A63B 22/203 482/52
2015/0087481 A1 * 3/2015 Liu ..... A63B 22/0015 482/52
2016/0213970 A1 * 7/2016 Eschenbach ..... A63B 22/001
2017/0154165 A1 * 6/2017 Dempfle ..... A61B 5/746
2019/0232107 A1 * 8/2019 Chen ..... A63B 22/0023
2021/0275864 A1 9/2021 Venturella

OTHER PUBLICATIONS

U.S. Appl. No. 16/808,221 titled "Elliptical Excercise Machine" filed Mar. 3, 2020, Attorney Docket No. P276297.US.01,.

* cited by examiner

ELLIPTICAL EXERCISE MACHINE

CROSS REFERENCE TO RELATED APPLICATIONS

This application is a continuation-in-part of U.S. application Ser. No. 16/808,221 filed Mar. 3, 2020, entitled "Compact Elliptical Exercise Machine," which is incorporated herein by reference in its entirety for any purpose.

TECHNICAL FIELD

The present disclosure relates generally to physical fitness and personal training and more specifically to an exercise machine.

BACKGROUND

Various types of exercise machines exist to aid the user in performing physical exercise for example, for maintaining physical fitness. Elliptical machines, for example, have been developed to help a user perform cardiovascular exercise and/or strength training as part of a fitness program. Many existing elliptical machines are bulky (e.g., having a larger footprint) than other exercise machines that can aid the user with cardiovascular exercise, such as a stationary bicycle. Additionally, and despite being generally bulky, many existing elliptical machines are not sufficiently or easily adjustable to a particular user. Designers and manufacturers of elliptical exercise machines continue to seek improvements thereto.

SUMMARY

The present disclosure pertains to a stationary exercise machine, such as an elliptical exercise machine. The exercise machine is adjustable to vary an exercise characteristic of the exercise machine depending on user preference, while still having a compact footprint. For example, the exercise machine may be adjusted to a fit a particular user. In some embodiments, the exercise machine may be adjusted to vary the exercise movement provided to the user.

An exercise machine according to some embodiments includes a frame, a crankshaft rotatably coupled to the frame, and a reciprocating member supporting a pedal such that the pedal is constrained to move in a closed loop path. The reciprocating member is operatively coupled to the crankshaft such that movement of the pedal in the closed loop path causes rotation of the crankshaft. The exercise machine further includes a rail pivotally coupled to the frame and movably supporting the reciprocating member, the reciprocating member configured to translate along the rail when the pedal moves in the closed loop path, and a lift mechanism operatively coupled to the rail for adjusting an incline angle of the rail. The lift mechanism may include a lever link having a first end operatively coupled to the rail and an opposite second end operatively coupled to a linear actuator, the lever link being pivotally coupled to the frame at a location between the first and second ends of the lever link. In some embodiments, the first end of the reciprocating member is slidably supported on the rail and a second end of the reciprocating member is configured to rotate about the crankshaft when the pedals move along the closed loop path. In some embodiments, the reciprocating member is coupled to the crankshaft via a crank arm. In some embodiments, the frame includes a base for contact with a support surface and an upright support extending from the base. In some embodiments, the rail is pivotally coupled to the base and, optionally, the lever link is pivotally coupled to the upright support. In some embodiments, the linear actuator is coupled to the upright support at a location above a pivot point (or fulcrum) of the lever link. In some embodiments, the linear actuator is coupled to the frame at a location below a fulcrum of the lever link. In some embodiments, the linear actuator is coupled to frame such that an extension of the linear actuator increases the incline angle of the rail. In some embodiments, the exercise machine further includes a link arm coupling the first end of the lever link to the rail. In some embodiments, the exercise machine further includes a resistance mechanism operatively coupled to the crankshaft to resist rotation of the crankshaft. In some embodiments, the resistance mechanism includes a flywheel rotatably supported by the frame. In some embodiments, the flywheel is supported by the crankshaft. In some embodiments, the flywheel is supported on the crankshaft by one or more two-way bearings. In some embodiments, the crankshaft is operatively coupled to the flywheel to cause the flywheel to rotate responsive to but asynchronously with the crankshaft. In some embodiments, the pedal is pivotally coupled to the reciprocating member.

In some embodiments, the exercise machine includes a transmission assembly operatively coupled between the crankshaft and the flywheel to cause rotation of the flywheel at an output rotational speed greater than an input rotational speed to the transmission assembly. In some embodiments, the transmission assembly includes a two-stage belt-drive assembly. In some embodiments, the exercise machine includes a plurality of transmission members pivotally supported on the frame, wherein rotation of the crankshaft causes at least one of the transmission members to rotate synchronously with the crankshaft. In some such embodiments, the least one of the transmission members that rotates synchronously with the crankshaft is coaxially positioned to the flywheel. In some embodiments, the one or more of the transmission members are rotatably supported on a transmission shaft spaced apart from the crankshaft. In some embodiments, the lever arm is coupled to the frame at a location between the crankshaft and the transmission shaft.

In some embodiments, the exercise machine further includes a reciprocating handle link pivotally coupled to the frame and operatively associated with the crankshaft to drive rotation of the crankshaft. In some embodiments, the reciprocating handle link is coupled to the reciprocating member thereby operatively associating the handle link with the crankshaft. In some embodiments, the reciprocating handle link is coupled to the reciprocating member via a reciprocating foot link. In some embodiments, the reciprocating foot link is pivotally coupled to the reciprocating member at a location between a first end and a second end of the reciprocating foot link.

An exercise machine according to some embodiments includes a frame, a crankshaft rotatably supported on the frame, and a flywheel rotatably supported on the crankshaft and configured to rotate responsive to rotation of the crankshaft but at a different rotational speed than the crankshaft. The exercise machine further includes a reciprocating member supporting a pedal, the reciprocating member having a first end movably supported by the frame and constrained to move in a reciprocating back and forth motion responsive to movement of the pedal, and the reciprocating member having an opposite second end operatively coupled to the crankshaft to cause rotation of the crankshaft responsive to the reciprocating back and forth motion of the first end. In some embodiments, the exercise machine further includes a crank arm coupling the second end of the reciprocating member to the crankshaft. In some embodiments, the exercise machine further includes a handle link configured to be driven by a user's hand, and wherein the handle link is operatively coupled to the crankshaft for driving rotation of the crankshaft. In some embodiments, the exercise machine further includes a foot link pivotally coupled to the handle link and the reciprocating member. In some embodiments, the exercise machine further includes a rail pivotally coupled to the frame and movably supporting the reciprocating member, and a lift mechanism operatively engaged with the rail to vary an incline angle of the rail. In some embodiments, the frame includes a base for contact with a support surface and an upright support extending from the base. In some such embodiments, the exercise machine further includes a rail pivotally coupled to the base and slidably supporting the first end of the reciprocating member, and a lever link pivotally coupled to the upright support and operatively associated with the rail to pivot the rail relative to the base. In some embodiments, the exercise machine further includes a transmission assembly operatively coupled between the crankshaft and the flywheel to drive rotation of the flywheel at an output rotational speed greater than an input rotational speed to the transmission assembly. In some embodiments, the transmission assembly is a two-stage belt-drive assembly.

An exercise machine according to some embodiments includes a frame, a crankshaft rotatably coupled to the frame, a reciprocating member movably supported by the frame such that a first end of the reciprocating member rotates the crankshaft responsive to movement of the reciprocating member, a rail pivotally coupled to the frame and movably supporting a second end of the reciprocating member such that the second end of the reciprocating member translates along the rail when the first end rotates the crankshaft, and a lift mechanism that selectively adjusts an incline angle of the rail, the lift mechanism including a lever link having a first end operatively coupled to the rail and an second end coupled to a free end of an extendible rod, wherein the lever link is pivotally coupled to the frame at a fulcrum, and wherein a distance between the fulcrum and the first end is greater than a distance between the fulcrum and the second end such that movement of the free end of the extendible rod by a first travel distance causes the second end of the lever link to move a second travel distance greater than the first travel distance. In some embodiments, the lever link is pivotally coupled to an upright support of the frame. In some embodiments, the free end of the rod is oriented towards a base of the exercise machine such that extension of the rod causes an increase in the incline angle of the rail. In some embodiments, the free end of the rod is oriented away from a base of the exercise machine such that extension of the rod causes a decrease in the incline angle of the rail. In some embodiments, the exercise machine further includes a flywheel associated with a brake mechanism, wherein the flywheel is coupled to the frame at a location below the fulcrum. In some embodiments, the exercise machine further includes a transmission assembly that transmits the rotation of the crankshaft to the flywheel, wherein the transmission assembly includes at least one disk rotatably coupled to the frame at a location above the fulcrum. In some embodiments, the exercise machine further includes a pedal pivotally coupled to the reciprocating member such that the pedal is constrained to move in a closed loop path.

An exercise machine according to some embodiments includes a frame with a base configured to support the exercise machine on a support surface and a mast extending upwardly from the base. A crankshaft is rotatably coupled to the frame to rotate about a first rotation axis. A reciprocating member supports a pedal such that the pedal is constrained to move in a closed loop path. The reciprocating member is operatively coupled to the crankshaft such that movement of the pedal in the closed loop path causes rotation of the crankshaft about the first rotation axis. A rail is pivotally coupled to the frame and movably supporting the reciprocating member. The reciprocating member is configured to translate along the rail when the pedal moves in the closed loop path. A lift mechanism is suspended from the mast from a location above the first rotation axis and operatively coupled to the rail for adjusting an incline of the rail.

In some embodiments, the exercise machine may also include a cantilever fixed to the mast at a location above the first rotation axis and extending rearward toward the rail. The lift mechanism may be suspended from the mast via the cantilever.

In some embodiments, the mast may include a first upright support extending from a front end of the base, a second upright support having a first end fixed to the base at a location aft of the first upright support and a second end fixed to the first upright support, and a third upright support connecting an intermediate location of the second upright support to the first upright support. An upper portion of the first upright support and the third support may be inclined toward a rear side of the exercise machine.

In some embodiments, the base is about 52 inches or less. In some embodiments, the rail is adjustable to at least 20 degrees of incline.

In some embodiments, a first end of the reciprocating member is slidably supported on the rail and a second end of the reciprocating member is configured to rotate about the crankshaft when the pedals move along the closed loop path. The pedal may be cantilevered from the reciprocating member.

In some embodiments, the reciprocating member is coupled to the crankshaft via a crank arm. A resistance mechanism may be operatively coupled to the crankshaft to resist rotation of the crankshaft. The resistance mechanism may include a flywheel rotatably supported by the frame. The flywheel may be rotatably supported on the mast. The flywheel may be rotatably supported on the mast at a vertical location below the crankshaft. The crankshaft may be rotatably coupled to the mast at the intermediate location of the second upright support. The crankshaft and the flywheel may rotate at different rotational speeds.

In some embodiments, the exercise machine may also include a console supported by the frame. The console may include a processor, a memory, and a display. The processor may be in communication with one or more user input devices for controlling an operation of the exercise machine. One or more user input devices may include one or more buttons located on a movable handle of the exercise machine. The one or more user input devices may be configured to receive user input for varying at least one of the incline of the rail, a resistance level, and information displayed on the display. Information displayed on the display may include a video, where the processor is configured to vary a playback rate of the video based on a rate of rotation of the crankshaft.

In some embodiments, the memory includes instructions that cause the processor to store exercise performance data in the memory, adjust an exercise program stored in the memory based on the exercise performance data to generated an adapted exercise program, and provide instructions, via the console, for adjusting at least one of the incline of the rail and the resistance level in accordance with the adapted exercise program, or automatically adjust at least one of the incline of the rail and the resistance level in accordance with the adapted exercise program.

In some embodiments, the lift mechanism includes a first end portion including a motor, the first end portion pivotally joined to the cantilever, and a driven portion pivotally joined to the rail. The motor may be configured to move the driven portion toward and away from the first end portion to raise and lower the rail, respectively.

In some embodiments, the exercise machine includes a transmission assembly that transmits the rotation of the crankshaft to the flywheel while changing the rotational speed thereof. The transmission assembly may include a single-stage belt-drive assembly. The transmission assembly may include a rotating disk fixed to the crankshaft to rotate in synchrony with the crankshaft and where the rotating disk and the flywheel are located on opposite sides of the mast.

In some embodiments, the lift mechanism is positioned between the rotating disk and the flywheel such that the driven portion moves in a plane parallel to and between respective planes of the rotating disk and the flywheel.

This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary.

BRIEF DESCRIPTION OF THE DRAWINGS

The description will be more fully understood with reference to the following figures in which components may not be drawn to scale, which are presented as various embodiments of the exercise machine described herein and should not be construed as a complete depiction of the scope of the exercise machine.

DETAILED DESCRIPTION

Figure 1:
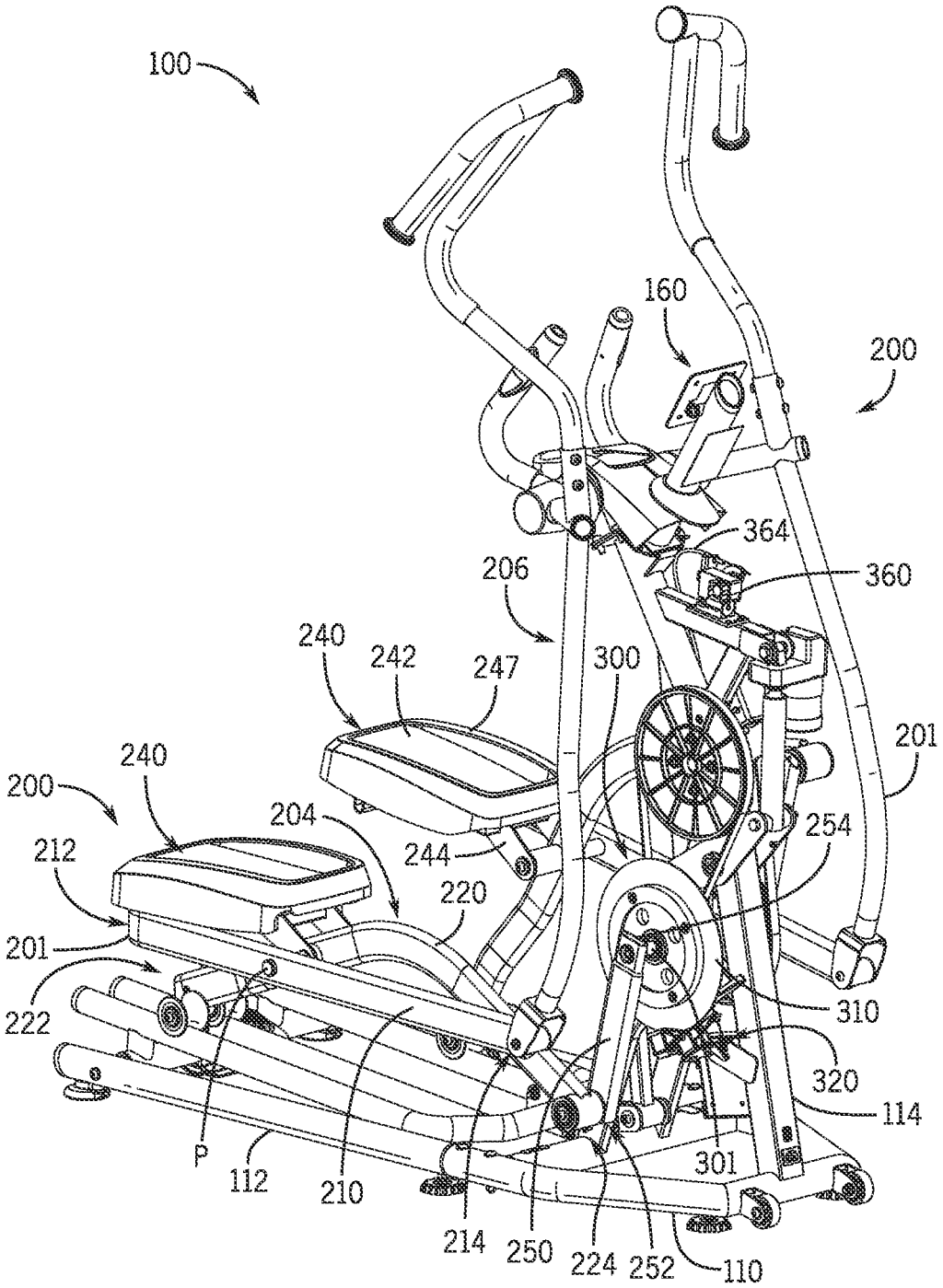
FIG. 1 is a front isometric view of a stationary exercise machine in accordance with some examples the present disclosure.

Embodiments according to the present disclosure include a stationary exercise machine, such as an elliptical machine, and components thereof. The stationary exercise machine according to the present disclosure may include components or assemblies that allow the machine to be more compact (e.g., occupy a smaller footprint) than existing exercise machines of a similar type, while, in some cases, providing adjustability (e.g., incline adjustments) comparable to or greater than existing exercise machines of the type. An exercise machine according to the present disclosure may include a frame, a crankshaft rotatably supported by the frame, and at least one reciprocating linkage configured for the application of a force by the user when using the machine and which transmits the movement or force of the user to the crankshaft. The reciprocating linkage may be operatively coupled to the crankshaft for driving the rotation of the crankshaft.

The reciprocating linkage may be supported by the frame in an adjustable manner. For example, the reciprocating linkage may be movably (e.g., slidably) supported on a rail, which is movably (e.g., pivotally) coupled to the frame to enable the user to vary the angle of the rail to the frame and/or ground, and consequently vary a characteristic of the exercise provided by the machine (e.g., a characteristic, such as an inclination of the closed loop path traversed by pedals of the machine). To that end, the exercise machine may include a lift mechanism operatively associated with the rail for varying the angle of inclination of the rail with respect to the frame and/or ground. By varying the angle of inclination of the rail, the user may be able to customize the exercise experience provided by the machine, for example to customize the machine for users of different sizes or stature and/or allow a user to selectively target or active different muscle groups. For example, in the case of an elliptical machine, the pedals of which traverse a substantially elliptical path, adjusting the incline of the rail may result in changing the angle of inclination of the elliptical path (e.g., an angle of inclination, with respect to the ground, of the major axis of the elliptical path). This may enable the user to customize the exercise experience between a more horizontal walking or running motion and a more vertical stair stepping motion. Alternatively or additionally, adjusting the incline of the rail may result in changing other characteristics of the elliptical path such as changing the eccentricity of the elliptical path and/or the length of an axis such as the major axis, which can be perceived by the user as a change in the length of the stride provided by the machine.

In some embodiments, an adjustment assembly (e.g., lift mechanism) that utilizes mechanical advantage can be implemented to provide comparable or greater range of adjustments, in some cases for an equivalent or smaller stroke of actuation, and in some case in a more compact form factor than existing exercise machines of the type. For example, a lift mechanism according to the present disclosure may include a lever link pivoted, at an intermediate location along its length, off the frame (e.g., an upward extending portion of the frame). One end of the lever link may be operatively engaged with an actuator (e.g., a linear actuator or an extendible or length-adjustable rod) for pivoting the lever link about its fulcrum, and the opposite end of the lever link may be operatively engaged with the rail for adjusting the incline angle of the rail. Such an arrangement, as compared to directly lifting the front of the rail to change its incline, may obtain a significant increase, in some cases two-fold or greater, in the incline adjustment range without a significant increase in power input (e.g., in some cases not exceeding 10%) or increase in the stroke of the linear actuator. A number of other advantages may be gained, such as reducing off-axis loading and torque on the linear actuator and reducing the form factor of the lift assembly, and the exercise machine altogether. In some embodiments, the distance between the fulcrum and the end coupled to the rail may be greater than a distance between the fulcrum and the end coupled to the actuator (e.g., the free end of an extendible rod) such that a given amount of extension by the actuator (e.g., a travel distance by the free end of the extendible rod) results in a larger amount of travel distance at the end coupled to the rail which may further enhance the mechanical advantage and/or other benefits or advantage that may be provided by the adjustment assembly.

In other embodiments, the adjustment assembly (e.g., lift mechanism) may be connected to apply the lifting force (e.g., for raising and lowering the rail) directly to the rail without an intermediate lever link. In some such embodiments, a linear actuator may be suspended from the rear side of the upright frame. One end (e.g., the motor end) of the linear actuator may be pivotally coupled to the upright frame, for example at a vertical location above the rotating shaft(s) of the exercise machine. The opposite (e.g., extendible) end of the linear actuator may be pivotally coupled to the rail whereby retraction of the linear actuator raises the rail increasing the incline angle of the elliptical path, and extension of the linear actuator lowers the rail decreasing the incline angle of the elliptical path. This arrangement may enable a suitable incline adjustment to be achieved while maintaining a compact form factor (e.g., a relatively smaller footprint than existing incline-adjustable elliptical machines). In some embodiments, the compact form factor is further achieved by supporting the one or more rotatable components, such as the crankshaft, flywheel and associated flywheel shaft, and the one or more transmission disks that transfer rotation from the crankshaft to the flywheel, also on the upright frame. In this manner, the footprint of the elliptical machine is reduced. In some examples, the frame of the exercise machine may have a length 558 (see e.g., FIGS. 26-28A) of about 55 inches or less, in some cases less than about 51 inches and a width 560 of about 25 inches or less, while capable of being adjusted to an incline angle of 20 degrees or more. In some embodiments of the exercise machine, the relative arrangement of certain components thereof (e.g., the adjustment assembly in relation to the frame) may provide for a compact elliptical exercise machine with sufficient incline adjustability which may improve not only the user's exercise experience but also the usability of the exercise machine in a home setting.

FIGS. 1-20 illustrate an example of an exercise machine 100, shown here as an elliptical exercise machine, which includes a lift assembly or mechanism 400 for changing a characteristic (e.g., pedal path incline) of the exercise machine 100. The exercise machine 100 includes a frame 110 configured to support the exercise machine on a support surface (e.g., on the ground). The frame 110 includes a base 112 configured for contact with the support surface (e.g., the ground). The base 112 may lie substantially parallel to the ground (e.g., horizontally) when the machine is in use and may thus also be referred to as the horizontal frame portion 112. The frame 110 may further include one or more upright supports 114 extending from the base 112, which may also be referred to as the upright frame portion 114. In the illustrated example, the upright frame portion 114 is arranged near the front of the horizontal frame portion 112, although other suitable arrangements may be used in other examples. In some examples herein, the frame 110 may be described as including the rigidly connected components of the machine 100 which supports, for example movable components of the machine, and may thus also be referred to as rigid frame 110.

The exercise machine 100 may include at least one, and typically a plurality of movable components supported by the frame 110. For example, the exercise machine 100 may include at least one, and typically a pair (i.e., a left and a right) of reciprocating assemblies 200 that are driven by the user during exercise. The reciprocating assemblies may be operatively coupled to a crankshaft 301 to cause the crankshaft 301 to rotate when a reciprocating assembly 200 is driven by the user. The reciprocating assemblies 200 may include one or more (e.g., left and right) reciprocating linkages 201. The reciprocating linkages 201 may include components configured to support and/or be driven by a lower extremity of the user (e.g., the user's feet) and may thus be referred to as lower linkages 204. In some examples, the reciprocating linkages 201 may additionally or alternatively include components configured to support and/or be driven by an upper extremity of the user (e.g., the user's hands) and may thus be referred to as upper linkages 206. In some examples, a lower linkage 204 may be connected to the respective upper linkage 206 such that movement of one of the two linkages (e.g., the upper linkage 206 or the lower linkage 204), for example when driven by the user, causes the other one of the two linkages (e.g., the lower linkage 204 or the upper linkage 206) to move.

Figure 2:
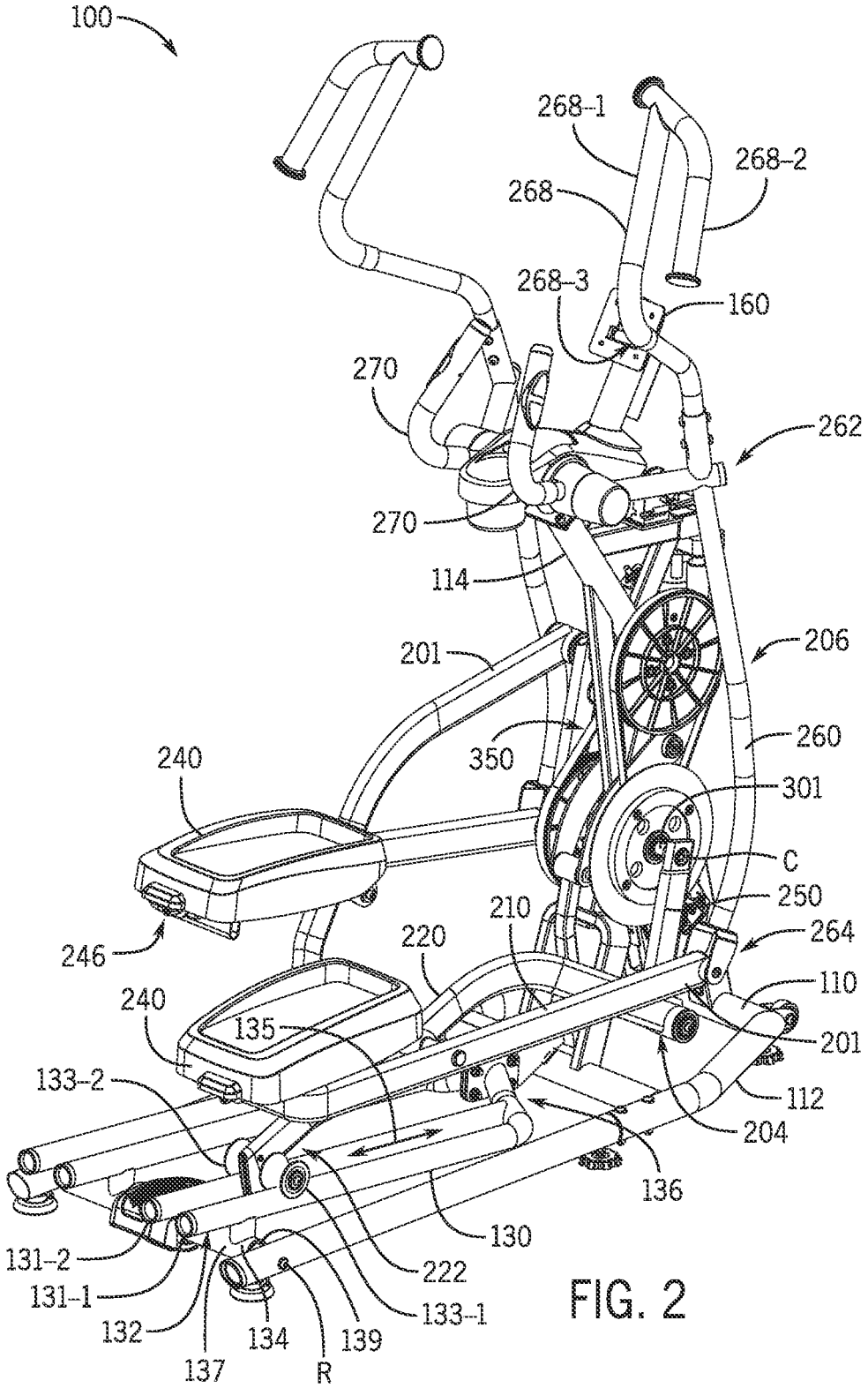
FIG. 2 is a rear isometric view of the exercise machine in FIG. 1.

Referring to FIGS. 1-2, the exercise machine 100 includes left and right reciprocating lower linkages 204, each of which includes a reciprocating member 220 that supports a pedal assembly (or simply pedal) 240. The reciprocating member 220 has a first or proximal end 222 and a second or distal end 224 opposite the first end 222. The reciprocating member 220 may be implemented using an elongate substantially rigid structure, such as a bar, which in this case has at least one curved portion between the two ends 222 and 224 of the reciprocating member 220. In other examples, the reciprocating member 220 may be substantially straight or have a different suitable geometry. The term proximal is used herein to refer to components or ends thereof which are relatively closer to the user, during use of the machine, such as the end closer to where user force is applied, while the term distal is used herein to refer to components or ends thereof relatively farther from the user during normal use of the machine.

The distal end 224 of the reciprocating member 220 is operatively coupled to a crankshaft 301, in this example via a crank arm 250. A first end 252 of the crank arm 250 is pivotally coupled to the distal end 224 and the opposite, second end 254 of the crank arm 250 is rigidly coupled to the crankshaft 301 such that the crank arm 301 rotates synchronously with the crankshaft 301. While the crank arm 250 is illustrated here as a generally straight rigid link or bar of a given length, the crank arm 250 may be provided by any rigid body, such as a radially-extending portion of a disk or other, which operatively connects the distal end 224 of the reciprocating member 220 to the crankshaft 301, providing a load path for transmitting the force from the reciprocating member 220 to the crankshaft 301. The crankshaft 301 may be coupled to a resistance mechanism 300 such that rotation of the crankshaft 301 about its axis (i.e., crank axis C) is resisted by the resistance mechanism 300, e.g., as described further below.

As previously described, in some examples, the lower linkage 204 may be operatively connected with a reciprocating upper linkage 206 configured to support and/or be driven by a hand of the user. In the present example, the upper linkage 206 is coupled to the lower linkage 204 via a foot link 210. The foot link 210 may be implemented as an elongate rigid member, in some case a substantially straight bar, which has a first or proximal end 212, a second distal end 214 opposite the first end 212, and a length defined therebetween. The foot link 210 may be coupled at its distal end 214 to the upper linkage 206. The foot link 210 may be coupled to the reciprocating member 220 at or near the proximal end 212 or any suitable location between the proximal and distal ends 212, 214, respectively, of the foot link 210. The foot link 210 may be pivotally coupled to the reciprocating member 220 at a pivot joint 216 such that the reciprocating member 220 and the foot link 210 can both pivot relative to one another and about the pivot axis P. In some embodiments, the foot link 210 may also be coupled to the pedal 240 and may support the pedal 240 at one or multiple locations. In some embodiments, the foot link 210 may extend distally of its connection with the reciprocating member 220, e.g., to support the pedal assembly 240 and/or components associated therewith. In the present example, the pedal 240 is pivotally coupled to the foot link 210 such that it is pivotable relative to the foot link 210 and the reciprocating member 220 about the same pivot axis P, and a rear portion of the pedal 240 is supported at the distal end of the foot link 210.

In some examples, the reciprocating member 220 (e.g., its proximal end 222) may be movably, in this case slidably, supported on the frame 110. For example, as shown in FIG. 2, the proximal end 222 is configured to slide on one or more rollers (e.g., rollers 133-1 and 133-2) along a rail 130. The rail 130 may be implemented using any suitable structure to define a path 135, which may be linear as in the present example or curved in other examples, such that, in use, the proximal end 222 of the reciprocating member 220 is constrained to travel (e.g., reciprocate) along the path 135. For example, the rail 130 may be implemented using a pair of substantially parallel rail members, shown here as tubes 131-1 and 131-2, each slidably or rollably supporting a respective one of the pair of rollers 133-1 and 133-2. In other examples, a single or a greater number of rail members may be used than in specific example here. In yet other examples, the rail 130 may take on a different shape or configuration, such as by being configured to engage differently shaped rollers or engage different portions of the rollers. In yet other examples, the reciprocating member 220 (e.g., its proximal end 222) may be movably supported on a rail in an entirely different manner that constrains the proximal end 222 in a reciprocating motion along a predefined path.

The rail 130 may be movably (e.g., pivotally) coupled to the frame to allow the relative position (e.g., incline) of the rail 130 to be changed. For example, the rail 130 may be pivotally coupled to the frame 110, and more specifically to the base 112, via any suitable pivot joint, referred to herein as rail pivot 134, that constrains all degrees of freedom except for one rotational degree of freedom of the rail 130. As shown in FIG. 2 and also in FIG. 15, the rail 130 may include a base, shown here as a transverse tube 137, rigidly coupled to the rail 130, for example at a location near its rear or proximal end 132. The tube 137 may be rotatably received over a rod 139, such that the tube 137 and consequently the rail 130 can pivot about a rail pivot axis R in response to a moment about the axis R, e.g., as may be applied by the lift mechanism 400 and as described further below.

The exercise machine 100 may include a pedal assembly (or simply pedal) 240 associated with each of the lower linkages 204. The pedal assembly 240 may be supported by the reciprocating member 220, the foot link 210, or both. The pedal assembly 240 may include a footplate 242, which in use supports the user's foot. The footplate 242 may be fixed to (e.g., rigidly attached or integrally formed) with a pedal shroud 247, which may include one or more walls extending from the footplate 242 to restrict movement of the user's foot in one or more direction (e.g., the forward and lateral directions). The footplate 242 may be coupled to the supporting structure (e.g., the reciprocating member 220 and/or the foot link 210) via a pedal mount 244. In some examples, the pedal 240 may be pivotally coupled to its supporting structure (e.g., the reciprocating member 220 and/or the foot link 210). In such examples, the pedal mount 244 may include a pivot joint that restricts all degrees of freedom except for one rotational degree of freedom to allow pivotal movement of the pedal 240 about the pedal pivot axis P. Such arrangement may enable pivotal movement of the pedal 240 during use of the machine 100 and/or pivotal adjustment to the pedal 240 prior to use, for example to change the incline of the pedal 240, such as from a neutral or relatively flat position to a heels-up position or other. In some such examples, the pedal assembly 240 may be associated with a pedal adjustment mechanism 246 that enables the user to change the angle of the pedal with respect to the supporting structure (e.g., the reciprocating member 220, the foot link 210, or both). For example, as shown e.g., in FIGS. 15 and 17, the pedal adjustment mechanism 246 may include a pop-pin 249 configured to engage any of a plurality of slots, notches or other suitable detents on the supporting structure, each of which positions the footplate 242 at a different angle with respect to the supporting structure. In some examples, the pedal adjustment mechanism 246 may be configured to enable the pedal 240 to resiliently support the user's foot during use of the exercise machine. The pedal assembly 240 of exercise machine 100 may be implemented in accordance with any of the examples in U.S. Ser. No. 14/986,068, titled "Pedal Assembly for Exercise Machine," which is incorporated herein by reference.

The exercise machine 100 may also include an upper reciprocating linkage 206 configured to be driven by a user's hand. The upper reciprocating linkage 206 may be operatively associated with the crankshaft 301 for transferring the force applied by the user to the crankshaft 301. In some embodiments, the upper reciprocating linkage 206 may be operatively coupled to the crankshaft 301 solely via its connection to the lower reciprocating linkage 204. As shown e.g., in FIGS. 2 and 3, the upper linkage 206 may include a handle link 260 terminating at a handle 268 configured to be gripped by the user. The handle link 260 may be pivotally coupled, near its proximal end 262, to the frame 110, and more specifically to the upright frame portion 114. The handle link 260 may be coupled to the frame at pivot location 261 such that, in use, the handle link 260 reciprocally pivots about a handle pivot axis H. The proximal end 262 of the handle link 260 may be fixed to (e.g., rigidly connected or integrally formed with) the handle 268 such that the handle 268 reciprocates in synchrony with the reciprocal movement of the handle link 260. In some examples, the handle 268 may include different distinct grip locations 268-1, 268-2, 268-3, e.g., to accommodate users of different builds (e.g., slimmer or wider users) and/or activate different muscle groups of the user. The exercise machine 100 may optionally include additional handles 270, which may be fixed to the frame 110 and thus may also be referred to as fixed handles 270.

The distal end 264 of the handle link 260 may be operatively associated with the crankshaft 301, in this example indirectly, via the connection between the upper linkage 206 to the lower linkage 204, which may be directly connected to the crankshaft 301. In other examples, the upper linkage 206 may be differently connected to the crankshaft 301 such as via a direct connection between the upper linkage 206 and the crankshaft 301. As shown e.g., in FIG. 2, the distal end 264 of the handle link 260 may be pivotally connected to the distal end 214 of the foot link 210 by any suitable pivot joint, such as a lug and clevis joint. As illustrated in FIGS. 3-6, in use, as the pedal 240 traverses the path E, shown here as being substantially elliptical, the foot link 210 reciprocate back and forth and consequently the distal end 264 of the handle link 260 reciprocates in corresponding back and forth motion. The reciprocating linkages 201 may be configured such that when a given pedal (e.g., the right pedal) is moved to the forward most position along its elliptical path, the corresponding handle (e.g., the right handle) is in a position closest to the user, while the opposite handle (e.g., the left handle) is in a position farthest from the user and the opposite pedal (e.g., the left pedal) is in the aft most position along its elliptical path to mimic natural walking or striding motion where each arm swings with the motion of the opposing leg.

Figure 3:
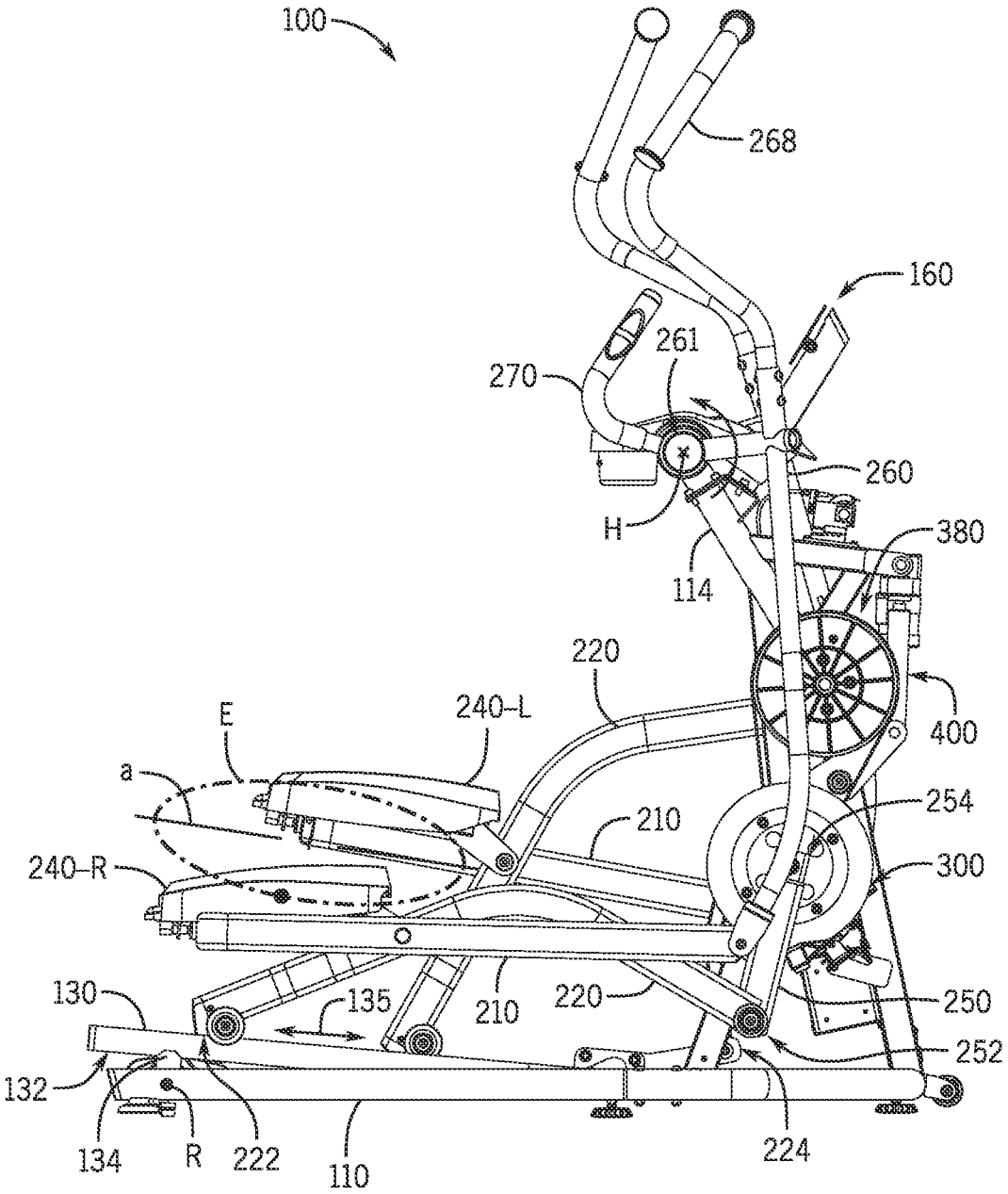
FIG. 3 is a side view of the exercise machine in FIG. 1.
Figure 4:
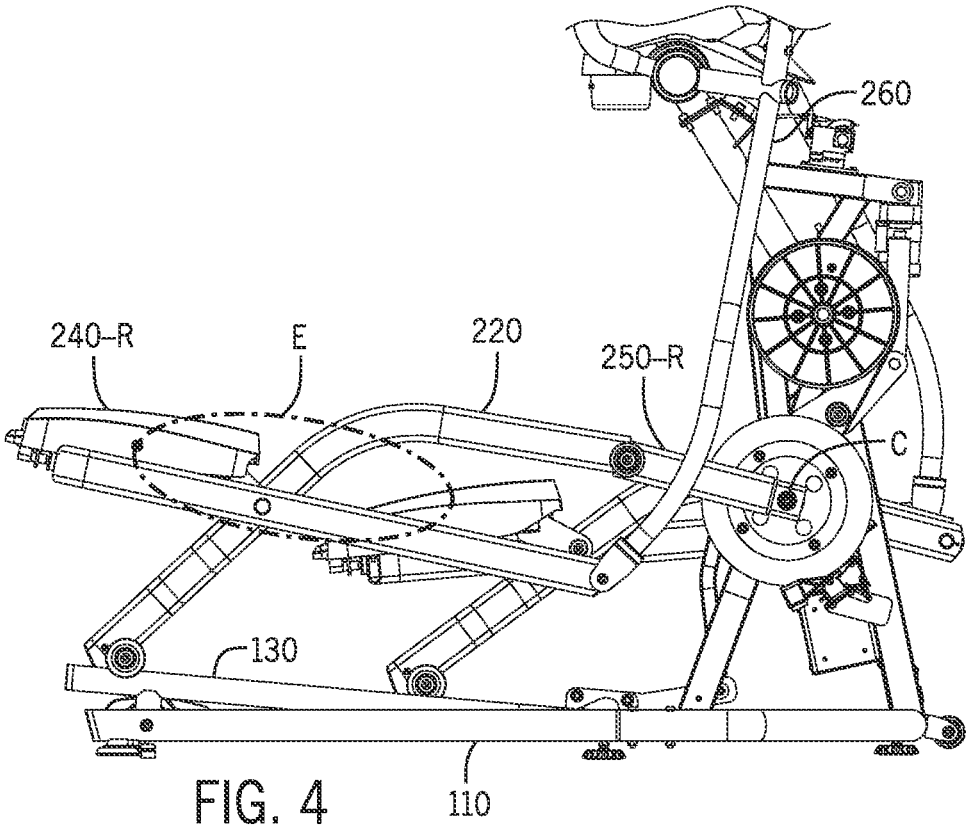
FIG. 4-6 are additional side views of a portion of the exercise machine in FIG. 3 with the pedals in different locations along the closed loop path.
Figure 5:
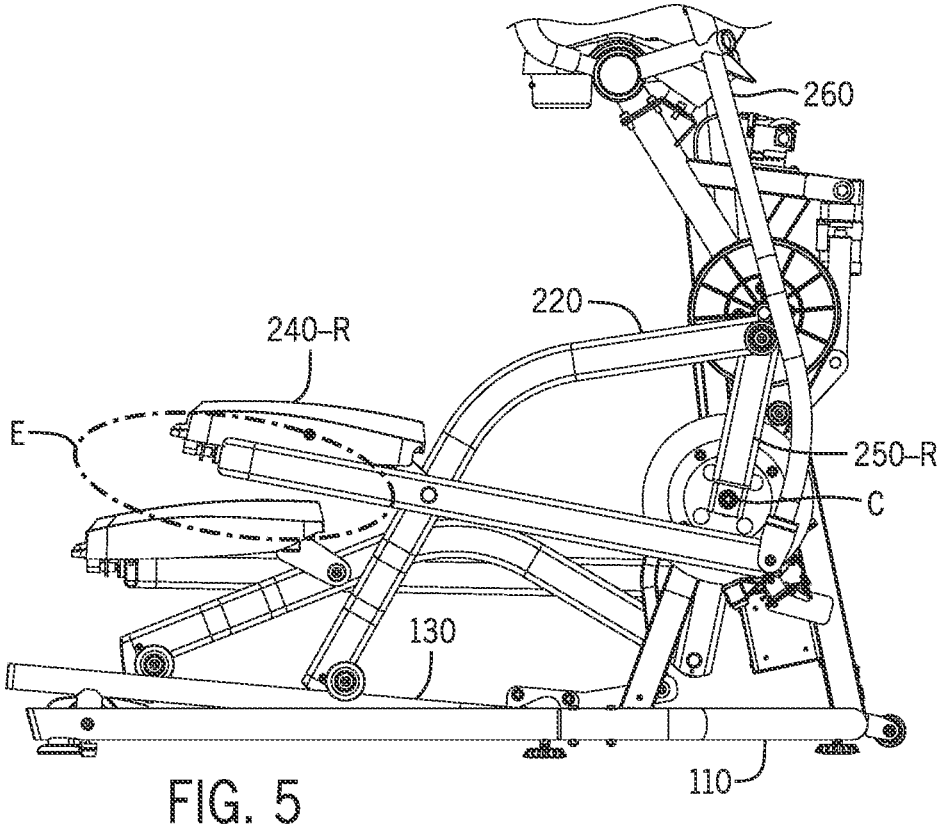
Figure 8:
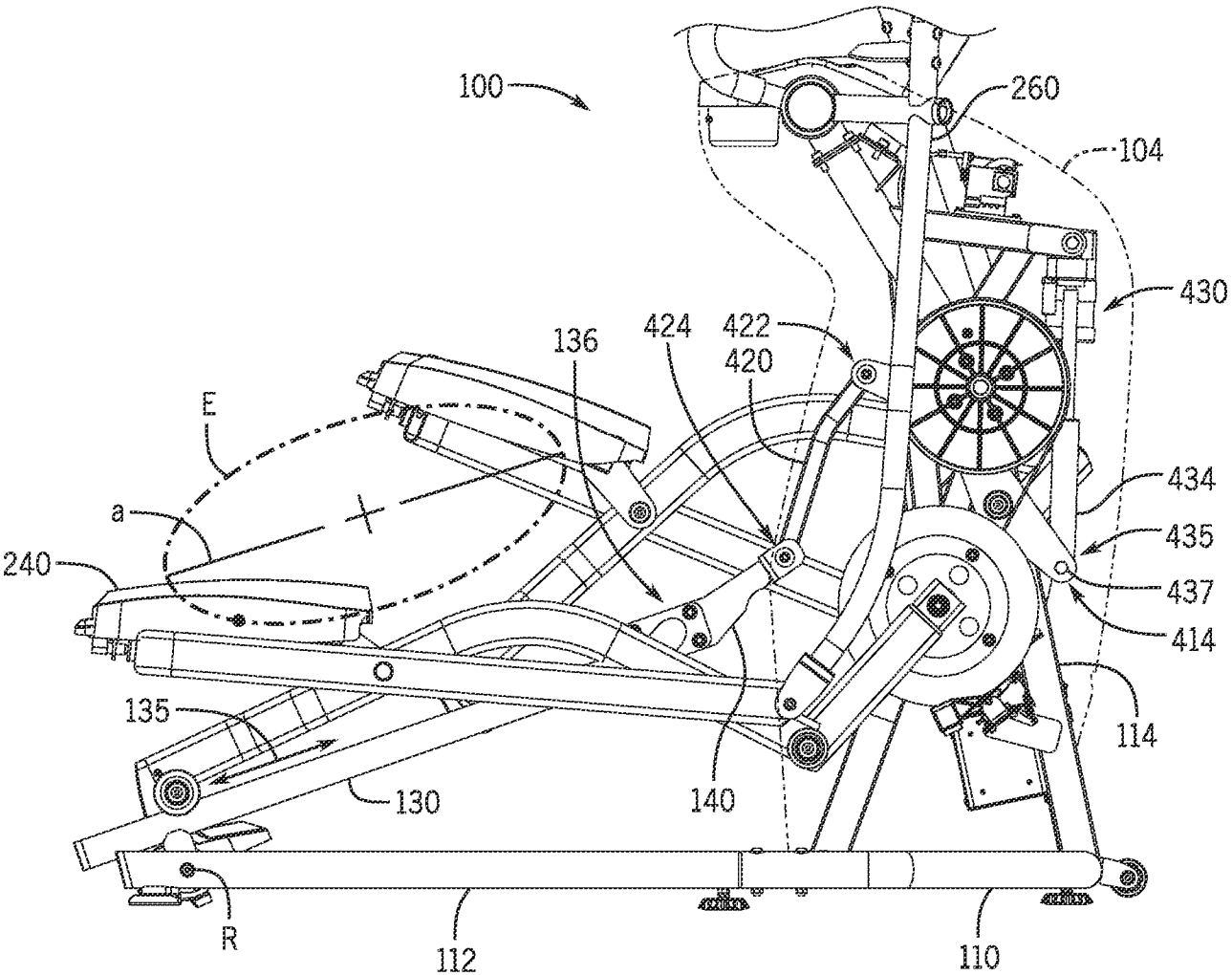
FIG. 8 is yet another side view of the portion of the exercise machine in FIGS. 3 and 7 show here with the lift mechanism further adjusted to further increase the incline as compared to FIGS. 3 and 7.

FIGS. 3-6 illustrate the exercise machine 100 at four positions of the pedal 240 along the closed loop, here elliptical, path E. The exercise machine 100 may be configured to enable the pedal 240 to traverse the elliptical path E in a clockwise direction to mimic natural forward walking or striding. The exercise machine 100 may be configured to additionally or alternatively enable the pedal 240 to traverse the elliptical path E in the reverse, counterclockwise direction, such as to allow the user to engage different muscle groups. In the clockwise direction that mimics natural bipedal walking/running, the upper portion of the elliptical path E (also referred to here as ellipse E) generally corresponds to the swing phase of the stride, while the lower portion of the ellipse E generally corresponds to the stance phase (or contact phase) of the stride. As shown in FIG. 3, for example, the right pedal 240-R may be near the bottom of the elliptical path E, which generally corresponds to near the mid stance of the stride or gait cycle. In this position of the pedal, the corresponding right crank arm 250-R may be near the 6 o'clock position or extending generally downward toward the ground. As the user continues to move the foot through a forward gait cycle and consequently drives the pedal 240-R in a clockwise direction along the path E, the pedal 240-R moves to a position near the rear end of the elliptical path E, as shown in FIG. 4, which may generally correspond to the toe off (or pre-swing) portion of the stance phase. In this position of the pedal 240-R, the corresponding crank arm 250-R may be near the 9 o'clock position, extending rearward, nearly horizontally. In some examples, the rail 130 may be configured to support the lower linkage 204 in a manner that results in a negatively inclined elliptical path E, as shown in FIGS. 3-6, and may be adjustable from this nominal position to a maximum incline position (e.g., as shown in FIG. 8), in which the elliptical path E is positively inclined.

Figure 6:
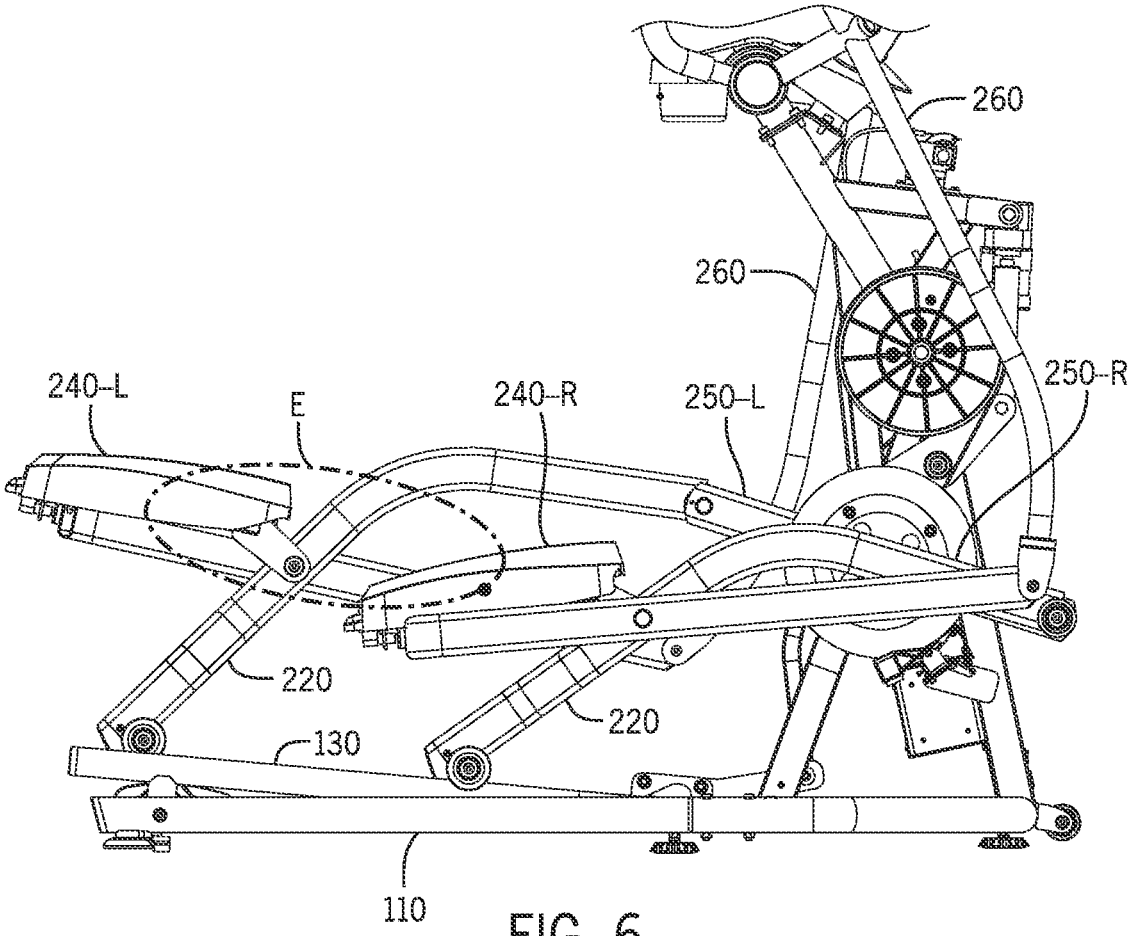

Returning back to FIGS. 3-6, as the user continues to move the foot through the gait cycle, advancing the pedal 240-R further along the elliptical path E, the pedal may move from the rear-most position of FIG. 4 to a position near the top of the elliptical path E, which may generally correspond to the mid swing phase of the gait cycle, and in which position the corresponding crank arm 250-R may be near the 12 o'clock position, extending upward, near vertically. As the user continues to advance the foot through the cycle to complete a full stride cycle, the pedal 240-R may pass through the forward most position along the elliptical path E, as shown in FIG. 6, which may generally correspond to the terminal swing phase of the gait cycle. In this position, the corresponding crank arm 250-R may be near the 3 o'clock position or extending forward, nearly horizontally. It will be understood that the driven components on the opposite (e.g., left) side of the exercise machine 100 may traverse similar paths but in opposition to the right side, such that, for example, when the right crank arm 250-R extends forward the left crank arm 250-L extends in radially opposite direction or rearward, as shown in FIG. 6. Similarly, while the right pedal 240-R is at the forward most position along its elliptical path E, the left pedal 240-L is at the rear most position along its elliptical path.

Figure 7:
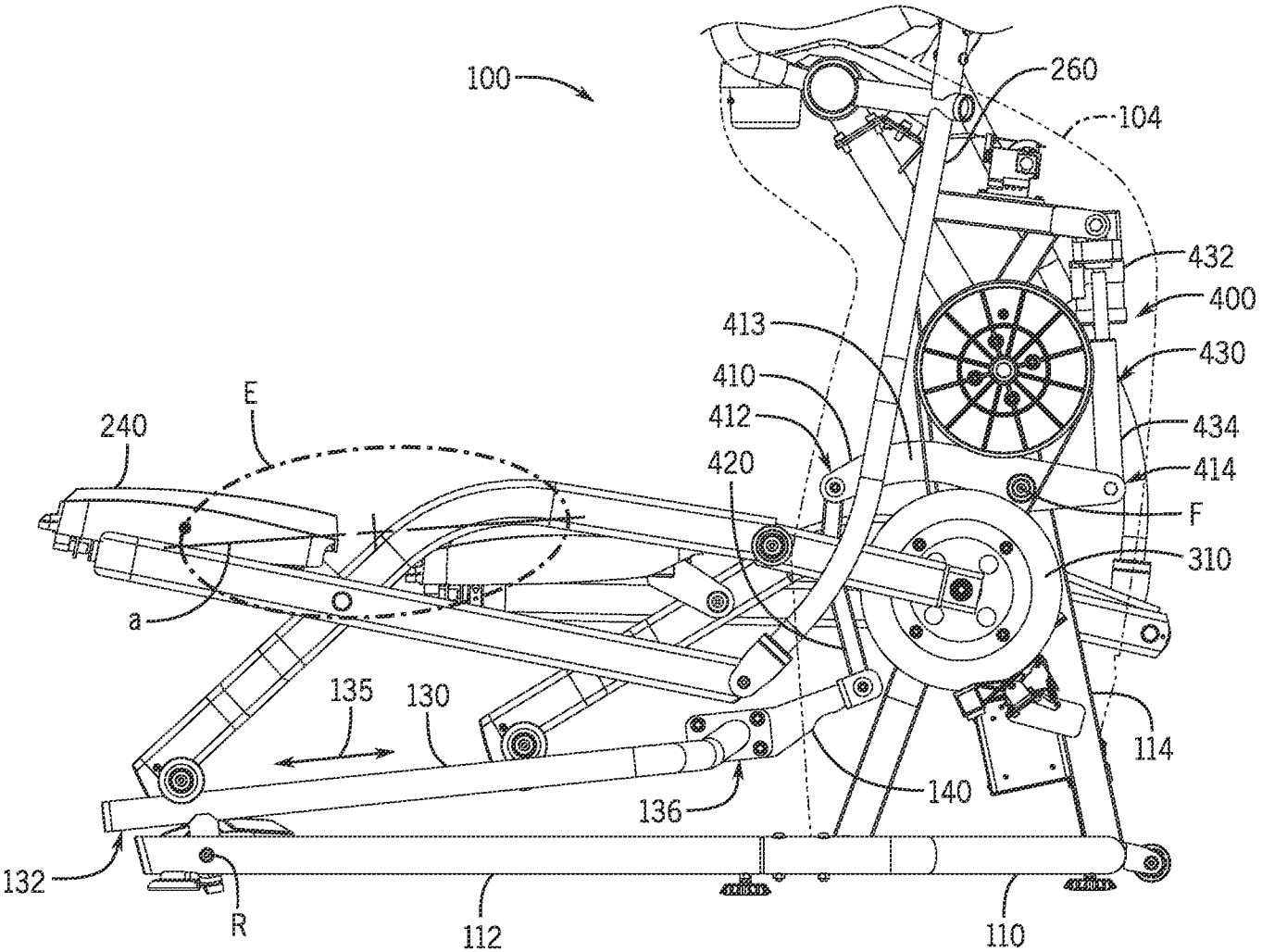
FIG. 7 is a side view of the portion of the exercise machine in FIG. 3 show here with the lift mechanism adjusted to provide a different incline.

In accordance with the present disclosure, the pedals 240 may be supported on the frame 110 of the exercise machine in a manner which enables the user to vary a characteristic of the exercise provided by the machine 100, such as by varying a characteristic of the closed loop path E traversed by the pedals. Referring back to FIGS. 2 and 3 and now also to FIGS. 7 and 8, the rail 130 which supports the lower linkage 204 may be pivotable to vary its incline angle. The rail 130 may be adjustable between a nominal (or minimum incline) position, which in the present example is at a negative incline with respect to the horizontal frame portion 112 and the ground (see FIG. 3), and a maximum incline position, e.g., as shown in FIG. 8. In some examples a range of up to about 20 degrees of incline adjustment may be achieved, and in some cases greater than 20 degrees, such as up to 30 degrees or more. As can be observed from FIGS. 3, 7, and 8, which show the exercise machine 100 at three incline positions including the nominal, an intermediate, and the maximum incline positions, respectively, as a result of adjusting the incline of the rail 130, a characteristic of the elliptical path E, for example the angle of inclination of the major axis a, may be varied. As shown in FIG. 3, the elliptical path E may be nearly horizontal or slightly negatively inclined at the nominal incline position of the rail 130, which may mimic a more horizontal walking or running motion. As the incline of the rail 130 is increased, the angle of inclination of the major axis a may also increase, as shown in FIGS. 7 and 8, to mimic increasingly more vertical motion, such as a stair climbing motion as the inclination approaches the maximum. To effect such incline adjustments, the exercise machine 100 may include a lift mechanism 400 operatively associated with the rail 130 to pivot the rail 130 about its pivot axis R.

In some examples, the lift mechanism 400 may include a lever link 410, a link arm 420, and a length-adjustable link, shown here as linear actuator 430. The lever link 410 may be implemented using a rigid member (e.g., bar) having a first of proximal end 412 and a second or distal end 414. The lever link 410 may be pivotally coupled to the frame 110, more specifically to the upright portion of the frame 114, at a location between the first and second ends 412, 414, respectively, of the lever link 410, which defines the pivot location or fulcrum F of the lever link 410. The link arm 420 may couple the first end 412 of the lever link 410 to the rail 130, and the length-adjustable link (e.g., linear actuator 430) may couple the opposite, second end 414 of the lever link 410 to the frame 110. The linear actuator 430 may be any suitable linear actuator including a combination of a motor 432 operably arranged to extend a rod 434. The motor 432 can be any suitable motor, such as an electric rotary motor. The rod 434 may be implemented using any suitable telescoping member, which is in operative arrangement with the motor 432 to convert, e.g., a rotary input of the motor 432 to linear output at (e.g., extension and retraction of) the free end of the rod 434. The linear actuator 430 may utilize electromechanical, hydraulic, or pneumatic actuation, or any combination thereof. For example, instead of an electrically driven rod-type actuator, the actuation may be provided by a hydraulic, pneumatic, electro-hydraulic or electro-pneumatic cylinder.

Figure 9:
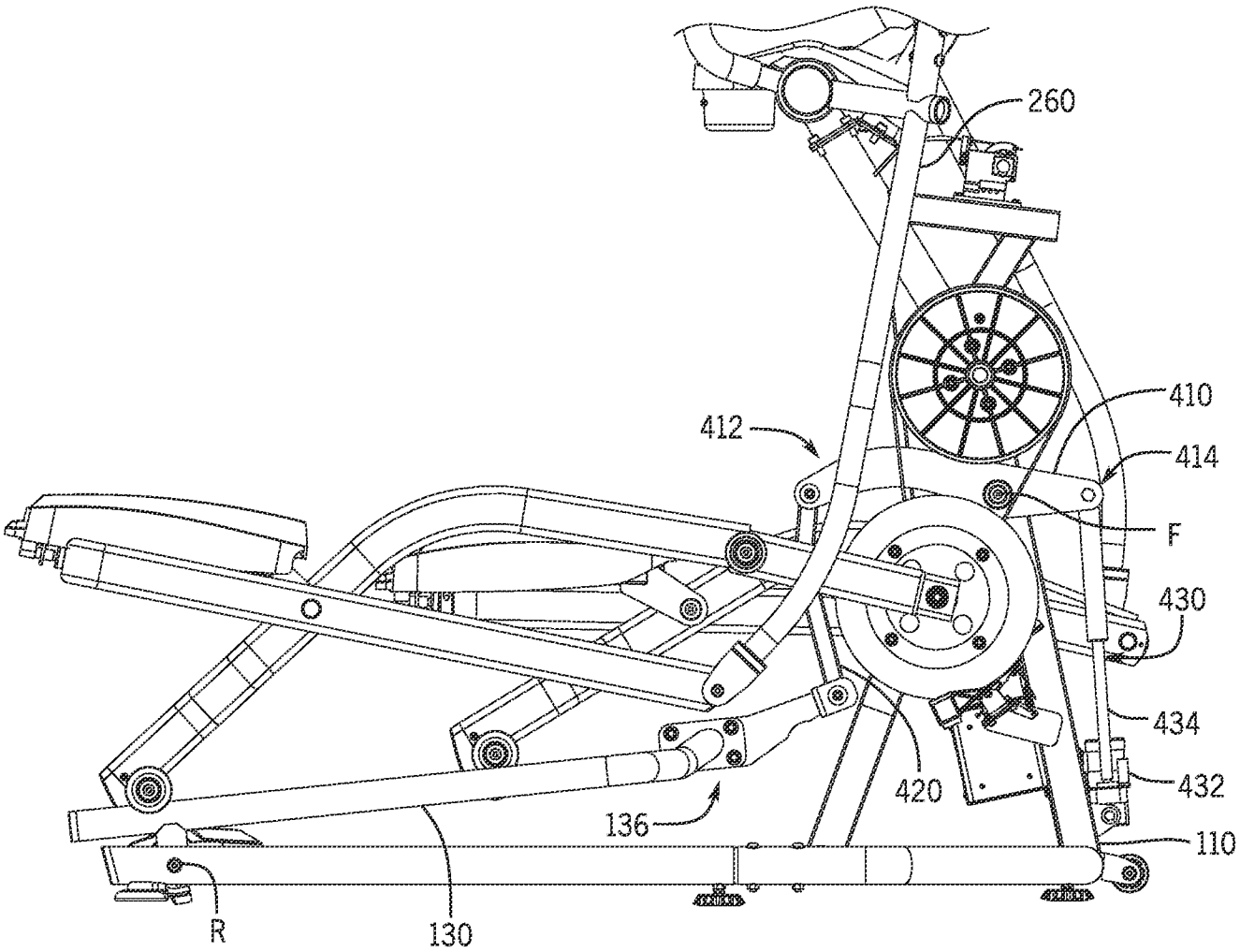
FIG. 9 is a side view of a portion of an exercise machine similar to that shown in FIG. 7 with the lift adjustment mechanism in a different configuration.

In some examples, the actuator 430 may be coupled to the frame 110 at a location above the fulcrum F such that extension of the linear actuator 430 applies a force (against gravity) to lift the front end 136 of the rail 130 and thus increase the incline of the rail 130, as shown in FIGS. 7 and 8. In other examples, as shown in FIG. 9, the actuator 430 may be coupled to the frame 110 at a location below the fulcrum F such that the extension of the actuator 430 cooperates with gravity to lower the rail 130, while lifting of the rail 130 is achieved through retraction of the linear actuator 430. While the operation of the lift mechanism is described herewith reference to a linear actuator, it will be understood that the lift mechanism may employ any number, including a plurality, of actuators, operating in concert (e.g., two or more actuators concurrently extending or retracting to lift or lower the rail), in opposition, or in other suitable configuration.

Figure 10:
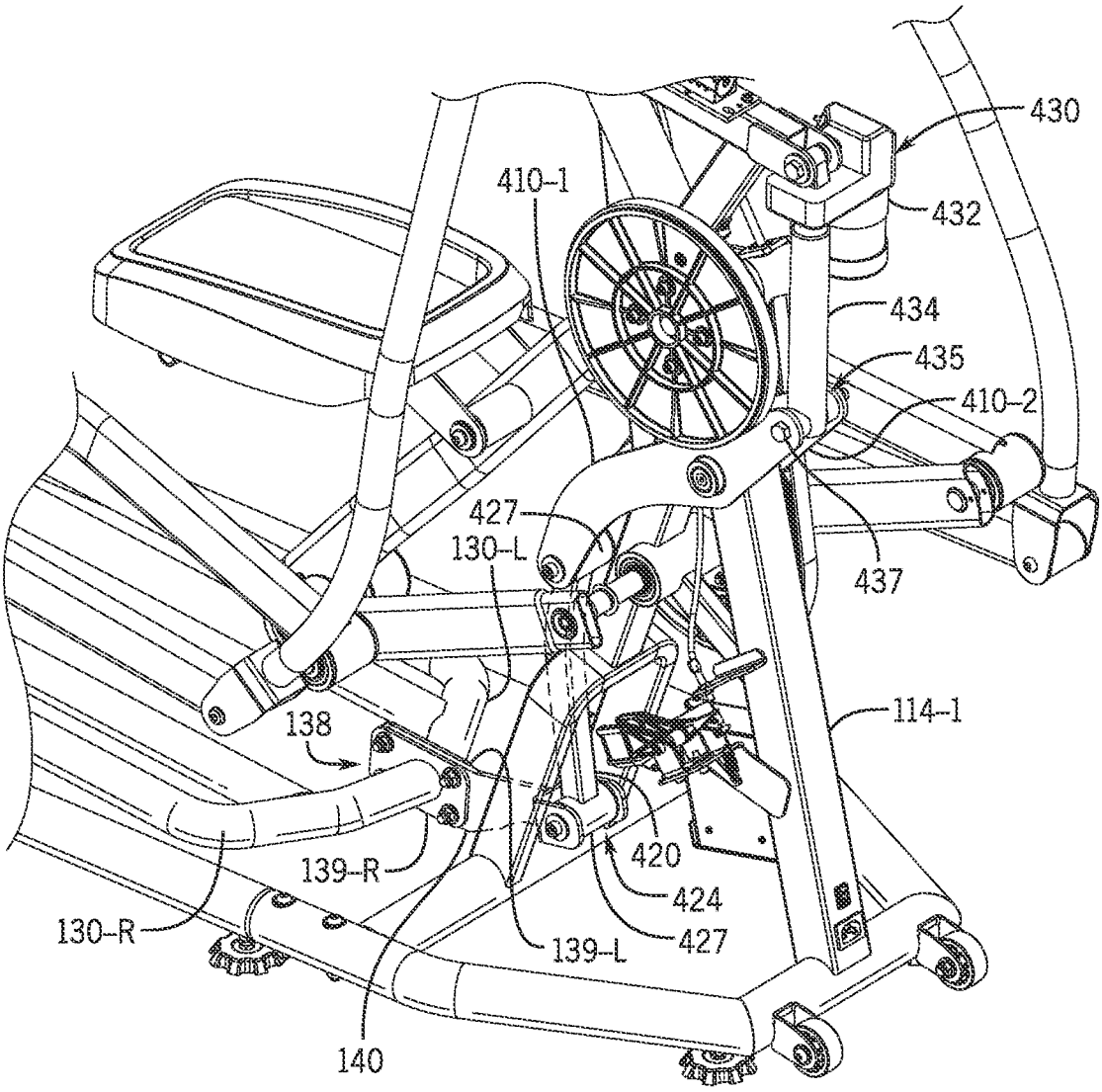
FIG. 10 is an enlarged partial view of a front portion of the exercise machine in FIG. 1 showing components of the lift adjustment mechanism.

Referring now also to FIG. 10, the lever link 410 may be implemented using a single or multiple rigid members, in this case a pair of rigid bars 410-1 and 410-2 coupled to opposite sides of an upright support 114-1 of the frame 110. Each of the bars 410-1 and 410-2 may have complementary shape and each may be pivoted off the upright support 114-1 such that both of the bars 410-1 and 410-2 pivot about a common axis passing through the fulcrum F, such that the two bars function in concert as a single link. The lever link 410 may be a straight rigid member. In some examples, at least a portion of the lever link 410 may be contoured (e.g., curved), which may improve its load bearing performance. For example, the proximal portion 413 of the lever link 410 extending between the fulcrum F and the proximal end 412 may be curved with the concave side facing down, which may reduce stress concentrations and/or more efficiently distribute the internal loads in the proximal portion 411 due to beam-bending when the rail 130 is lifted off the ground. The lever link 410, the link arm 420, or portions thereof, may additionally or alternatively be contoured (e.g., curved) for other considerations such as to fit within a desired form factor (e.g., within the shroud 104) of the exercise machine 100. In some embodiments, the lever link 410 may be coupled to the frame such that the distance between the pivot point (or fulcrum F) and the distal end 414 of the lever link 410 which is coupled to the actuator is smaller than the distance between the pivot point (or fulcrum F) and the opposite proximal end 412 of the lever link 410, whereby a smaller distance of travel of the distal end 414 may cause a greater amount of travel at its proximal end 412 enhancing the mechanical advantage of the system.

The lever link 410 may be pivotally coupled, at its distal end 414, to the free end 435 of the rod 434 of the actuator 430 using any suitable pivot joint, such as a lug and clevis joint. In this example, the distal ends of the bars 410-1 and 410-2 act as the opposite sides of the clevis, while the free end 435 of the rod 434 acts as the lug, with a pin 437 pivotally connecting the two. In other examples, a different arrangement may be used such by reversing the location of the lug and clevis or using a different suitable pivot joint. The lever link 410 may be pivotally coupled to the link arm 420, e.g., similarly using a lug and clevis joint, with the lever link 410 again providing the clevis part of the joint. In other words, the proximal ends of the bars 410-1 and 410-2 may act as the opposite sides of the clevis, while the cooperating end of the link arm 420 may provide the lug of the pivot joint.

As shown e.g., in FIG. 10, the link arm 420 may be implemented as a rigid member, e.g., a solid or tubular bar of any suitable cross-section including but not limited to square, rectangular or circular cross-sections. A respective tube 427 may be transversely positioned at each end of the opposite ends 422 and 424 of the link arm 420 to provide a lug end for the respective lug and clevis joints with the lever arm 410 and the rail 130, respectively. The rail 130, which in this example includes a right rail 130-R and a left rail 130-L, is coupled at its distal end 136 to the link arm 420 via a bracket 140, which terminates with a clevis 142. The right rail 130-R is fixed to one side of the bracket and the left rail 130-L is fixed to another side of the bracket, joining the right rail 130-R and the left rail 130-L together at the front end 136 of the rail 130. The right rail 130-R and the left rail 130-L may be fixed together and to the bracket 140, using any suitable means for rigidly coupling such as welding or bolting respective flanges 139-R and 139-L of the rail to the bracket 148, or by being integrally formed with the bracket 140. The bracket 140 may extend at the front end 136 of the rail 130 and may be used to operatively (e.g., pivotally) couple the front end 136 of the rail 130 to the lift mechanism 400. It will be appreciated, that the specific arrangement and coupling of components described is provided for illustration only and other suitable combinations or arrangements may be used in other examples.

As previously described, the crankshaft 301 may be operatively associated with a resistance mechanism 300 to resist the rotation of the crankshaft 301. In some examples, the crankshaft 301 may be associated with a rotatable resistance mechanism such as a magnetically-resisted flywheel 310. In other examples, the flywheel 310 may be frictionally resisted or employ another suitable type of resistance mechanism that can resist, in some cases selectively variably, the rotation of the flywheel 310. In yet further examples, other types of resistance mechanisms may be used in place or in combination with a flywheel, such as air-based resistance (e.g., a fan) or hydraulically resisted wheel. In some examples, the resistance mechanism may provide variable resistance based upon the reciprocation frequency of the pedal (e.g., the user's cadence). In some examples, the resistance mechanism may include a fan, alone or in combination of a flywheel, which in the case of the latter may optionally be arranged on the same shaft. Any other suitable resistance mechanism may be used.

As shown for example in FIGS. 1, 2, and 7, the resistance mechanism 300 may include a flywheel 310 operatively associated with a brake assembly (or simply brake) 320 (e.g., a magnetic eddy current brake). One or more components of the brake assembly 320 may be movably positioned with respect to the flywheel 310 to vary the amount of braking force applied by the brake 320. For example, in the case of a magnetic eddy current brake, the one or more magnets of the brake may be movable with respect to the flywheel to vary the amount of the opposing magnetic field to which the flywheel is exposed and thus vary the resistive or braking force on the flywheel. In other examples, a friction brake, which may be arranged to engage a periphery or a rim of they flywheel, may be used and may similarly include one or more friction members movable to the flywheel vary the friction applied to the flywheel. The operation of the brake 320, such as the relative position of braking elements (e.g., magnet(s), friction pad(s)) may be controlled by a controller 360. The controller 360 may receive electronic inputs from a console of the exercise machine 100 and cause the braking elements to be repositioned responsively, for example by sending electronic commands to an actuation element of the brake 320 or mechanically (e.g., through extension and retraction of a cable 364). In some examples, the brake 320 may be mechanically actuated by the user (e.g., via a lever, knob, etc.) rather than through electronic controls on a console. In yet other examples, the brake 320 may be configured to be controlled both electronically (e.g., during exercise) and/or mechanically (e.g., in an emergency).

Figure 11:
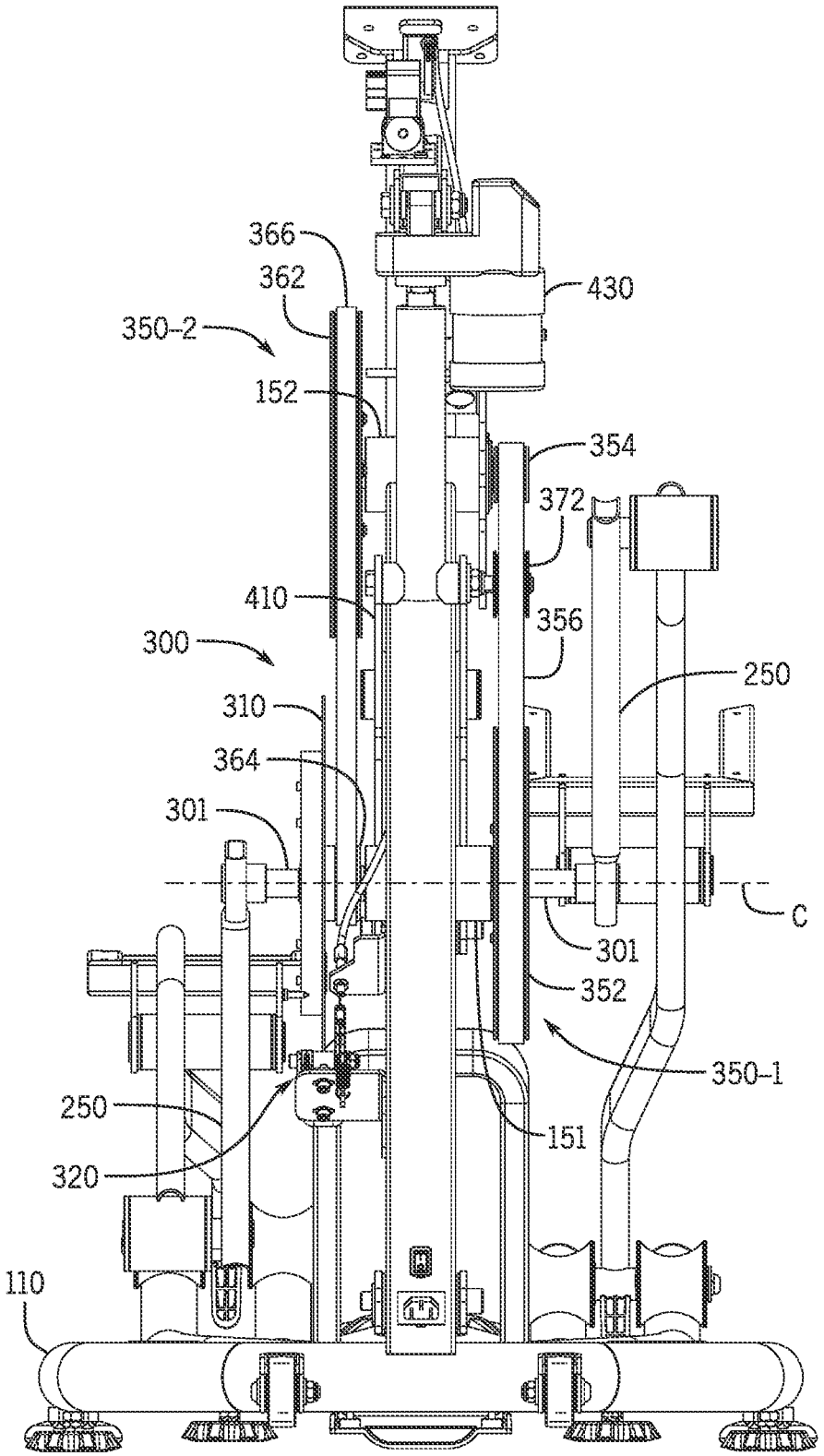
FIG. 11 is a front partial view of the exercise machine in FIG. 1.
Figure 12:
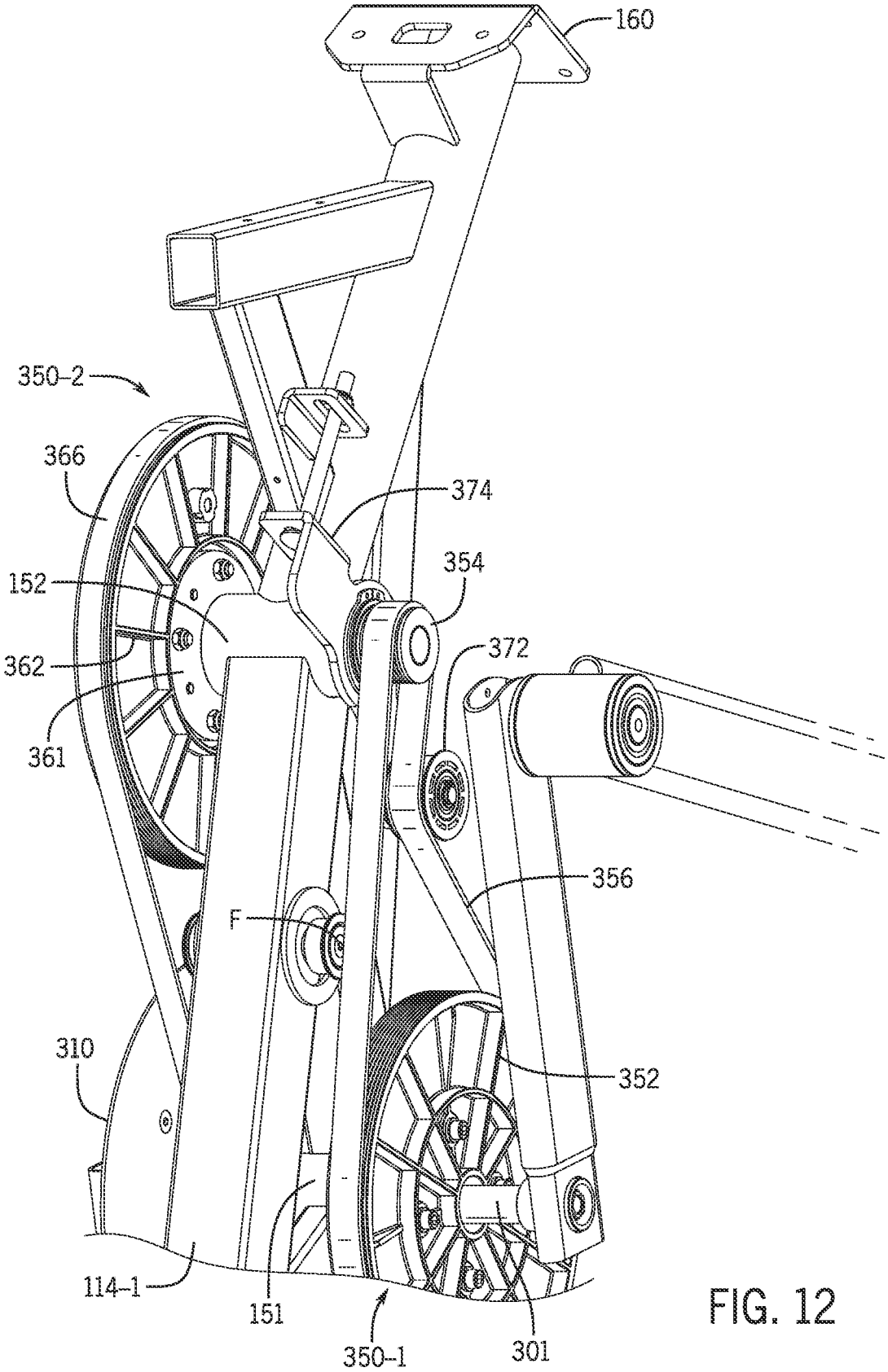
FIG. 12 is an isometric view of a transmission assembly of an exercise machine according to the present disclosure.
Figure 13:
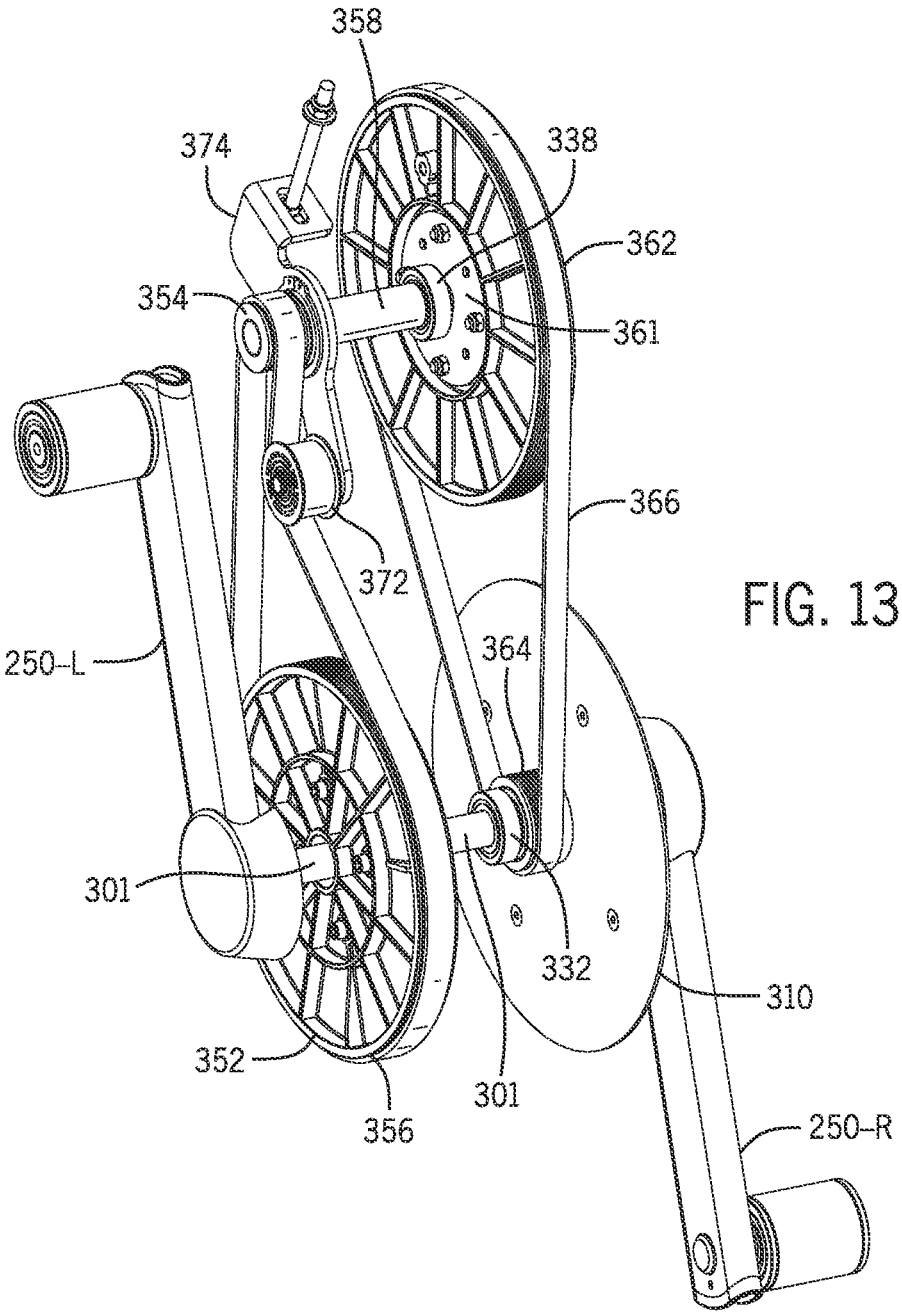
FIG. 13 is another isometric view of the transmission assembly in FIG. 12.

In some examples, the flywheel 310 may be supported by the crankshaft 301 (e.g., coaxially positioned therewith) without the crankshaft 301 directly driving/rotating the flywheel 310. The flywheel 310 may be coupled to the crankshaft 301 via one or more two-way bearings such that rotation of the crankshaft 301 is not directly transmitted to the flywheel 310. Instead, rotation from the crankshaft 301 may be transmitted to the flywheel 310 via a transmission assembly 350. The transmission assembly 350 may be configured to providing a desired gearing ratio, for example to increase the rotational speed from the input (e.g., the crankshaft 301) to the output (e.g., the flywheel 310). The transmission assembly may have a single stage or multiple stages, for example, two stages as shown in FIGS. 11-13. While in the illustrated example, the transmission assembly 350 is shown as a belt-drive assembly using belts and disks/pulleys, it will be understood that in other examples, additionally or alternatively other types of transmission elements, including chain(s) and sprockets, gears, or combinations thereof.

Figure 14:
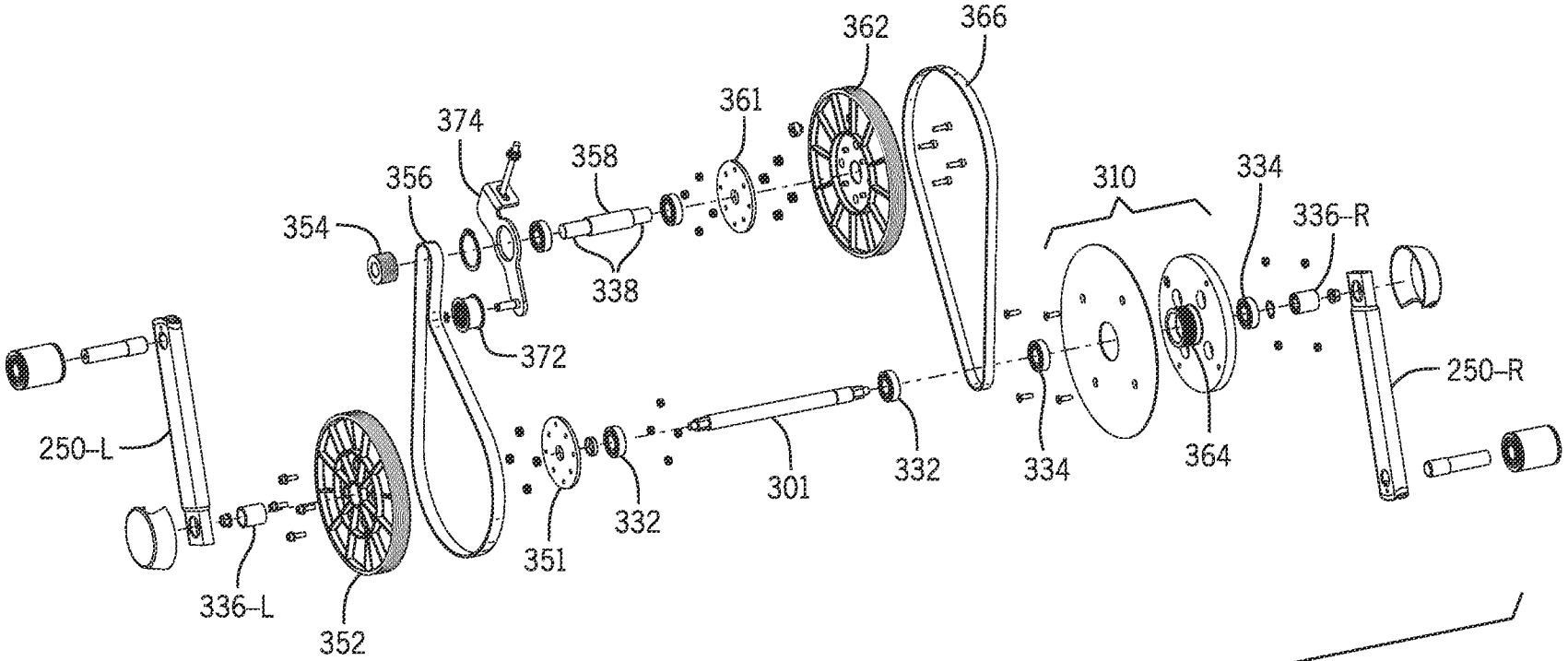
FIG. 14 is an exploded view of the transmission assembly in FIG. 13.
Figure 15:
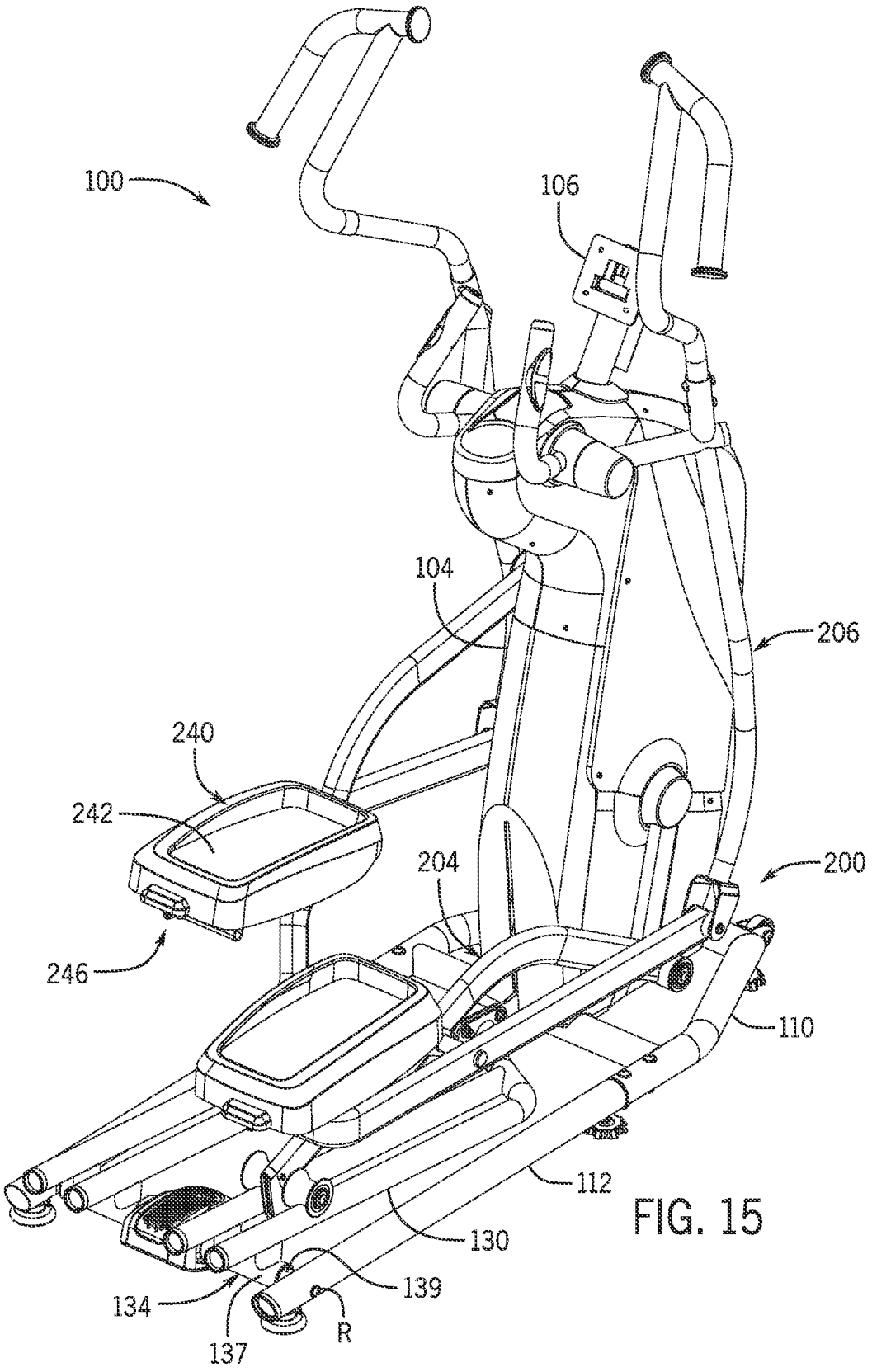
FIGS. 15-20 are rear isometric, front isometric, side, rear, front, and top views of an exercise machine according to the present disclosure, illustrated in these figures with an enclosure around certain movable components of the exercise machine.
Figure 16:
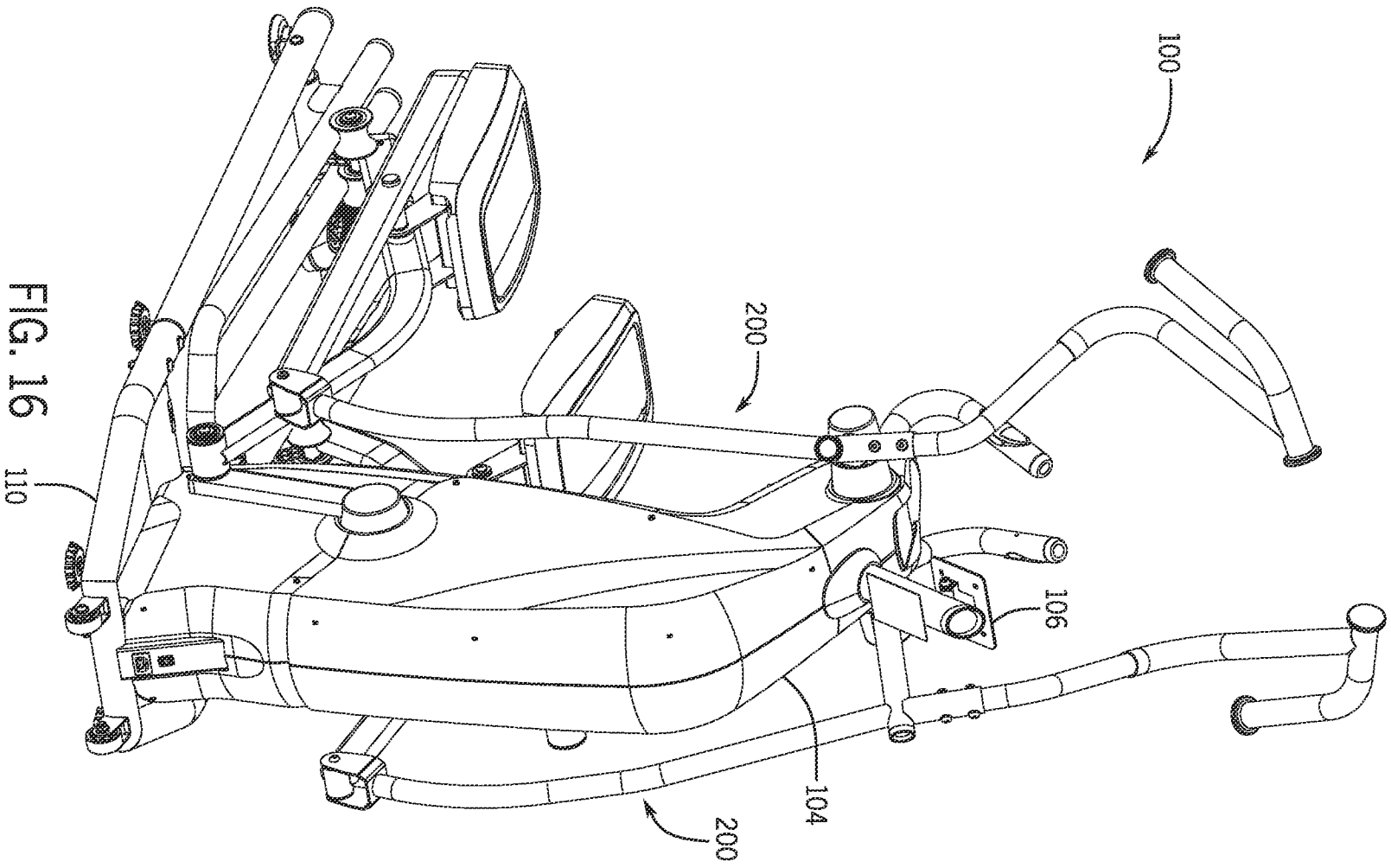
Figure 17:
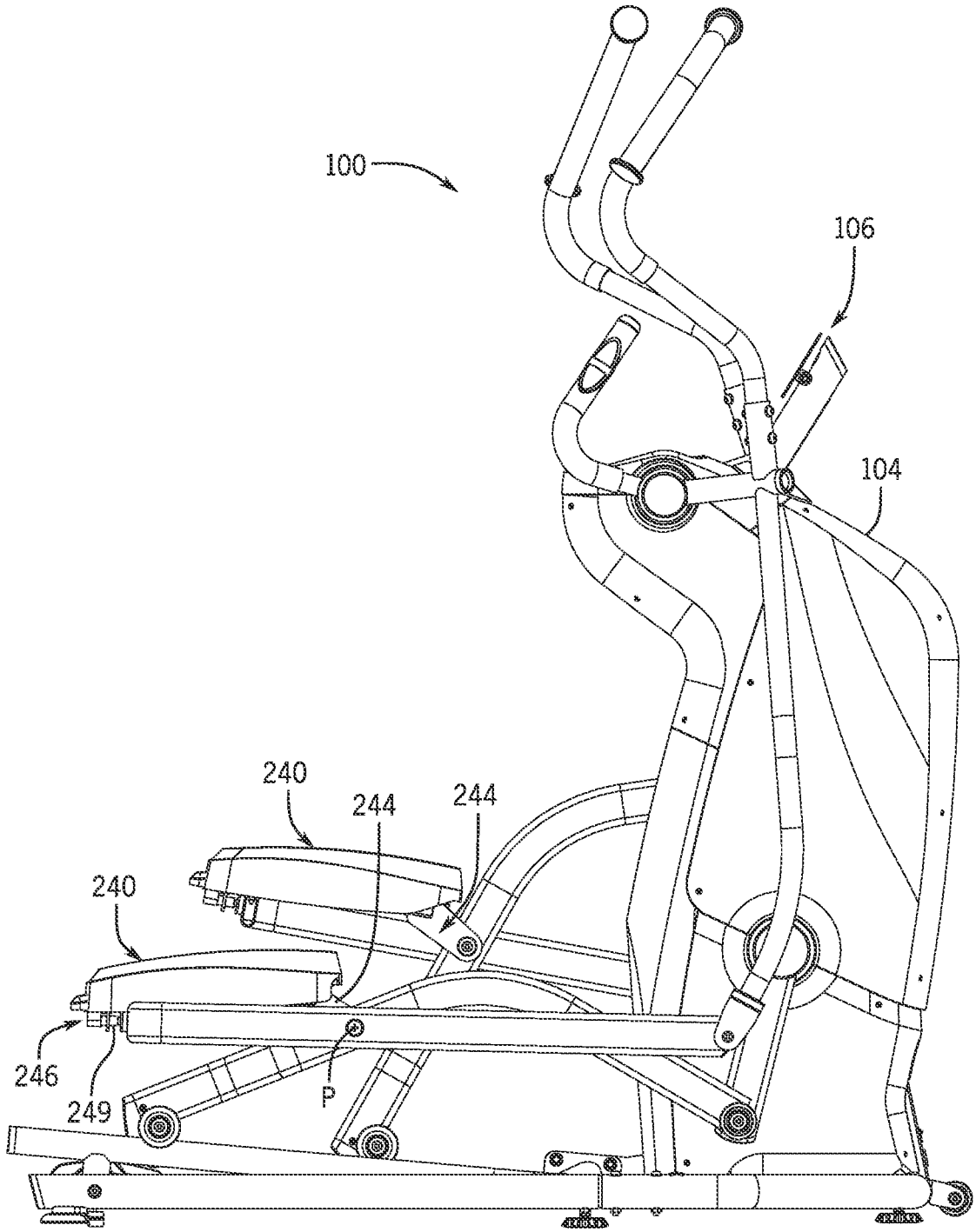
Figure 18:
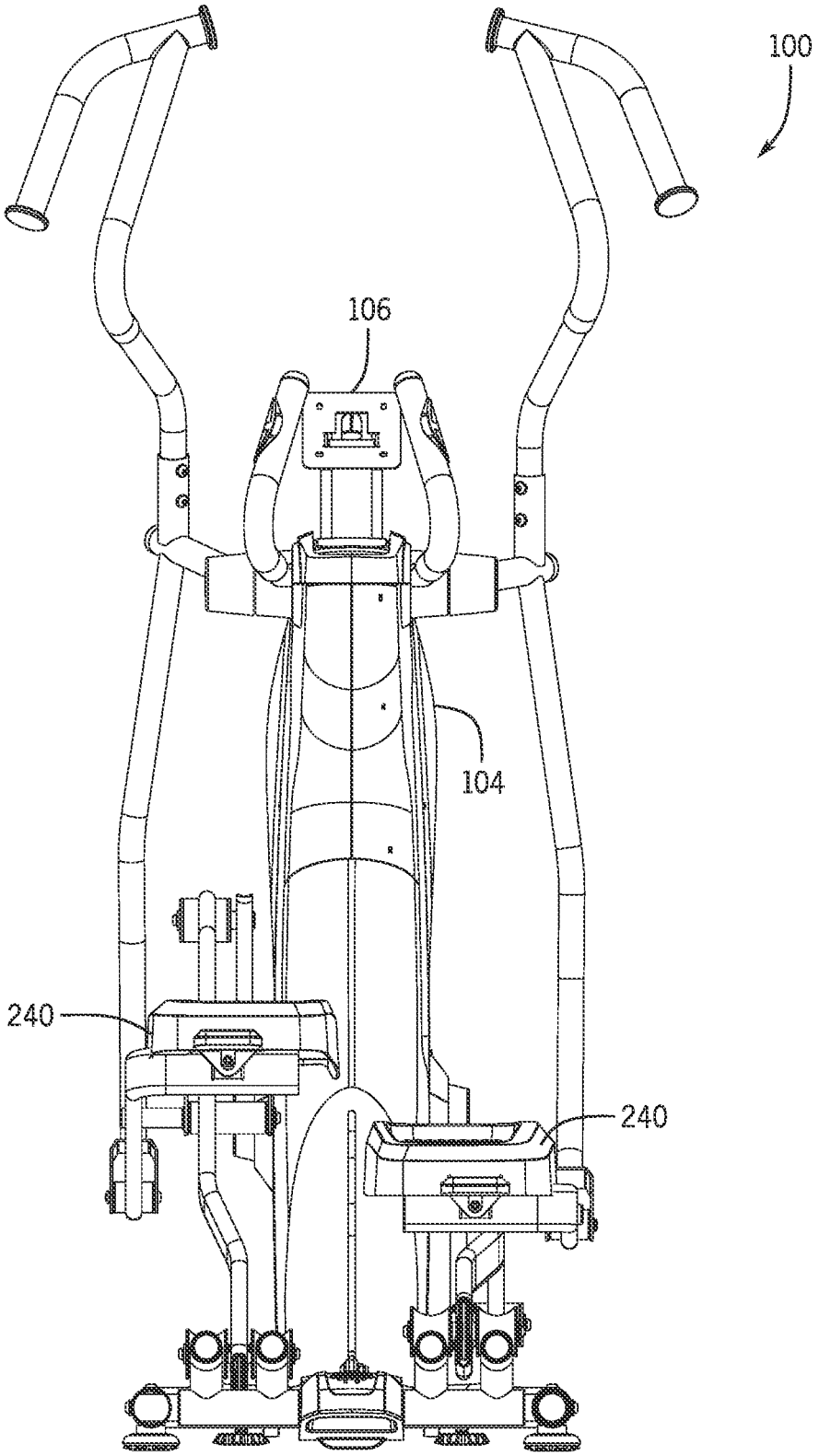
Figure 19:
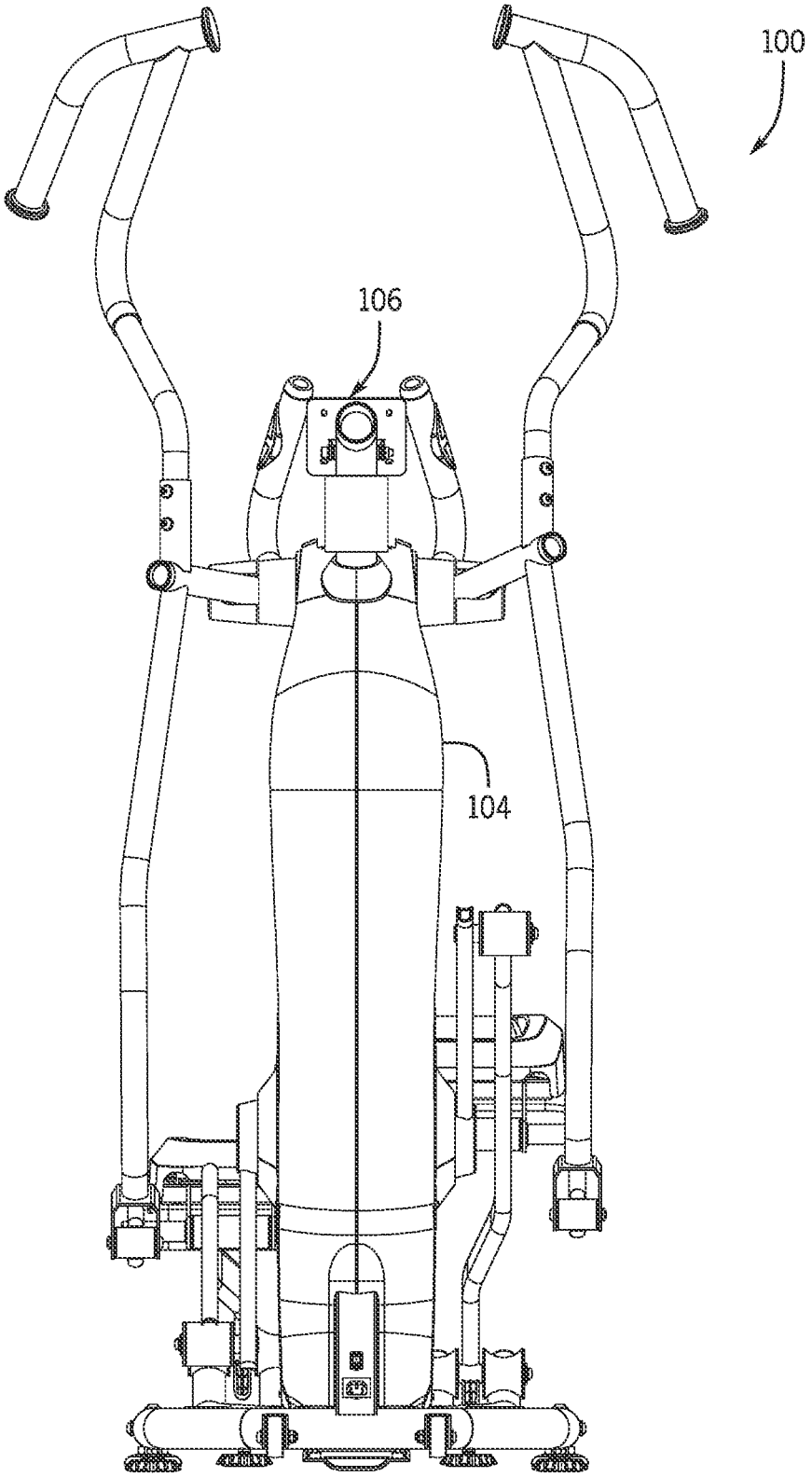
Figure 20:
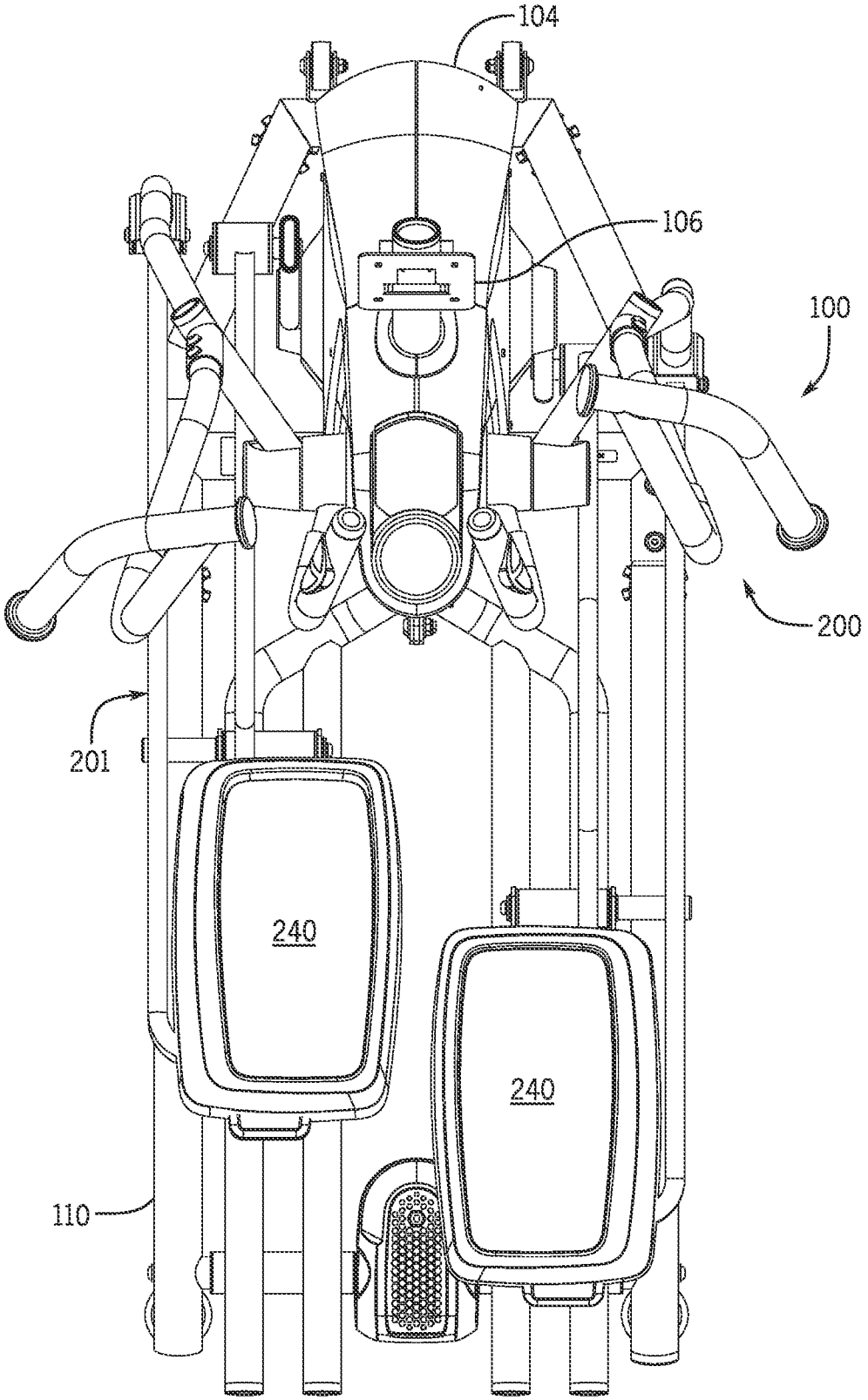

Referring to the example in FIGS. 11-13, the transmission assembly 350 may include a first stage 350-1 and a second stage 350-2, each of which may include an input element and an output element. Referring also to FIG. 14, the transmission assembly 350 may include a first driven member (e.g., first input disk 352) and a first follower member (e.g., first output disk 354) operatively connected, in this case by a first belt 356, to provide a first stage of the transmission assembly 350. In the present example, the first driven member (e.g., first input disk 352) is fixed to the crankshaft 301 such that rotation of the crankshaft 301 causes synchronous rotation of the first driven member (e.g., first input disk 352). In some examples, the first driven member (e.g., first input disk 352) may be fixed to the crankshaft 301, for example by a first plate mount 351, which may be fixed (e.g., welded) to the crankshaft 301 and fixed (e.g., bolted) to the first driven member (e.g., first input disk 352).

As previously described, the crankshaft 301 may be driven by one or more crank arms, for example left and right 250-L and 250-R, each of which is fixed to the respective end of the crankshaft 301 via a respective crank fitting 336-L and 336-R. The crankshaft 301 may be rotatably supported on the frame 110 via one or more two-way bearings 332, which may be used to coaxially rotatably couple the crankshaft 301 to a first tube 151 fixed to the frame 110. One or more additional two-way bearings 334 may be used to rotatably support the flywheel 310 on the crankshaft 301 in a manner that allows the flywheel 310 to rotate independently of the crankshaft 301. Such arrangement may allow the flywheel 310 to be positioned on a common shaft with a geared input (or driven) shaft, which may enable the exercise machine 100 to have a more compact form factor.

The rotation of the first driven member (e.g., first input disk 352) may be transmitted, e.g., via the first belt 356, to the first follower member (e.g., first output disk 354). In the present example, the first follower member (e.g., first follower disk 354) has a smaller diameter than the first driven member (e.g., first input disk 352) and thus the first stage 350-1 gears up (i.e., increases) the rotational speed of the input shaft (i.e., the crankshaft 301). The transmission assembly 350 may further include a second driven member (e.g., second input disk 362) and a second follower member (e.g., second output disk 364) operatively connected, e.g., by a second belt 366, to provide a second stage of the transmission assembly 350. The second driven member (e.g., second input disk 362) may be on a common transmission shaft 358 with the first follower member (e.g., first output disk 354), such that rotation of the first follower member (e.g., first output disk 354) causes synchronous rotation of (or drives) the second driven member (e.g., second input disk 362). The second driven member (e.g., second input disk 362) may be fixed to the transmission shaft 358 via another plate mount 361, which in this case is fixed (e.g., welded) to the transmission shaft 358 and fixed (e.g., bolted) to the second input disk 362. In other examples, the driven disks (e.g., first and second input disks 352 and 362, respectively) may be differently coupled to the respective shaft such as by being directly attached (e.g., bolted) to the shaft. The transmission shaft 358 may be rotatably supported on the frame 110 via one or more two-way bearings 338, which may be used to coaxially rotatably couple the transmission shaft 358 to a second tube 152 fixed to the frame 110. The first and second tubes 151, 152 may be fixed (e.g., rigidly coupled or integrally formed) to the upright frame portion 114 at locations sufficiently spaced apart to avoid interference of the rotatable components.

The rotation of the second driven member (e.g., second input disk 362) may be transmitted, e.g., via the second belt 366, to the second follower member (e.g., second output disk 364). In the present example, the second follower member (e.g., second output disk 364) has a smaller diameter than the second driven member (e.g., second input disk 362) thus further gearing up (i.e., increasing) the rotational speed of the input shaft in the second stage of the transmission assembly 350. The second follower member (e.g., second output disk 364) may be fixed to the flywheel 310 such that rotation of the second follower member (e.g., second output disk 364) causes synchronous rotation of the flywheel 310.

In some embodiments, for example when using belt or chain drives, a tensioner mechanism may be provided to remove slack from a flexible transmission member, such as a belt or chain. For example, an idler 372, which may be implemented pulley, roller, sprocket, other suitable structure and depending on the type of transmission member being used, may be operatively engaged with the flexible transmission member (e.g., the first belt 356). The idler may be supported on a bracket 374, which may be adjustably and/or biasingly coupled to the frame to tension (or biased) the idler 372, in some cases adjustably, toward the flexible transmission member (e.g., first belt 356), which may cause a bend in the flexible transmission member (e.g., first belt 356) towards the inside of the loop. While not shown here, in some examples, an idler may be associated with each of the flexible transmission members of the transmission assembly 350.

FIGS. 15-20 show additional views of an exercise machine 100, shown here with a shroud 104. The shroud 104 may enclose certain components of the exercise machine 100, such as the resistance engine and the lift mechanism, to prevent interference with these components during normal use of the machine, e.g., to reduce the risk of injury and/or provide an aesthetically more pleasing look of the exercise machine 100. In some embodiments, an exercise machine according to the present disclosure, such as the exercise machine 100, may include a media holder (not shown), which may be mounted (e.g., via mount 106) to the exercise machine and which may be configured to removably coupling an electronic device (e.g., a smart phone or other multi-media device) of the user to the exercise machine. The media holder may be implemented in accordance with any of the examples described in patent application U.S. Ser. No. 16/446,135, assigned to the applicant, and titled "Media Holder for Exercise Machine," which is incorporated herein by reference. In some embodiments, the exercise machine may additionally or alternatively include a console, which may be integrated into the machine (e.g., at least partially enclosed by the shroud 104), or at least a portion of which, such as a display, may be removably mounted to the exercise machine. In some embodiments, the media holder may be part of the console, such as being integrated, in part, into the enclosure of the console.

FIGS. 21-34 show views of another example of an exercise machine 500, shown here as an elliptical exercise machine, which includes a lift assembly or mechanism 800 for changing a characteristic (e.g., pedal path incline) of the exercise machine 500. The exercise machine 500 includes a frame 510 configured to support the exercise machine on a support surface (e.g., the ground). The frame 510 may include a plurality of rigidly connected frame members that support moving components of the exercise machine 500, and may thus also be referred to as a rigid frame 510. The frame 510 includes a base 512 configured for contact with the support surface (e.g., the ground). The base 512 may lie substantially parallel to the ground (e.g., horizontally) when the machine 500 is in use and may thus also be referred to as the horizontal frame portion 512. As may be best seen in FIGS. 25-27, the frame 510 includes an upright frame portion (or mast) 515 extending from the base 512. The mast 515 may be implemented by one or more rigid members, 514, 516, 518, shown here as tubes but which may have a different suitable geometry in other examples. The mast 515, or at least a lower portion thereof, may have a generally A-frame shape. The mast 515 may include a front member 516, at least a portion of which inclines aft, toward the rear of the machine 500, and at least one rear member 518, at least a portion of which inclines forward, toward the front of the machine 500 and thus toward the front member 516 of the A-frame. The front and rear members 516, 518 of the A-frame may be rigidly joined to provide a stable upright frame that supports one or more of the movable components of the exercise machine 500.

In the present illustrated example, a first tube 516 extends from the frame 510, e.g., from a distal end of the frame 510, whereby the first tube 516 is arranged near the front of the base 512, and thus substantially at the front end of the exercise machine 500. The first tube 516 may rise substantially vertically from the base 512, defining a first, lower portion 516-1 thereof, and then curve or bend toward the rear side of the exercise machine 500, defining a second, inclined upper portion 516-2 of the first tube 516. A second tube 518 extends from the base 512, from a location which may be generally longitudinally aligned with the first tube 516 but spaced aft therefrom. The second tube 518, which may be optionally inclined forward toward the first tube 516, has an upper end joined to the first tube 516 to form therewith a substantially A-frame shape. In other embodiments, the first tube 516 may be a substantially straight member extending upward and inclined toward the rear of the exercise machine 500, and being joined the second tube 518 to form a generally triangular frame (or A-frame). In yet other embodiments, the second tube 516 may be implemented by a pair of tubes having their lower ends laterally spread to form a tripod-like structure. Various other suitable arrangements of the rigid members forming the mast may be used to provide a stable upright frame portion that supports certain movable components of the exercise machine. In the present example, the upper end of the second tube 518 is connect to or near a lower end of the inclined, upper portion 516-2 of the first tube 516, and a third tube, as connecting support or brace, 514 extends from and connects the second tube 518 to the upper end of the upper portion 516-2 of the first tube 516. The connecting support 514 has a first, lower end 514-1 fixed to the second tube 518, at a location between its upper and lower ends, and a second, upper end 514-2 fixed to or near the upper end of the first tube 516. In other embodiments, the connecting support 514 may be omitted. In some such embodiments, the upper end of the second tube 518 may connect closer to the upper end 516-2 of the first tube 516. However, by using a connecting brace 514 as shown herein, the mast 515 may have a narrower profile, as seen from the side (see e.g., FIGS. 23, 26 and 27), and may accommodate additional components behind the mast 515 while maintaining a compact form factor.

The exercise machine 500 may include at least one, and typically a plurality of movable components supported by the frame 510. For example, the exercise machine 500 includes at least one, and typically a pair of (i.e., a left and a right) reciprocating assemblies 600 that are driven by the user during exercise. Each of the reciprocating assemblies is operatively coupled to a crankshaft 701 (FIG. 22) to cause the crankshaft 701 to rotate when a reciprocating assembly 600 is driven by the user. Each of the reciprocating assemblies 600 includes one or more respective (e.g., left and right) reciprocating linkages 601. The reciprocating linkages 601 may include components configured to support and/or be driven by a lower extremity of the user (e.g., the user's feet), which components may, thus, be referred to as lower linkages 604. In some examples, the reciprocating linkages 601 may additionally or alternatively include components configured to support and/or be driven by an upper extremity of the user (e.g., the user's hands), which component may, thus, be referred to as upper linkages 606. In some examples, a lower linkage 604 may be connected to the respective upper linkage 606 such that movement of one of the two linkages (e.g., the upper linkage 606 or the lower linkage 604), for example when driven by the user, causes the other one of the two linkages (e.g., the lower linkage 604 or the upper linkage 606) to move.

Figure 21:
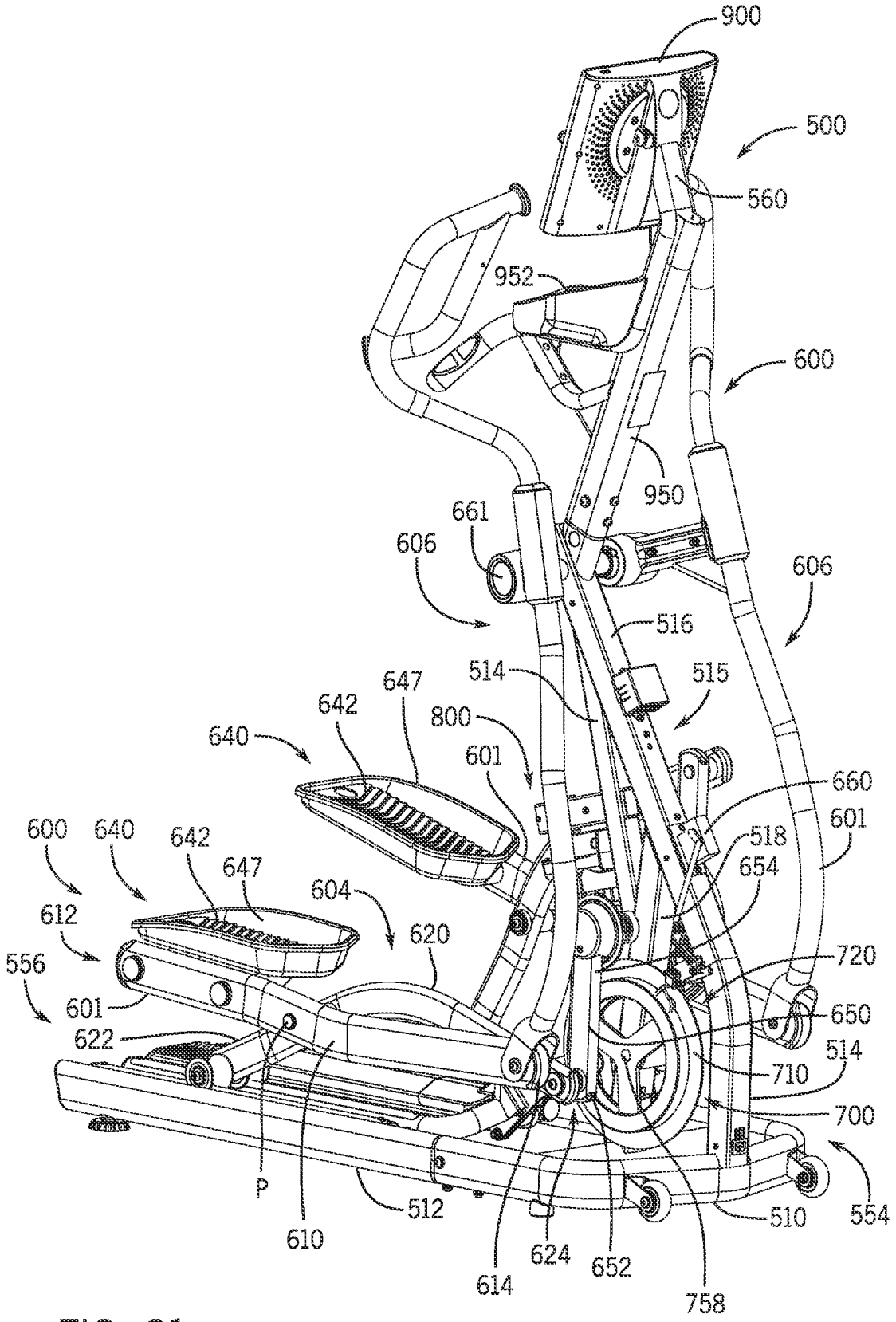
FIG. 21 is a front isometric view of a stationary exercise machine in accordance with further examples the present disclosure.
Figure 22:
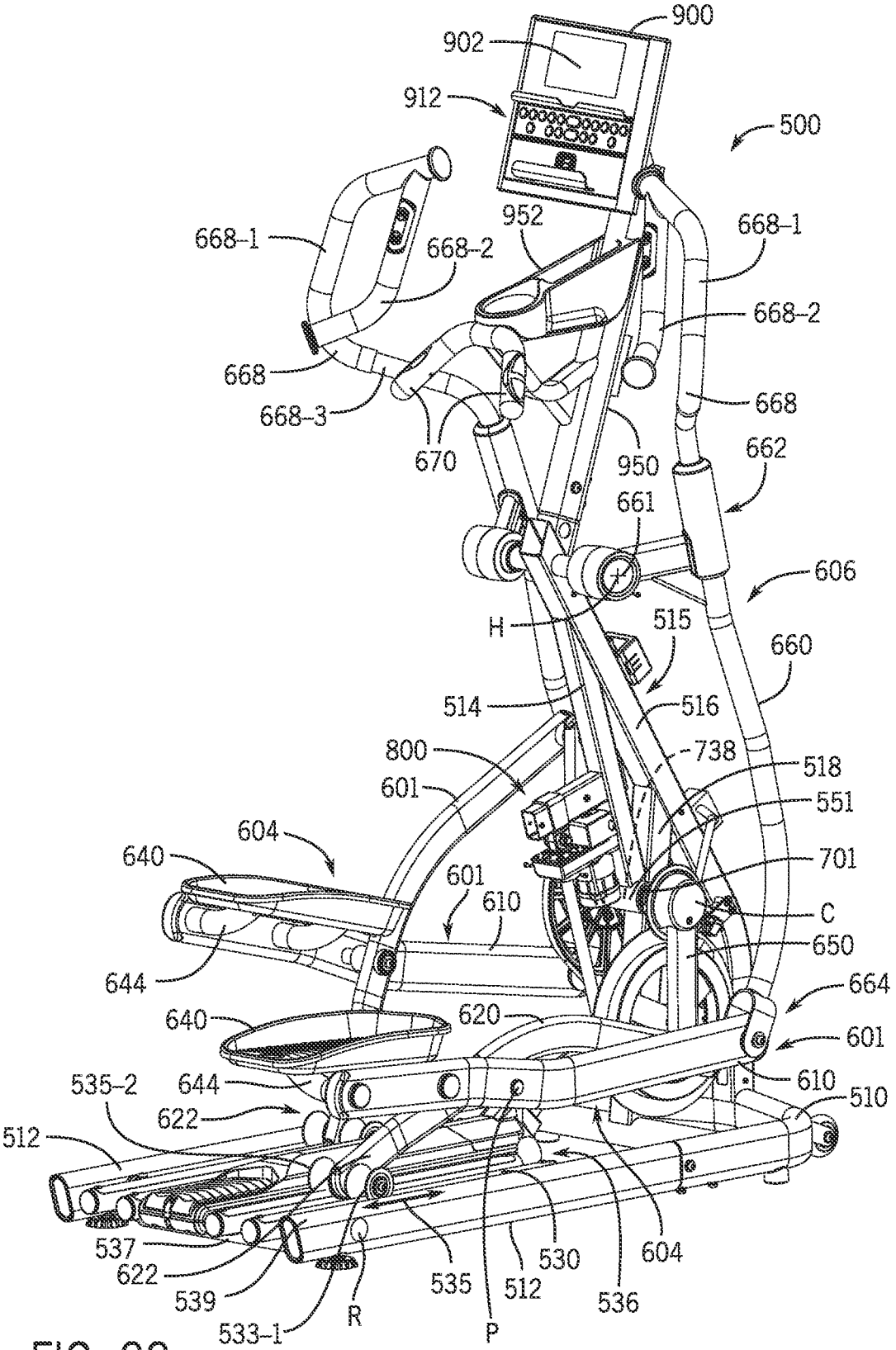
FIG. 22 is a rear isometric view of the exercise machine in FIG. 21.

Referring to FIGS. 21-22, the exercise machine 500 includes left and right reciprocating lower linkages 604, each of which includes a reciprocating member 620 that supports a pedal assembly (or simply pedal) 640. The reciprocating member 620 has a first or proximal end 622 and a second or distal end 624 opposite the first end 622. The reciprocating member 620 may be implemented using an elongate substantially rigid structure, such as a bar, which in this case has at least one curved portion between the two ends 622 and 624 of the reciprocating member 620. In other examples, the reciprocating member 620 may be substantially straight or have a different suitable geometry.

The distal end 624 of the reciprocating member 620 is operatively coupled to the crankshaft 701, in this example via a crank arm 650. A first end 652 of the crank arm 650 is pivotally coupled to the distal end 624 and the opposite, second end 654 of the crank arm 650 is rigidly coupled to the crankshaft 701 such that the crank arm 650 rotates synchronously with the crankshaft 701. While the crank arm 650 is illustrated here as a generally straight rigid link or bar of a given length, the crank arm 650 may be provided by any rigid body, such as a radially-extending portion of a disk or other, which operatively connects the distal end 624 of the reciprocating member 620 to the crankshaft 701, providing a load path for transmitting the force from the reciprocating member 620 to the crankshaft 701. The crankshaft 701 may be coupled to a resistance mechanism 700 such that rotation of the crankshaft 701 about its axis (i.e., crank axis C) is resisted by the resistance mechanism 700, e.g., as described herein.

In some examples, the lower linkage 604 may be operatively connected with a reciprocating upper linkage 606 configured to grasped by and/or be driven by a hand of the user. In the present example, the upper linkage 606 is coupled to the lower linkage 604 via a foot link 610. The foot link 610 may be implemented as an elongate rigid member, in some case a substantially straight bar, which has a first or proximal end 612, a second distal end 614 opposite the first end 612, and a length defined therebetween. The foot link 610 is coupled at its distal end 614 to the upper linkage 606. The foot link 610 may be coupled to the reciprocating member 620 at or near the proximal end 612 or any suitable location between the proximal and distal ends 612, 614, respectively, of the foot link 610. The foot link 610 may be pivotally coupled to the reciprocating member 620 at a pivot joint 616 such that the reciprocating member 620 and the foot link 610 can both pivot relative to one another and about the pivot axis P. In some embodiments, the foot link 610 may also be coupled to the pedal 640 and may support the pedal 640 at one or multiple locations. In some embodiments, the foot link 610 may extend distally of its connection with the reciprocating member 620, e.g., to support the pedal assembly 640 and/or components associated therewith.

In some examples, the reciprocating member 620 (e.g., its proximal end 622) may be movably, in this case slidably, supported on the frame 510. For example, as shown in FIG. 22, the proximal end 622 is configured to slide on one or more rollers (e.g., rollers 533-1 and 533-2) along a rail 530. The rail 530 may be implemented using any suitable structure to define a path 535, which may be linear as in the present example or curved in other examples, such that, in use, the proximal end 622 of the reciprocating member 620 is constrained to travel (e.g., reciprocate) along the path 535. For example, the rail 530 may be implemented using a pair of substantially parallel rail members, shown here as tubes 531-1 and 531-2 (see, e.g., FIGS. 28A and 28B), each slidably or rollably supporting a respective one of the pair of rollers 533-1 and 533-2. In other examples, a single or a greater number of rail members may be used than in specific example here. In yet other examples, the rail 530 may take on a different shape or configuration, such as by being configured to engage differently shaped rollers or engage different portions of the rollers. In yet other examples, the reciprocating member 620 (e.g., its proximal end 622) may be movably supported on a rail in an entirely different manner that constrains the proximal end 622 in a reciprocating motion along a predefined path.

Figure 24:
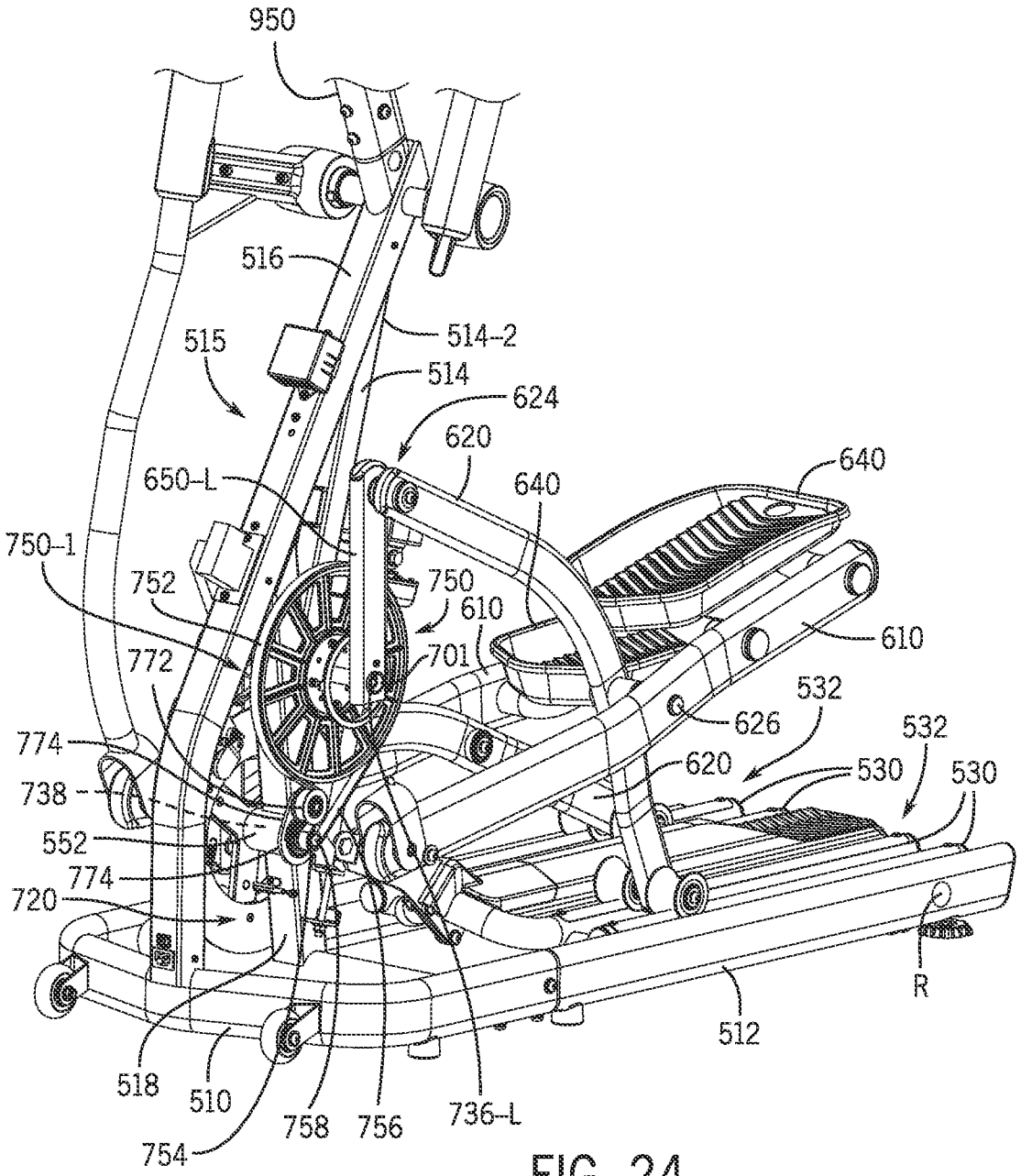
FIG. 24 is an enlarged partial view of a portion of the exercise machine in FIG. 21 showing, for example, components of the transmission.
Figure 28A:
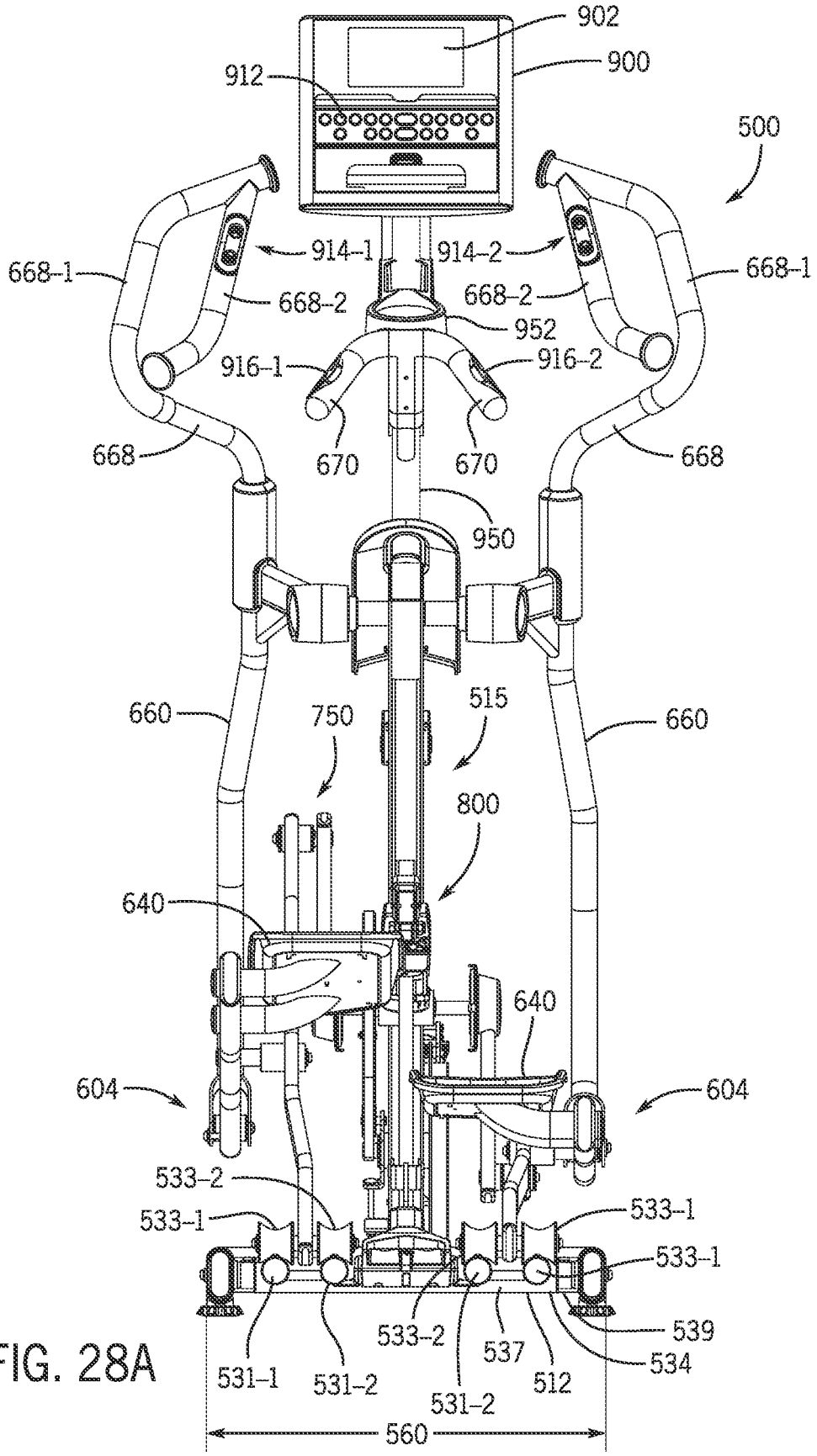
FIG. 28A is a rear elevation view of the exercise machine in FIG. 21.

The rail 530 may be movably (e.g., pivotally) coupled to the frame to allow the relative position (e.g., incline) of the rail 530 to be changed. For example, the rail 530 may be pivotally coupled to the frame 510, and more specifically to the base 512, via any suitable pivot joint, referred to herein as rail pivot 534, that constrains all degrees of freedom except for one rotational degree of freedom of the rail 530. As shown in FIGS. 24 and 28A, the rail 530 may include a rail base, shown here as a transverse tube 537, rigidly coupled to longitudinal tubes of the rail 530, for example at a location near a rear or proximal end 532 thereof. The tube 537 may be rotatably received over a rod 539, such that the transverse tube 537 and consequently the longitudinal tubes of the rail 530 can pivot about a rail pivot axis R in response to a moment about the axis R (shown in FIG. 22), e.g., as may be applied by the lift mechanism 800 and as described further below.

Each of the lower linkages 604 supports a respective pedal assembly (or simply pedal) 340. The pedal assembly 640 may be supported by the reciprocating member 620, the foot link 610, or both. The pedal assembly 640 may include a footplate 642, which in use supports the user's foot. The footplate 642 may be fixed to (e.g., rigidly attached or integrally formed) with a pedal shroud 647, which may include one or more walls extending upwardly from the footplate 642 to restrict movement of the user's foot in one or more direction (e.g., the forward and lateral directions). The footplate 642 may be coupled to the supporting structure (e.g., the reciprocating member 620 and/or the foot link 610) via a pedal mount 644. In some embodiments, the pedal mount 644 may be configured to cantilever the respective pedal 640 from the foot link 610. Each of the pedals 640 may be rigidly connected to the foot link 610 so as to remain in a fixed position relative thereto. In some embodiments, the pedals 640 may be movably (e.g., pivotally) supported on the lower linkage 604, for example using a similar mounting structure to that of the exercise machine 100, or using another suitable mount which enables the orientation and/or position of the individual pedals in relation to the supporting structure (e.g., the reciprocating member 620 and/or the foot link 610) to be adjusted.

The exercise machine 500 may also include an upper reciprocating linkage 606 configured to be driven by a user's hand. The upper reciprocating linkage 606 may be operatively associated with the crankshaft 701 for transferring the force applied by the user to the crankshaft 701. In some embodiments, the upper reciprocating linkage 606 may be operatively coupled to the crankshaft 701 solely via its connection to the respective lower reciprocating linkage 604. As shown e.g., in FIGS. 22 and 23, the upper reciprocating linkage 606 may include a handle link 660 terminating at a handle 668 configured to be gripped by the user. The handle link 660 may be pivotally coupled, near its proximal end 662, to the frame 510, and more specifically to the upright frame portion 516. The handle link 660 may be coupled to the upper end of the mast 515, e.g., above the junction of the first tube 516 with the connecting support 514. The handle link 660 may be coupled to the frame at pivot location 661 such that, in use, the handle link 660 reciprocally pivots about a handle pivot axis H. The proximal end 662 of the handle link 660 may be fixed to (e.g., rigidly connected or integrally formed with) the handle 668 such that the handle 668 reciprocates in synchrony with the reciprocal movement of the handle link 660. In some examples, the handle 668 may include different distinct grip locations 668-1, 668-2, 668-3, e.g., to accommodate users of different builds (e.g., slimmer or wider users) and/or activate different muscle groups of the user. The exercise machine 500 may optionally include additional handles 670, which may be coupled to the frame 510 so as to remain stationary during exercise, and thus may also be referred to as fixed or stationary handles 670. The exercise machine 500 may include a console support 950 coupled to and extending upward from the mast 515 to support a console 900, a storage tray 952, a free weight hanger (not shown), and other accessories of the exercise machine 500 at a location accessible to the user, e.g., at a height suitable for reach by the user. The height of the console, storage tray, free weight hanger, and other accessories, or any combinations thereof, may be adjustable, individually for each accessory or via a movable coupling between the console support and the mast 515. In some embodiments, one or more of the handles, such as the stationary handles 670, may be mounted on the console support 950, and in embodiments in which the console support 950 is adjustable (vertically), the relative height of the stationary handles 670 in relation to the pedals may be adjusted to accommodate users of different heights.

Figure 23:
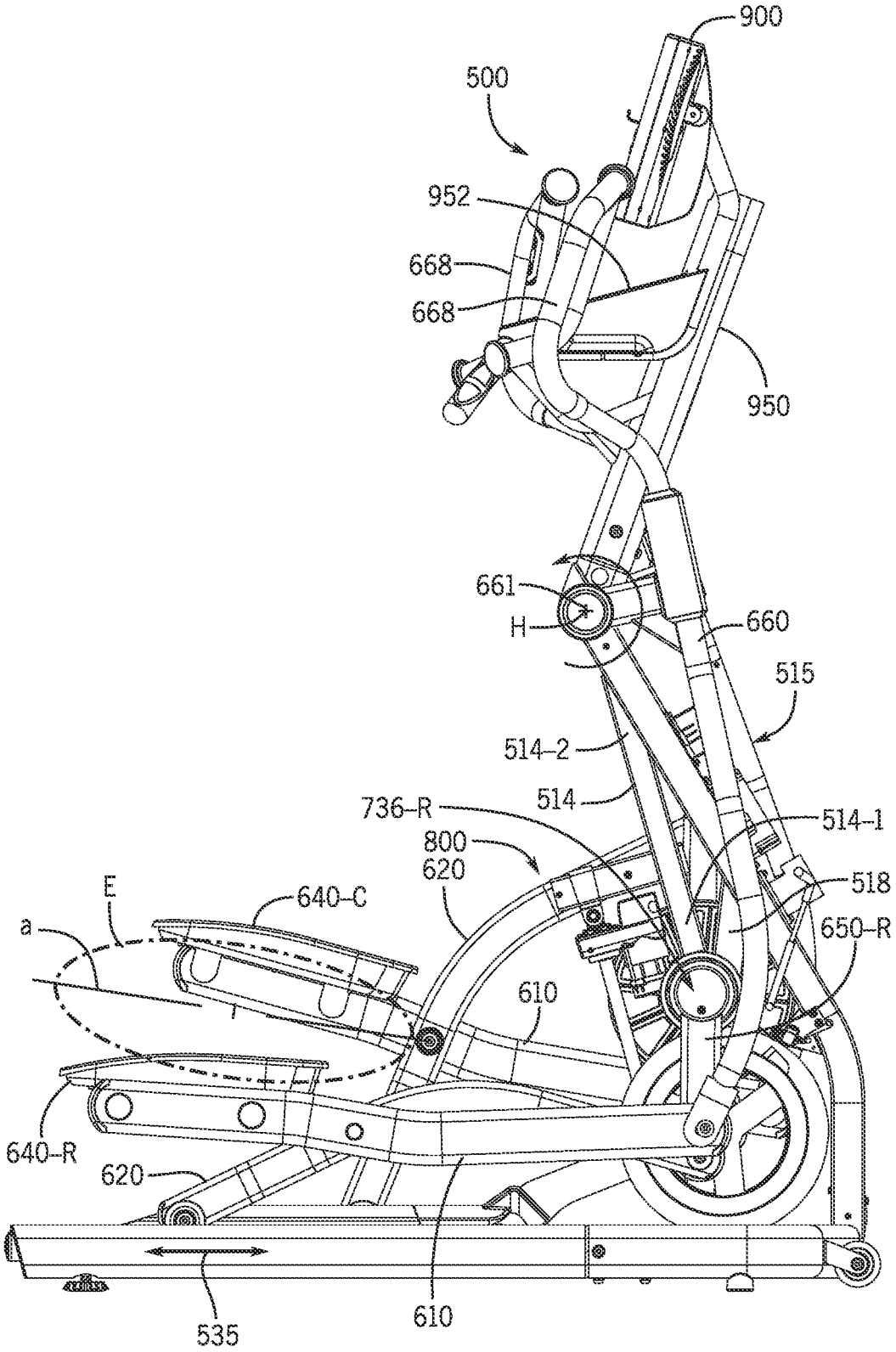
FIG. 23 is a side view of the exercise machine in FIG. 21.

The distal end 664 of the handle link 660 may be operatively associated with the crankshaft 701, in this example indirectly, via the connection between the upper linkage 606 to the lower linkage 604, which may be directly connected to the crankshaft 701. In other examples, the upper linkage 606 may be differently connected to the crankshaft 701 such as via a direct connection between the upper linkage 606 and the crankshaft 701. As shown e.g., in FIG. 23, the distal end 664 of the handle link 660 may be pivotally connected to the distal end 614 of the foot link 610 by any suitable pivot joint, such as a lug and clevis joint. As illustrated in FIG. 23, in use, as the pedal 640 traverses the path E, shown here as being substantially elliptical, the foot link 610 reciprocates back and forth and consequently the distal end 664 of the handle link 660 reciprocates in corresponding back and forth motion. The reciprocating linkages 601 may be configured such that when a given pedal (e.g., the right pedal) is moved to the forward most position along its elliptical path, the corresponding handle (e.g., the right handle) is in a position closest to the user, while the opposite handle (e.g., the left handle) is in a position farthest from the user and the opposite pedal (e.g., the left pedal) is in the aft most position along its elliptical path to mimic natural walking or striding motion where each arm swings with the motion of the opposing leg.

The movement of the pedals 640 through the elliptical path E may be similar to that as described with respect to the exercise machine 100 as shown for example in FIGS. 3-6 and as described in the accompanying description, which is not repeated, for brevity.

Figure 26:
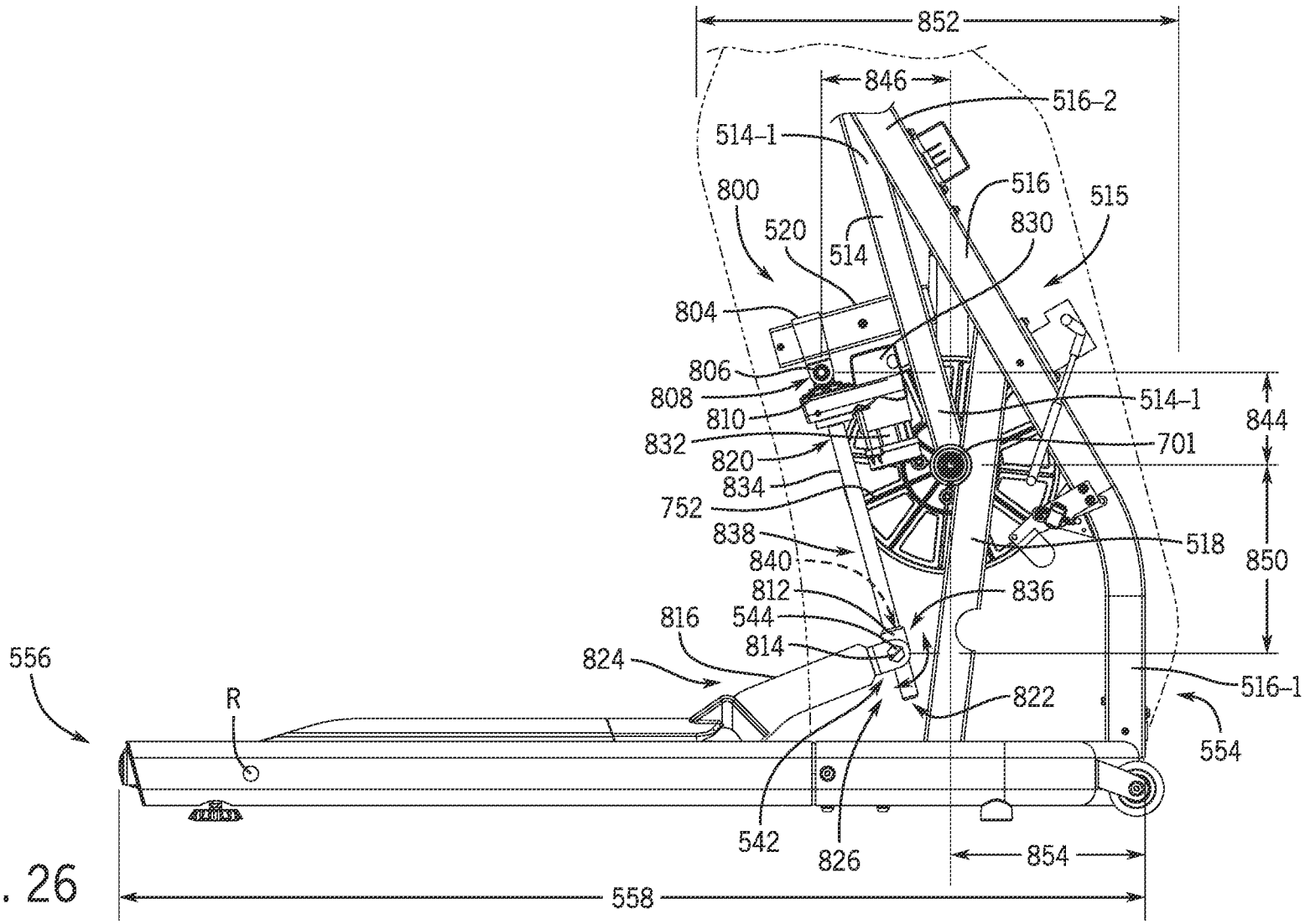
FIG. 26 is a side elevation view of the exercise machine in FIG. 21 showing the lift mechanism in a first configuration.
Figure 27:
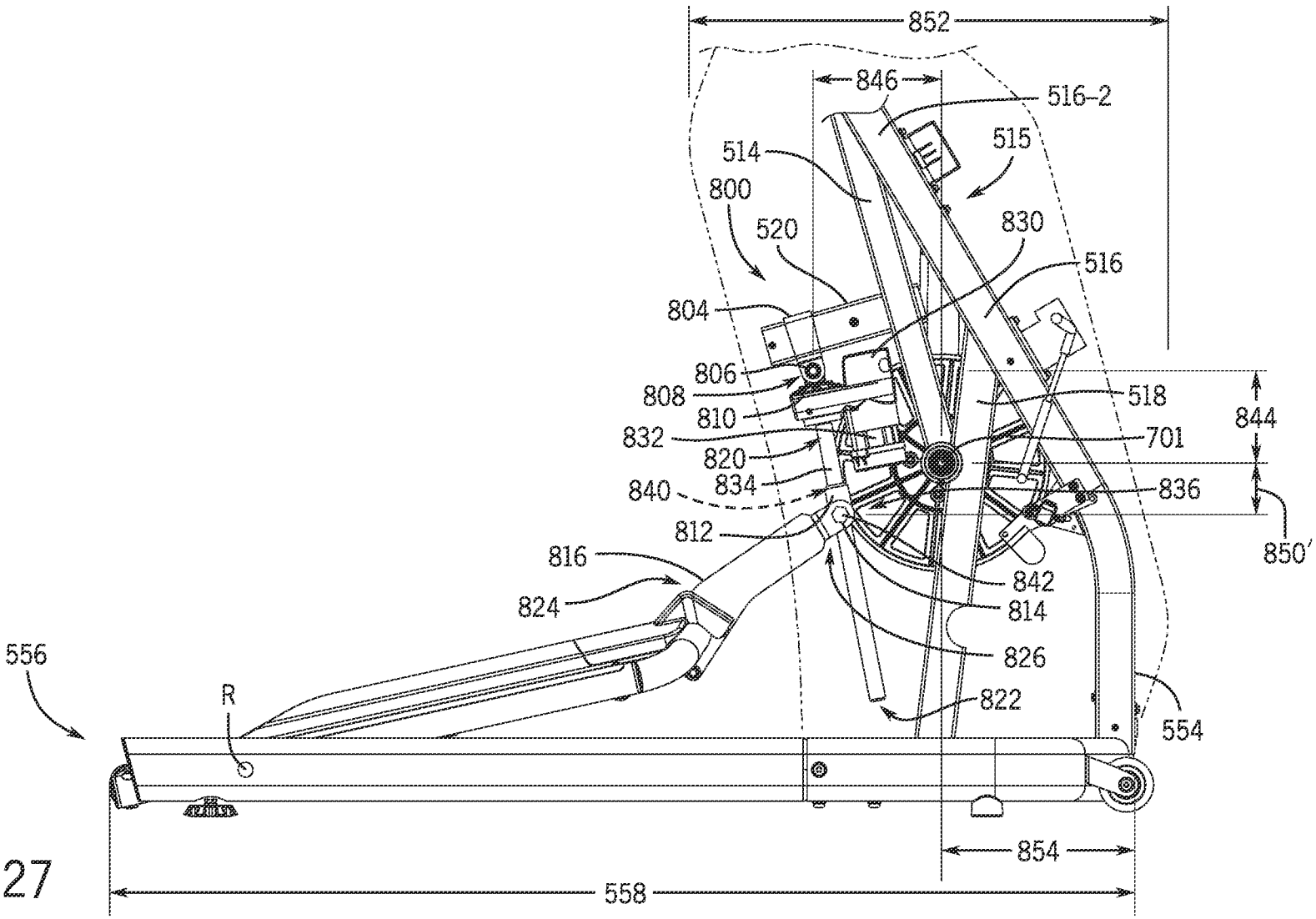
FIG. 27 is a side elevation view of the exercise machine in FIG. 21 showing the lift mechanism in a second configuration.

In accordance with the present disclosure, the pedals 640 may be supported on the frame 510 of the exercise machine in a manner which enables the user to vary a characteristic of the exercise provided by the machine 500, such as by varying a characteristic of the closed loop path E traversed by the pedals. Referring to FIGS. 26 and 27, the rail 530 which supports the lower linkage 604 may be pivotable to vary its incline angle, which in turn changes the incline angle of the closed loop path. For example, the lift mechanism 800 may be adjustable between raised and lowered positions that vary the incline angle of the lower linkage 604. The rail 530 may be adjustable between a nominal (or minimum incline) position, which in the present example is a substantially level or horizontal position of the rail 530 with respect to the horizontal frame portion 512 and the ground producing a negative incline of the closed loop path E, and a maximum incline position which may be about 20 degrees of incline of the rail 530 relative to the ground, and in some cases greater than 20 degrees, such as up to 30 degrees or more. The lift mechanism may be positionable to a decline position, below the horizontal position of the rail 520 (e.g., to simulate moving down an hill). As shown for example in FIG. 23, for example the angle of inclination of the major axis a, may be varied. As shown in FIG. 23, the elliptical path E may be nearly horizontal or slightly negatively inclined at the nominal incline position of the rail 530, which may mimic a more horizontal walking or running motion. As the incline of the rail 530 is increased, the angle of inclination of the major axis a may also increase to mimic increasingly more vertical motion, such as a stair climbing motion as the inclination approaches the maximum. To effect such incline adjustments, the exercise machine 500 may include a lift mechanism 800 operatively associated with the rail 530 to pivot the rail 530 about its pivot axis R.

Figure 25:
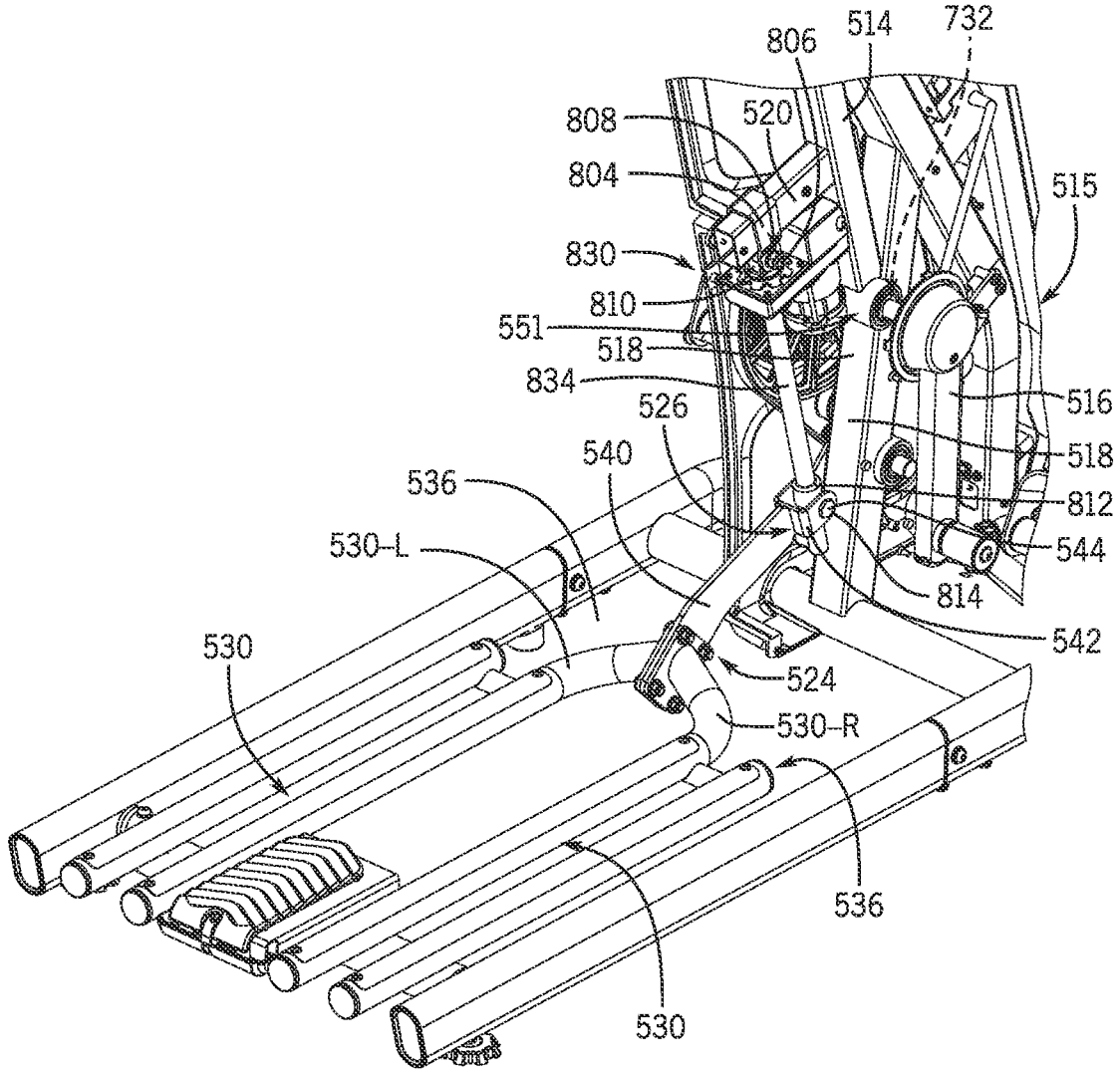
FIG. 25 is another enlarged partial view of a portion of the exercise machine in FIG. 21 showing, for example, components of the lift mechanism.

The angle (incline or decline) of the linear path traversed by the lower linkages 604 may be varied by changing the angle of the rail 530 relative to the base 512 by operation of the lift mechanism 800, and example of which is shown in FIGS. 25-27. The lift mechanism 800 may include a linear actuator or lift motor 830 of any suitable configuration. For example, the lift motor 830 may be implemented by a motor 832 (e.g., electric motor) operably arranged to move a driven portion 812 away from and toward the motor 832. The motor 832 can be any suitable motor, such as an electric rotary motor. The driven portion 812 may be provided, for example, by a free end of a telescoping rod which extends and retracts. In other examples, the driven portion 812 may be provided by a movable portion (e.g., a nut) arranged to move along the length of a rod (e.g., a screw). In the case of the former, the rod 834 may be implemented using any suitable telescoping member, which is in operative arrangement with the motor 832 to convert, e.g., a rotary input of the motor 832 to linear output at (e.g., extension and retraction of) a free end 822 of the rod 834 opposite the motor. The lift motor 830 may utilize electromechanical, hydraulic, or pneumatic actuation, or any combination thereof. For example, instead of an electrically driven rod-type actuator, the actuation may be provided by a hydraulic, pneumatic, electro-hydraulic or electro-pneumatic cylinder.

In some embodiments, the rod 834 may be configured to move the driven portion 812 (e.g., a nut), along the length of the rod 834. In such embodiments, the rod 834 may include one or more helical threads (not shown) on an external surface 838 of the rod 834. The threads on the external surface 838 may operatively engage with mating threads of the driven portion 812 of the lift mechanism 800, such as a nut 812 including internal threads (not shown) on an aperture 840 formed therein that mate with the threads on the external surface 838 of the rod 834. Rotation of the rod 834, powered by the motor 832, moves the driven portion toward and away from the motor end portion, depending on the direction of rotation, to raise and lower, respectively, the rail 530, which is operatively connected to the driven portion 812 of the lift mechanism 800.

In some embodiments, the lift mechanism 800 is suspended from the mast 515. In the example shown, the mast 515 includes a cantilever 520 that extends from one of the upright supports of the mast 515, such as from the connecting support 514, in a rearward direction (e.g., towards the rail 530). In the example shown, the cantilever 520 declines below horizontal as it extends rearwardly from the connecting support 514. In other examples, the cantilever 520 may extend substantially horizontally from the connecting support 514, or may be inclined upward. A different suitable structure for suspending the lift mechanism may be used in other embodiments.

The lift motor 830 is suspended from the mast 515, from a location above the crankshaft 701 and axis C, whit the motor end of the lift motor 830 coupled to the cantilever 520 and the rod 834 extending downward therefrom, towards the base 512. The motor end of the lift motor 830 may be pivotally coupled to the cantilever 820 using any suitable pivot joint 808. For example, referring to FIG. 25, the pivot joint 808 may include a collar or yoke 804 rigidly mounted, such as by being welded, bolted, or otherwise fastened, to the cantilever 520. The yoke 804 may wrap over the top and sides of the cantilever 520 and have a yoke end adapted to receive a pin 806. The pin 806 may pass through an eye provided on the motor end of the lift motor 830 such that the lift motor 830 may be suspended from the mast 515 with the motor 832 positioned near the cantilever 520. The eye on the motor end of lift motor 830 and the yoke 804 may form the pivot joint (or simply pivot) 808. Pivotally suspending the lift mechanism 800 (e.g., lift motor 830) from the mast 515 allows the lift mechanism (e.g., lift motor 830) to pivot toward and away from the mast 515 as the lift mechanism 800 lowers and raises the rail 530, respectively. In other embodiments, the lift mechanism 800 may be pivotally suspended from the mast 515 using a different suitable structure such as a clevis bracket fixed to the underside of the cantilever 520 and which receives the pin 806, or via an axle passing through the cantilever 520 to provide the pivotal action provided by pin 806. The lower end of the lift mechanism 800 may also be pivotally mounted, in that case to the rail 530 as described further herein.

As shown e.g., in FIGS. 25-27, the rail 530, which in this example includes a right rail 530-R and a left rail 530-L, is coupled at its distal end 536 to a bracket 540, which terminates with a clevis 542. The right rail 530-R is fixed to one side of the bracket 540 and the left rail 530-L is fixed to another side of the bracket 540, joining the right rail 530-R and the left rail 530-L together at the front end 536 of the rail 530, which is then coupled to the rear end 524 of the bracket 540. The right rail 530-R and the left rail 530-L may be fixed together and to the bracket 540, using any suitable means for rigidly coupling such as welding or bolting respective flanges 539-R and 539-L of the rail to the bracket 548, or by being integrally formed with the bracket 540.

The bracket 540 may extend at the front end 536 of the rail 530 and may be used to operatively (e.g., pivotally) couple the front end 536 of the rail 530 to the lift mechanism 800 for raising and lowering the rail 530. Any suitable pivot joint (or simply pivot 544) may be used to pivotally connect the rail 530 to the lift mechanism 800. For example, the clevis 542 may be wide enough to accommodate the driven portion 812 between its two sides, and a pin (or set of pins) 814 may be pivotally received through apertures in the sides of the clevis 542 and fixed to the sides of the driven portion 812 to form the pivot 844. In other embodiments, the pin(s) 814 may be fixed to the bracket 540 and pivotally received by the driven portion 812. Other suitable combinations or arrangements may be used in other examples to form the pivot joint 544.

As shown in FIGS. 26 and 27, the pivot 808 may be spaced aft of the crank axis C of the crankshaft 701 by a horizontal distance 846. The pivot 808 may be located spaced vertically above the crank axis C by a vertical distance 844. The pivot 544 may be located vertically below the crank axis C. In some embodiments, the pivot 544 may remain vertically below the crank axis C through the full range of travel of the driven portion 812 (e.g., even at its fully retracted position, shown by reduced vertical distance 850' in FIG. 27). In some embodiments, the pivot 544 may move to a vertical location above the crank axis C when the lift mechanism 800 is fully retracted and the rail is raised to its maximum incline angle. The pivot 544 moves away from the mast 515 and thus from the crank axis C supported thereon, when the lift mechanism 800 is retracted, as shown by increased horizontal distances 848' in FIG. 27. A protective enclosure (e.g., shroud 504) having a dimension just large enough to enclose the mast and certain moving components associated therewith, including the lift mechanism 800, may enhance the user safety and/or aesthetics of the exercise machine, while still offering an exercise machine with an incline-adjustable rail and having a relatively slim profile. For example, the shroud 504 may have a width 852, as viewed from the side, which is just large enough to substantially enclose the mast 515, the lift mechanism 800 suspended therefrom, and some or all rotating components supported by the mast 515 (e.g., a flywheel). In some embodiments, this width 852 may not exceed about 25 inches. In some embodiments, the shroud 504 may surround the front of the mast 515 and extend aft to the crank axis C, which in this example is located a horizontal distance 854 behind of the front of the mast, the shroud further extending aft just enough (e.g., about a distance 848') to enclose the lift mechanism at its fully retracted position.

As previously described, the crankshaft 701 may be operatively associated with a resistance mechanism 700 to resist the rotation of the crankshaft 701. In some examples, the crankshaft 701 may be associated with a rotatable resistance mechanism such as a magnetically-resisted flywheel 710. In other examples, the flywheel 710 may be frictionally resisted or employ another suitable type of resistance mechanism that can resist, in some cases selectively variably, the rotation of the flywheel 710. In yet further examples, other types of resistance mechanisms may be used in place or in combination with a flywheel, such as air-based resistance (e.g., a fan) or hydraulically resisted wheel. In some examples, the resistance mechanism may provide variable resistance based upon the reciprocation frequency of the pedal (e.g., the user's cadence). In some examples, the resistance mechanism may include a fan, alone or in combination of a flywheel, which in the case of the latter may optionally be arranged on the same shaft. Any other suitable resistance mechanism may be used.

As shown for example in FIGS. 21 and 22, the resistance mechanism 700 may include a flywheel 710 operatively associated with a brake assembly (or simply brake) 720 (e.g., a magnetic eddy current brake). One or more components of the brake assembly 720 may be movably positioned with respect to the flywheel 710 to vary the amount of braking force applied by the brake 720. For example, in the case of a magnetic eddy current brake, the one or more magnets of the brake may be movable with respect to the flywheel to vary the amount of the opposing magnetic field to which the flywheel is exposed and thus vary the resistive or braking force on the flywheel. In other examples, a friction brake, which may be arranged to engage a periphery or a rim of they flywheel, may be used and may similarly include one or more friction members movable to the flywheel vary the friction applied to the flywheel. The operation of the brake 720, such as the relative position of braking elements (e.g., magnet(s), friction pad(s)) may be controlled by a controller 760. The controller 760 may receive electronic inputs from a console of the exercise machine 500 and cause the braking elements to be repositioned responsively, for example by sending electronic commands to an actuation element of the brake 720 or mechanically (e.g., through extension and retraction of a cable 764). In some examples, the brake 720 may be mechanically actuated by the user (e.g., via a lever, knob, etc.) rather than through electronic controls on a console. In yet other examples, the brake 720 may be configured to be controlled both electronically (e.g., during exercise) and/or mechanically (e.g., in an emergency).

In some examples, the flywheel 710 may be supported by the crankshaft 701 (e.g., coaxially positioned therewith) without the crankshaft 701 directly driving/rotating the flywheel 710, as described previously with reference to the exercise machine 100. In such examples, the flywheel 710 may be coupled to the crankshaft 701 via one or more two-way bearings such that rotation of the crankshaft 701 is not directly transmitted to the flywheel 710. Instead, rotation from the crankshaft 701 may be transmitted to the flywheel 710 via a transmission assembly 750. The transmission assembly 750 may be configured to providing a desired gearing ratio, for example to increase the rotational speed from the input (e.g., the crankshaft 701) to the output (e.g., the flywheel 710). The transmission assembly may have a single stage as shown in FIG. 24. or multiple stages, for example, two stages as shown in FIGS. 11-13. While in the illustrated example, the transmission assembly 750 is shown as a belt-drive assembly using belts and disks/pulleys, it will be understood that in other examples, additionally or alternatively other types of transmission elements, including chain(s) and sprockets, gears, or combinations thereof. The exercise machine 500 may include a transmission assembly as previously described, such as a two-stage transmission.

In other examples, such as the example shown in FIGS. 21-34, the exercise machine 500 may have a single-stage transmission. As best shown in FIG. 24, the transmission assembly 750 may include a first stage 750-1 which may include an input element and an output element. The transmission assembly 750 may include a first driven member (e.g., first input disk 752) and a first follower member (e.g., first output disk 754) operatively connected, in this case by a first belt 756, to provide a first stage of the transmission assembly 750. In the present example, the first driven member (e.g., first input disk 752) is fixed to the crankshaft 701 such that rotation of the crankshaft 701 causes synchronous rotation of the first driven member (e.g., first input disk 752). In some examples, the first driven member (e.g., first input disk 752) may be fixed to the crankshaft 701, as previously described with respect to the transmission assembly 350.

The crankshaft 701 may be driven by one or more crank arms, for example left and right crank arms 650-L and 650-R, respectively, each of which may be fixed to the respective end of the crankshaft 701 via a respective crank fitting 736-L and 736-R. The crankshaft 701 may be rotatably supported on the frame 510 via one or more bearings 732, which may be used to rotatably couple the crankshaft 701 to a first tube 551 (FIG. 25) fixed to the frame 510. The first tube 551 may be rigidly coupled to (e.g., by being welded, brazed, or bolted or otherwise fastened, or by being integrally formed with) the mast 515. The first tube 551 may be arranged with its axial direction transversely to the mast 515. In some embodiments, the first tube 551 is fixed to the mast 515 proximate or at the location where the connecting support 514 joins the upright support 518. In other embodiments, the first tube 551 may be supported at a different suitable locations on the mast 515 or frame 510.

The flywheel 710 is rotatably coupled to the frame 510. The flywheel 710 may be fixedly coupled to an output shaft 758. One or more bearings 738 may be received in a second tube 552 which may be fixed to the mast 515, e.g., below the first tube 551, or otherwise supported on the frame. The output shaft 758 may be rotatably supported on the frame 510 via the one or bearings 738, which may be used to coaxially rotatably couple the transmission shaft 758 to the second tube 552. The second tube 552 may be fixed to the mast 515, such as on the upright frame support 518 (see, e.g., FIG. 24). In other examples, the second tube 552 may be fixed to other locations on the mast 515 such as the upright support 516, the connection support 514, or other suitable location. In some embodiments, the second tube 552 may be vertically aligned, or close to being vertically aligned, with the first tube 551, for example within a maximum of 5-10 inch vertical offset therefrom. Thus, the crankshaft 701 may be located above the output shaft 758 in close vertical alignment with one another. The sizes (e.g., diameter) of the flywheel 710 and the disk 752 may be similar, whereby the similar dimensions of these rotating components and their close vertical alignment may further facilitate the compact profile of the exercise machine.

The rotation of the first driven member (e.g., input disk 752) may be transmitted, e.g., via the first belt 756, to the first follower member (e.g., output disk 754). The output disk 754 may be mounted on the output shaft 758 with the flywheel 710 such that rotation of the output disk 754 causes the flywheel 710 to rotate synchronously with the output disk 754. In the present example, the first follower member (e.g., output disk 754) has a smaller diameter than the first driven member (e.g., input disk 752) and thus the first stage 750-1 gears up (i.e., increases) the rotational speed of the output shaft 758 relative to the input shaft (i.e., the crankshaft 701) such that the crankshaft 701 is operatively coupled to the flywheel 710 to cause the flywheel 710 to rotate responsive to, but asynchronously with, the crankshaft 701. The smaller relative diameter of the output disk 754 to the diameter of the input disk 752 thus may also increase the rotational speed of the flywheel 710 relative to the speed of the input disk 752. In other examples, disks (e.g., input disk 752 and/or the output disk 754) may be fixed to their respective shafts by plate mounts as previously described with respect to the transmission assembly 350, or they may be differently coupled to the respective shafts such as by being directly attached (e.g., bolted) to the shaft. In other embodiments, a different suitable gearing arrangement may be used.

Figure 28B:
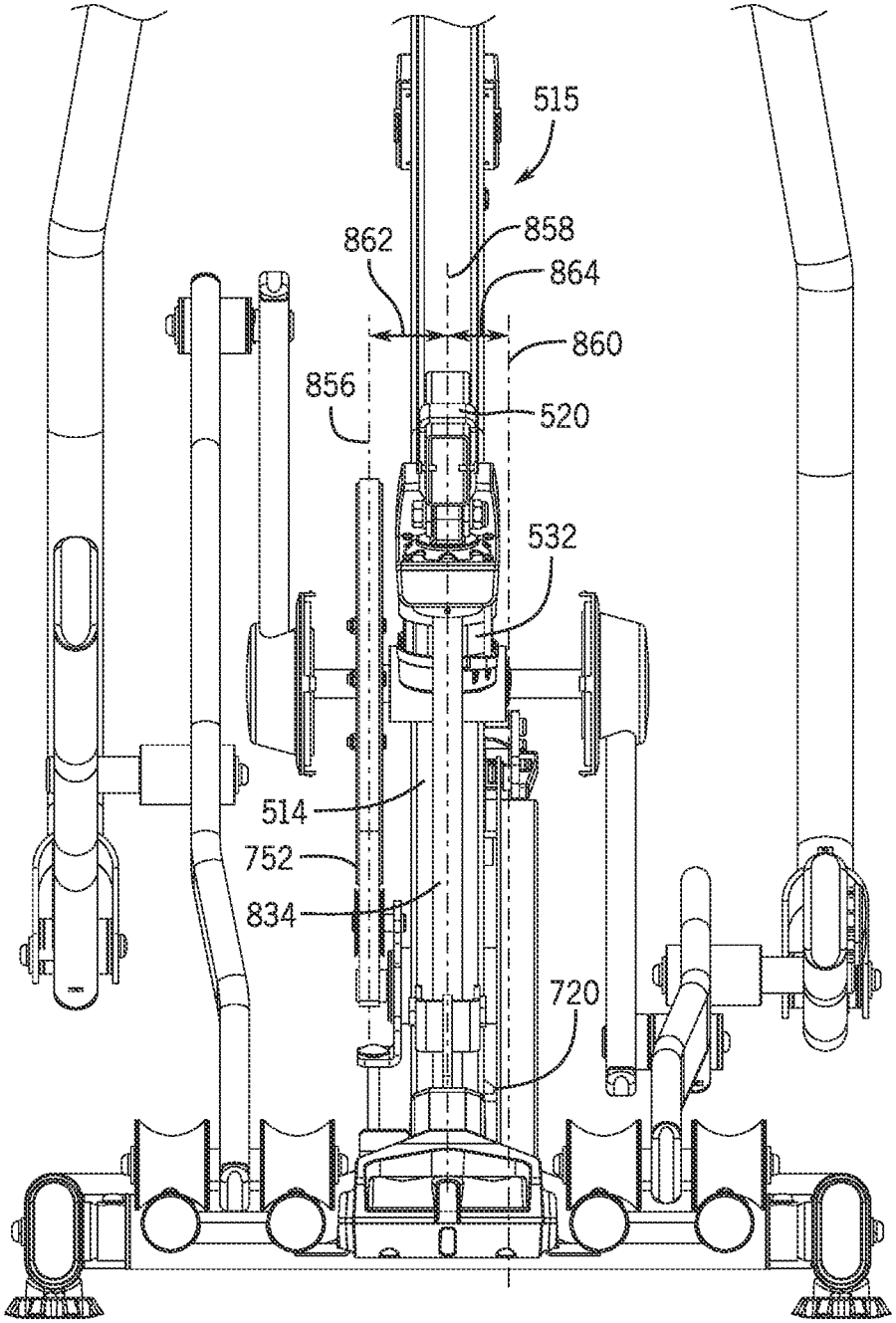
FIG. 28B is a rear, enlarged view of a portion of the exercise machine in FIG. 28A with the pedals removed.
Figure 29:
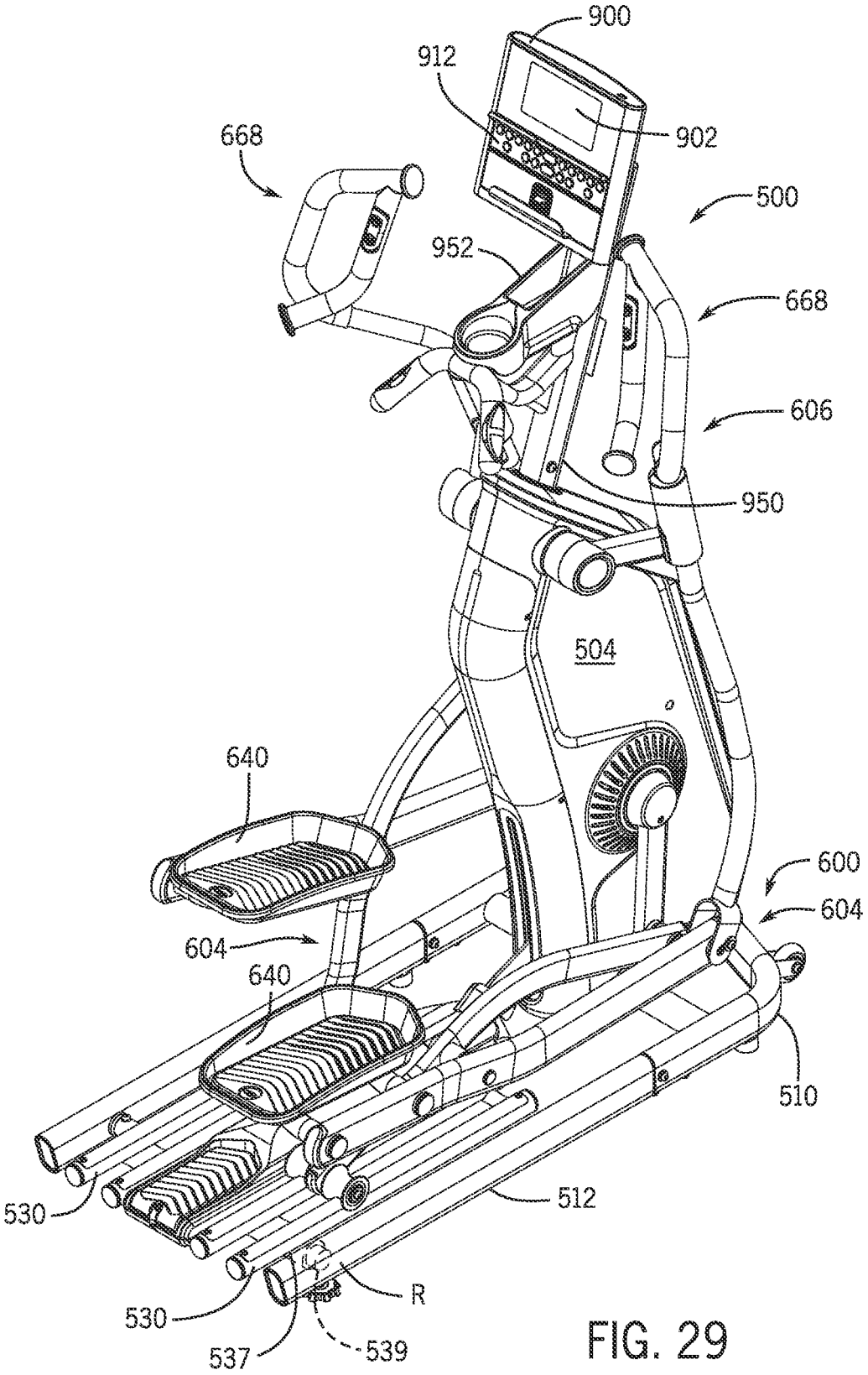
FIGS. 29-34 are rear isometric, front isometric, side, rear, front, and top views of an exercise machine according to the present disclosure, illustrated in these figures with an enclosure around certain movable components of the exercise machine.
Figure 30:
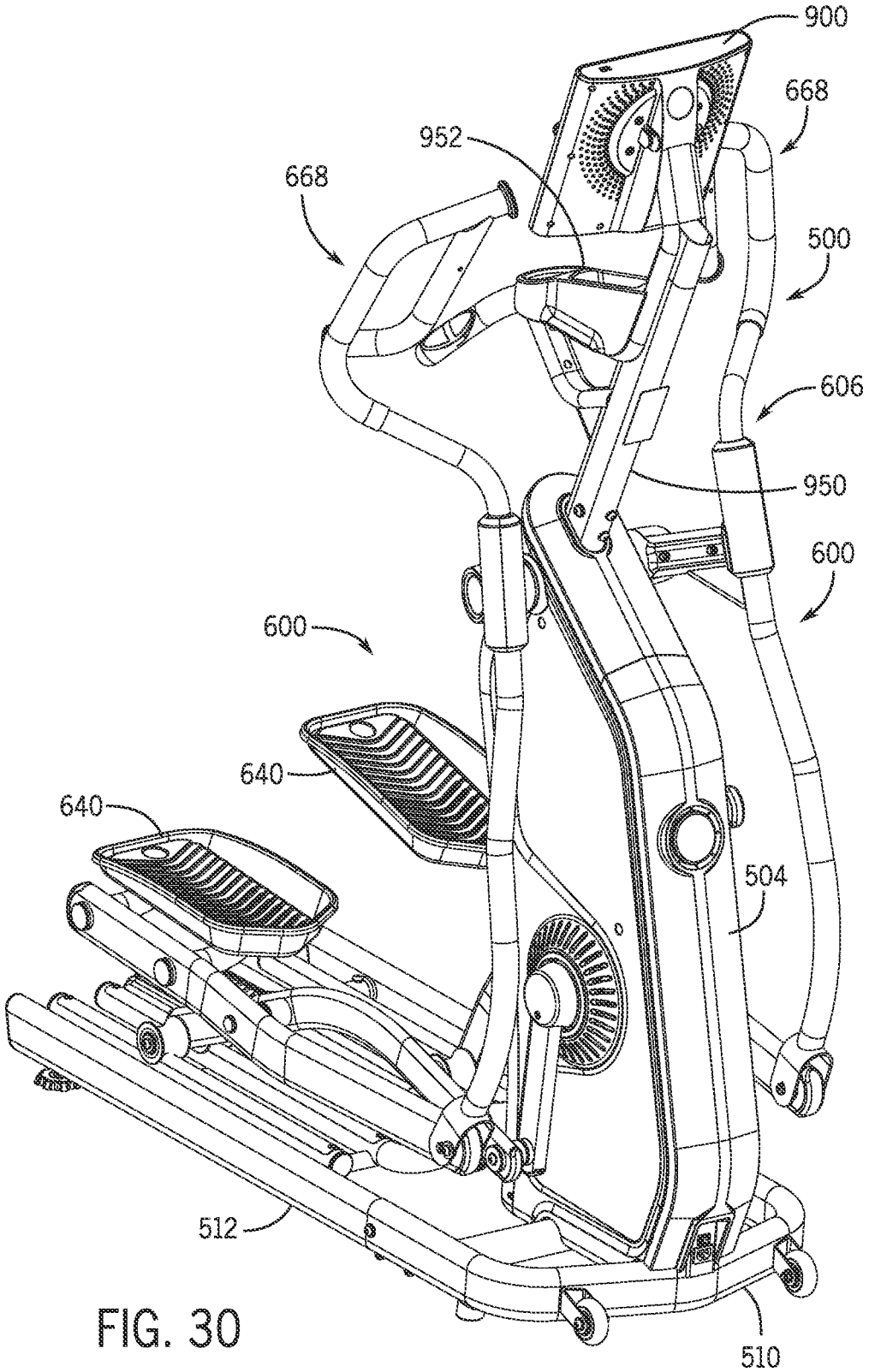
Figure 31:
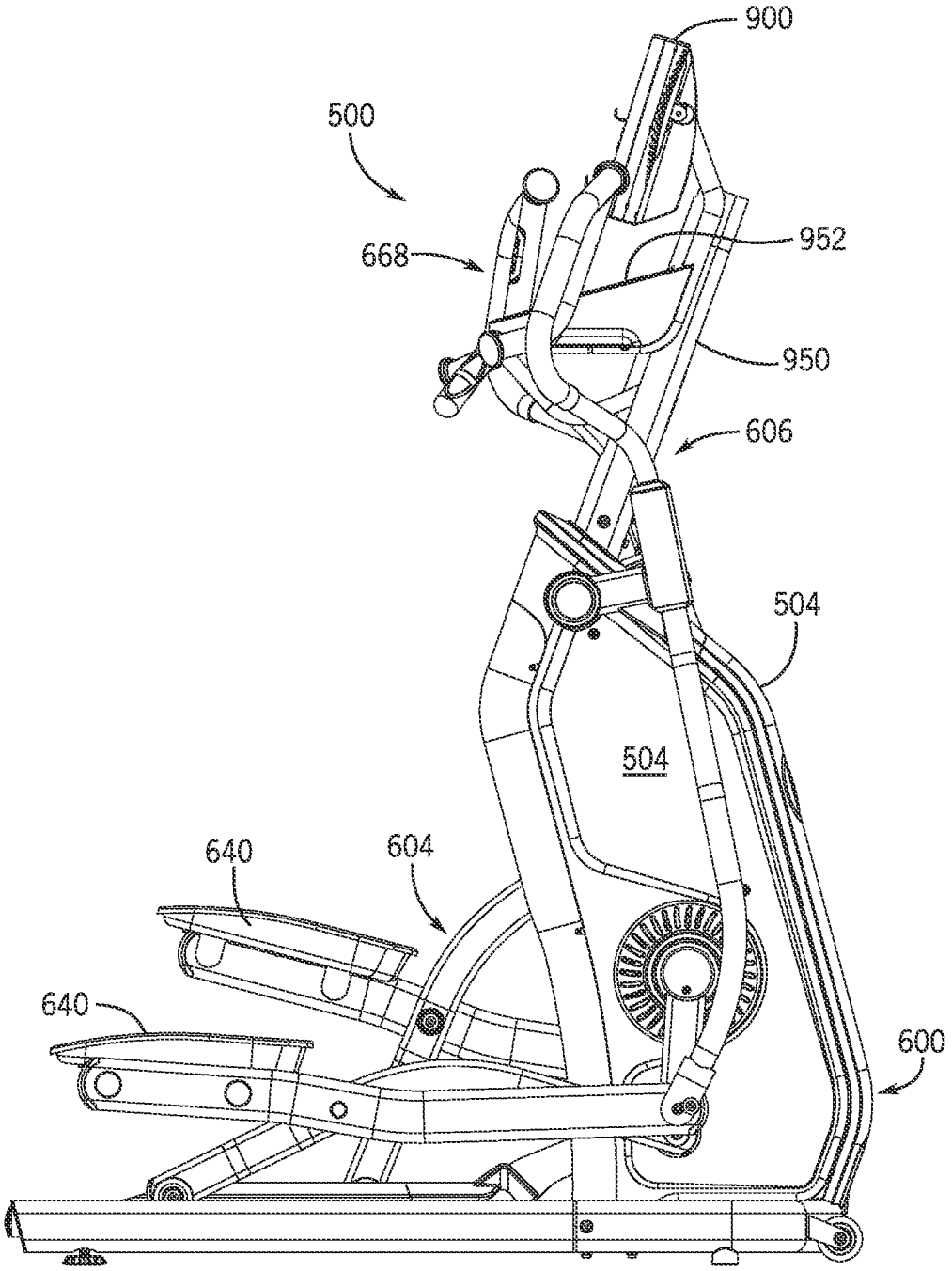
Figure 32:
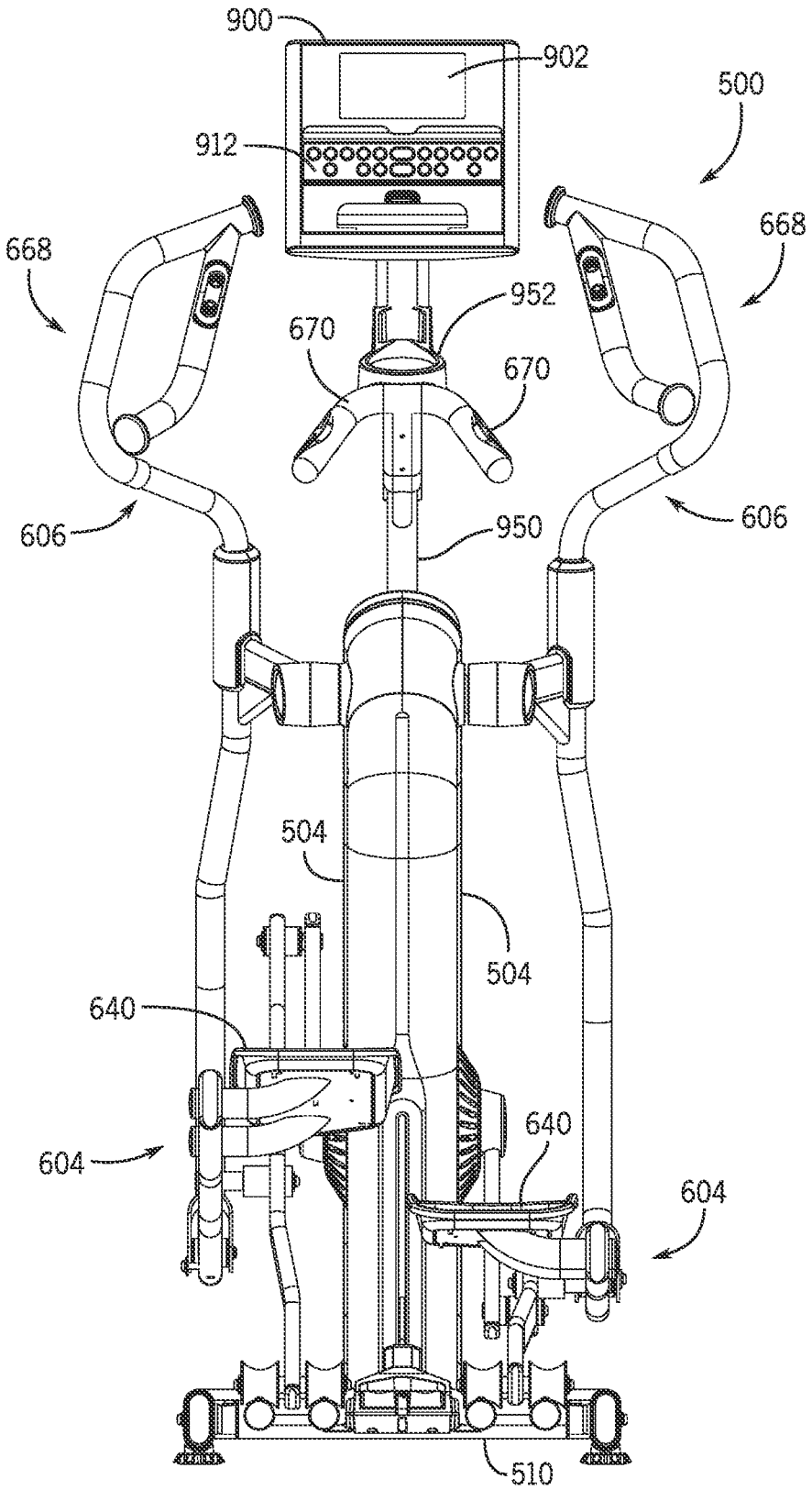
Figure 33:
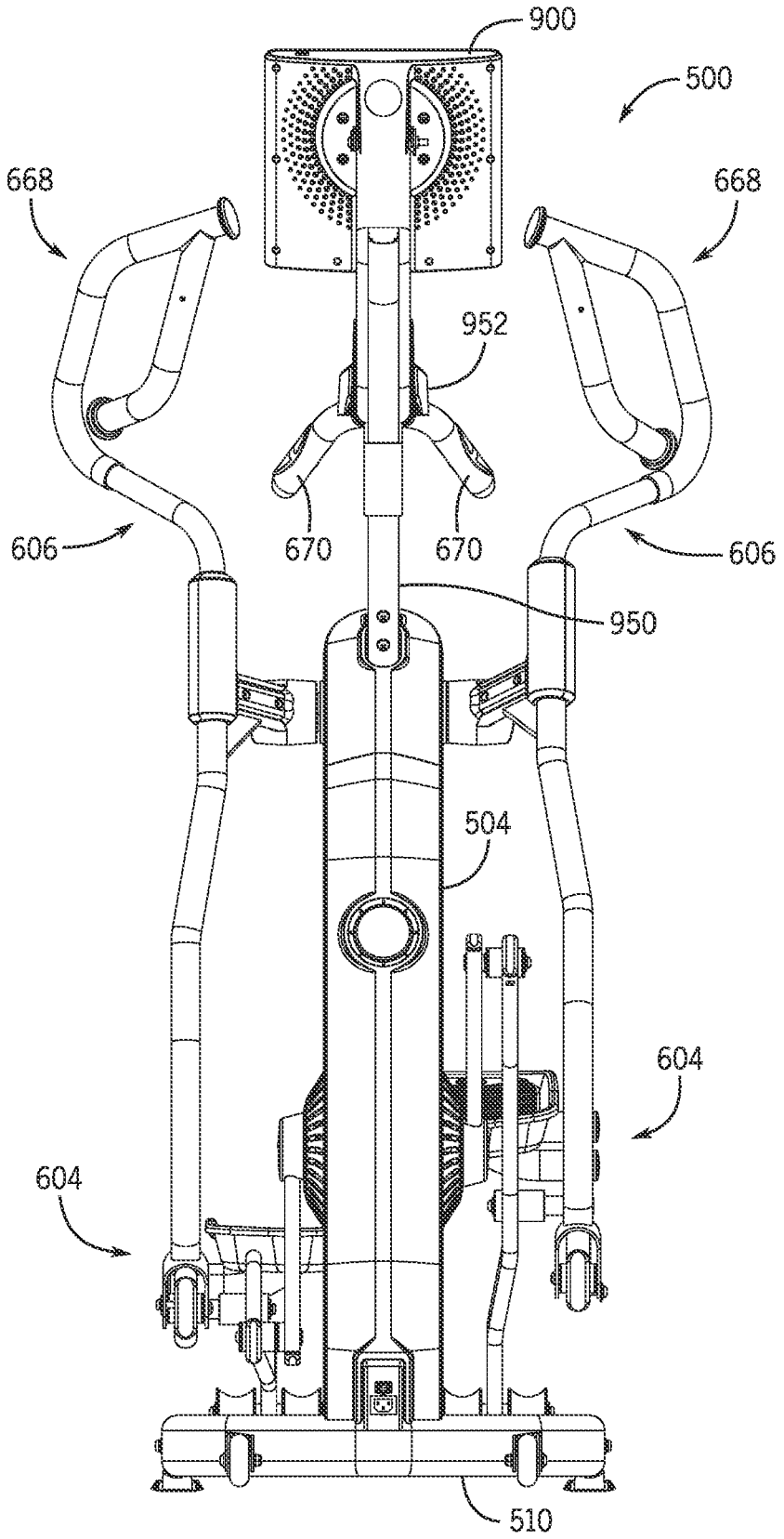
Figure 34:
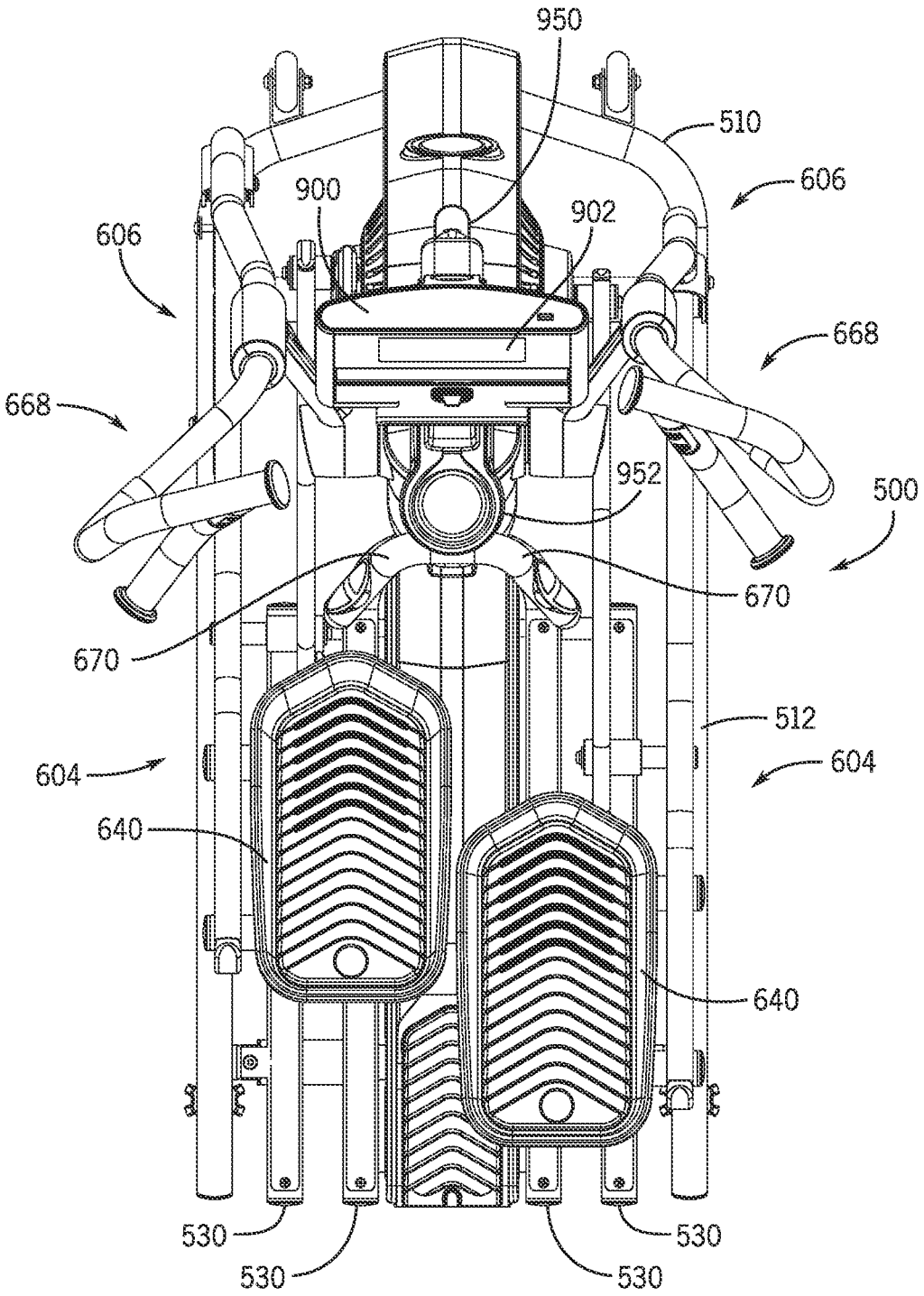

The input disk 752 and the flywheel 710 may be located on opposite sides of a the mast 515, e.g., on opposite sides of the support 516, 518, and/or 514. For example, as shown in FIG. 24, the input disk 752 is located on one (e.g., left) side of the supports 516, 518 and 514 and the flywheel 710 is located on the opposite (e.g., right) side of the supports 516, 518, and 514. In other embodiments, the sides on which the input disk 752 and flywheel 710 are located may be reversed from those shown in FIG. 24. As previously noted, the first and second tubes 551, 552 may be in close vertical alignment but at sufficient vertical spacing to avoid interference of the rotatable components. The lift mechanism 800 may be positioned between the two rotating disks (e.g., the input disk 752 and the flywheel 710), in some embodiments substantially centered to the mast 515 so as to further facilitate the compact form factor of the exercise machine. As can be seen in FIGS. 25 and 28B, the input disk 752 may generally defines a first plane 856 and the flywheel 710 may generally defines a second plane 860. The lift motor 832 (e.g., the rod and driven portion thereof) may define and/or extend in a third plane 858, which is between the first and second planes. The two rotating disks are laterally spaced apart by a sufficient distance to accommodate the lift motor therebetween. The third plane 858 may be offset transversely, towards center, from the first plane 856 by a first distance 862, and from the second plane 860 by a second distance 864. In some embodiments, the first and second distances 862 and 864 are substantially the same and thus the lift motor is substantially centered between the two rotating disks. In other embodiments, the first and second distances 862 and 864 (e.g., due to one of the rotating disks being positioned closer to the mast 515 than the other). The lift motor 832 is arranged to remain between the respective planes 856 and 860 of the rotating disk 752 and the flywheel 710 during its full range of motion.

In some embodiments, for example when using belt or chain drives, a tensioner mechanism may be provided to remove slack from a flexible transmission member, such as a belt or chain (e.g., the belt 756). For example, an idler 772, which may be implemented pulley, roller, sprocket, other suitable structure and depending on the type of transmission member being used, may be operatively engaged with the flexible transmission member (e.g., the belt 756). The idler may be supported on a bracket 774, which may be adjustably and/or biasingly coupled to the frame to tension (or biased) the idler 772, in some cases adjustably, toward the flexible transmission member (e.g., first belt 756), which may cause a bend in the flexible transmission member (e.g., first belt 756) towards the inside of the loop. In some examples, an idler may be associated with each of the flexible transmission members of the transmission assembly 750.

FIGS. 29-34 show additional views of an exercise machine 500, shown here with a shroud 504. The shroud 504 may enclose certain components of the exercise machine 500, such as the resistance mechanism 700 and the lift mechanism 800, to prevent interference with these components during normal use of the machine, e.g., to reduce the risk of injury and/or provide an aesthetically more pleasing look of the exercise machine 500.

An exercise machine according to any embodiments of the present disclosure (e.g., machine 100 or machine 500) may include a console 900 for controlling one or more operations of the exercise machine. In some embodiments, the console 900 may be operable to display content and/or facilitate interaction with the user while the user is exercising. The console 900 may be mounted on the frame 510 (e.g., on the mast 515) in a convenient location, such as to position elements of the console 900 (e.g., the display 902, user controls 912, etc.) at a location accessible to the user while exercising with the exercise machine. The console 900 may be integrated into the machine (e.g., at least partially enclosed by the shroud 504). In some embodiments, at least a portion of the console 900, such as the display 902, may be removably mounted to the exercise machine 500. In some embodiments, the console 900 may be mounted on a console support 950, which extends from or is integrated with the upper end of the mast 515. In some embodiments, the console 900 and/or the console support 950 may be configured to adjusting the vertical position, the horizontal position, and/or orientation of the console 900 or a component thereof (e.g., the display) with respect to the rest of the frame 510 (e.g., relative to the mast 515).

Figure 35:
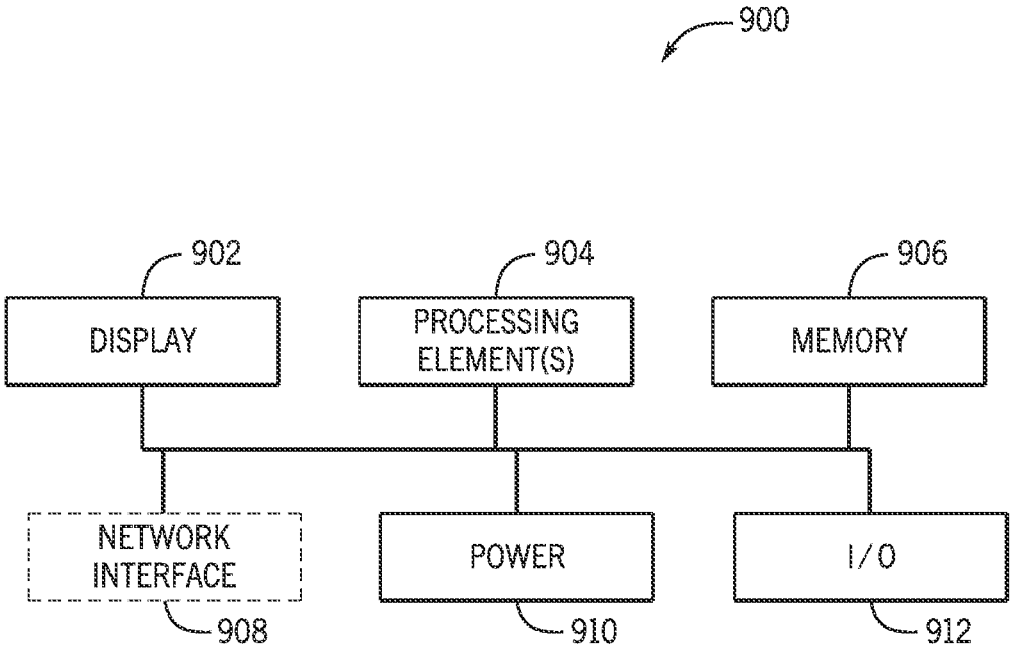
FIG. 35 is a simplified block diagram of a control system suitable for use with the exercise machines of FIGS. 1 and 21.

FIG. 35 illustrates a block diagram of the console 900. As shown, the console 900 may include one or more processing elements (or simply processor) 904, a display 902, memory 906, an optional network/communication interface 908, a power source 910, and one or more input/output (I/O) devices 912. The various components may be in direct or indirect communication with one another, such as via one or more system buses or other electrical connections, which may be wired or wireless.

The processor(s) 904 may be implemented by any suitable combination of one or more electronic devices (e.g., one or more CPUs, GPUs, FPGAs, etc., or combinations thereof) capable of processing, receiving, and/or transmitting instructions. For example, the processor(s) 904 may be implemented by a microprocessor, microcomputer, graphics processing unit, or the like. The processor(s) 904 may include one or more processing elements or modules that may or may not be in communication with one another. For example, a first processing element may control a first set of components of the console 900 and a second processing element may control a second set of components of the console 900 where the first and second processing elements may or may not be in communication with each other. The processor(s) 904 may be configured to execute one or more instructions in parallel locally, and/or across a network, such as through cloud computing resources or other networked electronic devices. The processor 904 may control various elements of the exercise machine, including but not limited to the display 902.

The display 902 provides an output mechanism for the console 900, such as to display visual information (e.g., images, videos and other multi-media, graphical user interfaces, notifications, exercise performance data, exercise programs and instructions, and the like) to a user, and in certain instances may also act to receive user input (e.g., via a touch screen or the like), thus also functioning as an input device of the console. The display 902 may be an LCD screen, plasma screen, LED screen, an organic LED screen, or the like. In some examples, more than one display 902 may be used. The display 902 may include or be otherwise associated with an audio playback device (e.g., a speaker or an audio output connector) for providing audio data associated with any visual information provided on the display 902. In some embodiments, the audio data may instead be output via a Bluetooth or other wireless connection.

The memory components 906 store electronic data that may be utilized by the console 900, such as audio files, video files, document files, programming instructions, media, and the like. The memory components 906 may be, for example, non-volatile storage, a magnetic storage medium (e.g., a hard disk), optical storage medium, magneto-optical storage medium, read only memory, random access memory, erasable programmable memory, flash memory, or a combination of one or more types of memory components. In some embodiments, memory 906 may store one or more programs, modules and data structures, or a subset or superset thereof. The program and modules of the memory 906 may include, but are not limited to, an operating system, a network communication module, a system initialization module, and/or a media player. The operating system may include procedures for handling various basic system services and for performing hardware dependent tasks. Further, a system initialization module may initialize other modules and data structures stored in the memory 906 for the appropriate operation of the console. In some embodiments, the memory 906 stores, responsive to the processor 904, exercise performance data (e.g., resistance level, cadence, power, user heart rate, etc.) obtained or derived from measurement by one or more sensors on the exercise machine. In some embodiments, the memory 906 may store one or more exercise programs and instructions, which cause the processor 904 to adapt one or more of the exercise programs based on the exercise performance data. The memory 906 may store the adapted exercise program(s) and may subsequently cause the processor 904 to control an operation of the exercise machine in accordance with the adapted exercise program(s). For example, the processor 904 may provide instructions the user, e.g., via the display or other component of the console, for adjusting the configuration of the machine (e.g., the incline of the rail, the resistance level) or the user's performance (e.g., a cadence) in accordance with the adapted exercise program. In some embodiments, the processor 904 may automatically, concurrently with or alternatively to providing instructions, adjust the configuration of the machine (e.g., the incline, the resistance, etc.) in accordance with the adapted exercise program.

The network/communication interface 908, when provided, enables the console 900 to transmit and receive data, to other electronic devices directly and/or via a network. The network/communication interface 908 may include one or more wireless communication devices (e.g., Wi-Fi, Bluetooth or other wireless transmitters/receivers). In some embodiments, the network/communication interface may include a network communication module stored in the memory 906, such as an application program interface (API) that interfaces and translates requests across the network between the network interface 908 of the console 900 and other devices on the network. The network communication module may be used for connecting the console 900 to other devices (such as personal computers, laptops, smartphones, and the like) via the network interface 908 in communication with one or more communication networks (wired or wireless), such as the Internet, other wide area networks, local area networks, metropolitan area networks, personal area networks, and so on.

The console 900 may also include and/or be operatively associated a power supply 910. The power supply 910 provides power to the console 900. The power supply 910 may include one or more rechargeable batteries, power management circuit(s) and/or other circuitry (e.g., AC/DC inverter, DC/DC converter, or the like) for connecting the console 900 to an external power source. Additionally, the power supply 910 may include one or more types of connectors or components that provide different types of power to the console 900. In some embodiments, the power supply 910 may include a connector (such as a universal serial bus) that provides power to the an external device such as a smart phone, tablet or other user device.

The one or more input/output (I/O) devices 912 allow the console 900 to receive input and provide output (e.g., from and to the user). For example, the input/output devices 912 may include a capacitive touch screen (e.g., a touch screen associated with the display 902), various buttons, knobs, dials, keyboard, stylus, or any other suitable user controls. In some embodiments, inputs may be provided to the console (e.g., to processor 904) also via one or more biometric sensors (e.g., a heart rate sensor, a fingerprint sensor), which may be suitably arranged on the exercise machine, such as by placing them at one or more locations likely to be touched by the user during exercise (e.g., on a handle 668 and/or 670 of the exercise machine). The input/output devices 912 may include an audio input (e.g., a microphone or a microphone jack). In some embodiments, the processor 904 may be configured to receive user inputs (e.g., a voice command) via the audio input. One or more of the input/output devices may be integrated with or otherwise co-located on the console 900. For example, certain buttons, knobs and/or dials, may be co-located with the display 902, which may be a passive or touch sensitive display, on the console 900. In some examples, one or more of the input devices (e.g., button for controlling volume or other functions of the console) may be located elsewhere on the exercise machine, e.g., separately from the display 902. For example, one or more buttons may be located on one or more handles 668, 670 of the exercise machine. As shown in FIG. 28A, one or more user input devices 914-1, 914-2 may be disposed on a movable handle 668, such as on a handle grip location 668-2, which may allow the user to interact with the exercise machine such as to configure an aspect of the exercise machine 100, 500 without removing their grip from the handle and interrupting the exercise motion. One or more user input devices 916-1, 916-2 may be disposed on a stationary handle such as a handle 670, or other stationary locations such as near the display. For example, a biometric sensor, such as a fingerprint reader, may be located on or near the console for identifying the user before starting to exercise. The one or more input devices 914-1, 914-2, 916-1, 916-2 may be implemented by one or more buttons, capacitance detectors, heart rate monitors, or other suitable devices to detect a user input. The input devices 914-1, 914-2, 916-1, 916-2 may detect volitional inputs of a user (e.g., a user command). The input devices 914-1, 914-2, 916-1, 916-2 may detect biometric data of the user such as a skin galvanic response, heart rate, pule oxidation, or other biometric data.

Operation of an input device 914-1, 914-2, 916-1, 916-2 may control a configuration or operation of a portion of the exercise machine 100, 500. For example an input device 914-1, 914-2, 916-1, 916-2 may include any suitable user control, such as a button for adjusting (e.g., raising and/or lowering) the lift mechanism 400, 800; changing the resistance level of the resistance mechanism 300, 700, or the like. In some examples, an input device 912 (e.g., any of the input devices 914-1, 914-2, 916-1, 916-2) may be in communication, directly or via the processor 904, with a controller (e.g., controller 360, 760) and/or the brake 320, 720 to control an aspect of the exercise machine 100, 500. A user input device 912 may be in direct communication with the controller 360, 760 and/or brake 320, 720, or indirectly, such as via processor 904. For example, user input f may be received via an input device 912, which is then received by the processor 904, which consequently interprets the input and issues a command to the controller 360, 760 and/or brake 320, 720 to reconfigure the exercise machine 100, 500.

In some embodiments, the incline and/or resistance may be adjusted by the processing element 904 based on an exercise sequence or program stored in memory 906. In some examples, the exercise sequence may define a set of time intervals at various incline and/or resistance levels. In some embodiments, the console may additionally or alternatively communicate the exercise sequence to the user, such as in the form of instructions (e.g. audio and/or visual) on the timing of and settings to which a user should adjust the incline and/or resistance. In some embodiments the exercise sequence may be adapted (e.g., by processor 904) over time based on the user's prior performance of the exercise sequence or portion(s) thereof. The console may be configured to enable the user to interact with the exercise program, such as to manually adjust it and/or override it (e.g., for exercising in manual mode). In some embodiments, the console may be configured to present, independent of or concurrently with an exercise program, stored or streamed video content (e.g., scenery which may be recorded or computer generated), the playback of which may be dynamically adapted, in some embodiments, based on the user's movements of the upper and/or lower linkages. For example, the console 900 may present a video of a scene (e.g., a trail in Central Park in New York City, a boardwalk, or a fictional scene) presented from the vantage point of a user advancing through the scene and which may include real, virtual, and/or augmented reality content, on the display 902. As the user exercises, the processor 904 may determine a speed of travel of the user, e.g., based on the rotational speed of the crankshaft and/or the incline of the rail, and may change the playback rate of the video (e.g., speed it up and slow it down) to provide a more realistic experience of the rate at which the user advances through the scenery. In some embodiment, the scenery is configured to match a particular exercise program such as to display a hilled terrain for time intervals performed at relatively higher incline, and generally flat terrain for time intervals performed at relatively lower incline. The processor 904 may facilitate a generally synchronized progression through the scenery and the exercise sequence, e.g., by adjusting the playback to match the user's progression through the exercise sequence. Alternatively, the exercise machine may adjust the machine's configuration (e.g., incline and/or resistance) based on the scenery, such as to increase incline and/or resistance when the scenery presents a path up a hill, and decrease the incline and/or resistance when the scenery presents level ground or downhill terrain. The display 902 may display the interactive environment in a first person view (e.g. as seen by a user) or in a third person view (e.g., a view of the user as seen by an observer). For example, the scene may be displayed from point of view above, behind, and/or to a side of the user. The interactive environment may be as described in U.S. Pat. No. 10,810,798, titled "Systems and Methods For Generating 360 Degree Mixed Reality Environments," which is incorporated herein by reference for all purposes.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. An exercise machine comprising:

a frame comprising a base configured to support the exercise machine on a support surface and a mast extending upwardly from the base and comprising:

a first upright support extending from a front end of the base, a second upright support extending from the base, and a third upright support connecting an intermediate location of the second upright support to the first upright support;

a crankshaft rotatably coupled to the frame to rotate about a first rotation axis;

a reciprocating member supporting a pedal such that the pedal is constrained to move in a closed loop path, and wherein the reciprocating member is operatively coupled to the crankshaft such that movement of the pedal in the closed loop path causes rotation of the crankshaft about the first rotation axis;

a rail pivotally coupled to the frame and movably supporting the reciprocating member, wherein the reciprocating member is configured to translate along the rail when the pedal moves in the closed loop path; and a lift mechanism suspended from the mast from a location above the first rotation axis and operatively coupled to the rail for adjusting an incline of the rail.

2. The exercise machine of claim 1, wherein the second upright support connects to an intermediate location of the first upright support.

3. The exercise machine of claim 2, further comprising a resistance mechanism operatively coupled to the crankshaft to resist rotation of the crankshaft.

4. The exercise machine of claim 3, wherein the resistance mechanism comprises a flywheel rotatably supported by the frame.

5. The exercise machine of claim 4, wherein the flywheel is rotatably supported on the mast.

6. The exercise machine of claim 5, wherein the crankshaft and the flywheel rotate at different rotational speeds.

7. The exercise machine of claim 6, further comprising a transmission assembly that transmits the rotation of the crankshaft to the flywheel while changing the rotational speed thereof.

8. The exercise machine of claim 7, wherein the transmission assembly comprises a rotating disk fixed to the crankshaft to rotate in synchrony with the crankshaft and wherein the rotating disk and the flywheel are located on opposite sides of the mast.

9. The exercise machine of claim 8, wherein the lift mechanism is positioned between the rotating disk and the flywheel such that the driven portion moves in a plane parallel to and between respective planes of the rotating disk and the flywheel.

10. The exercise machine of claim 7, wherein the transmission assembly comprises a single-stage belt-drive assembly.

11. The exercise machine of claim 5, wherein the flywheel is rotatably supported on the mast at a vertical location below the crankshaft.

12. The exercise machine of claim 2, further comprising a console supported by the frame, wherein the console includes a processor, a memory, and a display, and wherein the processor is in communication with one or more user input devices for controlling an operation of the exercise machine.

13. The exercise machine of claim 12, wherein the one or more user input devices are configured to receive user input for varying at least one of the incline of the rail, a resistance level, and information displayed on the display.

14. The exercise machine of claim 13, wherein the information displayed on the display comprises a video, and wherein the processor is configured to vary a playback rate of the video based on a rate of rotation of the crankshaft.

15. The exercise machine of claim 12, wherein the one or more user input devices include one or more buttons located on a movable handle of the exercise machine.

16. The exercise machine of claim 12, wherein the memory includes instructions that cause the processor to:

store exercise performance data in the memory;

adjust an exercise program stored in the memory based on the exercise performance data to generate an adapted exercise program; and provide instructions, via the console, for adjusting at least one of the incline of the rail and the resistance level in accordance with the adapted exercise program, or automatically adjust at least one of the incline of the rail and the resistance level in accordance with the adapted exercise program.

17. The exercise machine of claim 2, wherein the second upright support has a first end fixed to the base at a location aft of the first upright support.

18. The exercise machine of claim 17, wherein the crankshaft is rotatably coupled to the mast at the intermediate location of the second upright support.

19. The exercise machine of claim 17, wherein an upper portion of the first upright support and the third upright support are inclined toward a rear side of the exercise machine.

20. The exercise machine of claim 2, wherein the frame comprises a cantilever fixed to the mast at the location above the first rotation axis and extending rearward toward the rail, and wherein the lift mechanism is suspended from the mast via the cantilever.

21. The exercise machine of claim 20, wherein the lift mechanism comprises a first end portion including a motor, the first end portion pivotally joined to the cantilever, and a driven portion pivotally joined to the rail, the motor configured to move the driven portion toward and away from the first end portion to raise and lower the rail, respectively.

22. The exercise machine of claim 2, wherein a length of the base is about 52 inches or less, and wherein the rail is adjustable to at least 20 degrees of incline.

23. The exercise machine of claim 2, wherein a first end of the reciprocating member is slidably supported on the rail and a second end of the reciprocating member is configured to rotate about the crankshaft when the pedals move along the closed loop path.

24. The exercise machine of claim 2, wherein the reciprocating member is coupled to the crankshaft via a crank arm.

25. The exercise machine of claim 2, wherein the pedal is cantilevered from the reciprocating member.

* * * * *